US009427065B2

(12) United States Patent
Palmieri

(10) Patent No.: US 9,427,065 B2
(45) Date of Patent: Aug. 30, 2016

(54) RECIPROCATING ROTATING VIBRATING BIDIRECTIONAL ELECTRIC COSMETIC APPLICATOR

(71) Applicant: Herman David Palmieri, Pittsburgh, PA (US)

(72) Inventor: Herman David Palmieri, Pittsburgh, PA (US)

( * ) Notice: Subject to any disclaimer, the term of this patent is extended or adjusted under 35 U.S.C. 154(b) by 0 days.

(21) Appl. No.: 14/327,749

(22) Filed: Jul. 10, 2014

(65) Prior Publication Data

US 2015/0013713 A1 Jan. 15, 2015

Related U.S. Application Data

(60) Provisional application No. 61/845,376, filed on Jul. 12, 2013.

(51) Int. Cl.

| | |
|---|---|
| ***A45D 40/26*** | (2006.01) |
| ***A46B 13/02*** | (2006.01) |
| ***A46B 9/02*** | (2006.01) |

(52) U.S. Cl.

CPC ..... *A45D 40/265* (2013.01); *A45D 40/267* (2013.01); *A46B 9/021* (2013.01); *A46B 13/02* (2013.01); *A46B 2200/1053* (2013.01)

(58) Field of Classification Search

CPC ..... A45D 40/265; A45D 40/267; A45D 40/262; A45D 40/264; A46B 13/023; A46B 13/04; A46B 13/02; A46B 13/026; A46B 9/021; A46B 2200/1046; A46B 2200/1053; A46B 2200/106; A46B 7/06; A46B 7/08; A46B 7/10

USPC ..... 132/218, 212, 216, 119.1, 317, 320, 132/238; 401/126, 118; 74/20, 21, 22 R, 74/22 A, 23–25

See application file for complete search history.

(56) References Cited

U.S. PATENT DOCUMENTS

| | | | | |
|---|---|---|---|---|
| 3,046,801 | A * | 7/1962 | Pravel | 74/25 |
| 3,661,018 | A * | 5/1972 | Keefer et al. | 74/22 R |
| 4,056,111 | A * | 11/1977 | Mantelet | 132/218 |
| 4,084,280 | A * | 4/1978 | May | 15/22.1 |
| 4,352,300 | A * | 10/1982 | Esch | 74/22 R |
| 4,397,055 | A * | 8/1983 | Cuchiara | 15/22.1 |
| 6,565,276 | B1 * | 5/2003 | Diaz | 401/129 |
| 7,465,114 | B2 * | 12/2008 | Kress et al. | 401/129 |
| 7,762,269 | B2 * | 7/2010 | Wyatt et al. | 132/218 |
| 8,001,981 | B2 * | 8/2011 | Jeong et al. | 132/218 |
| 8,007,192 | B2 * | 8/2011 | Huang | 401/129 |
| 8,028,707 | B2 * | 10/2011 | Wyatt et al. | 132/218 |
| 8,091,560 | B2 * | 1/2012 | Kim et al. | 132/217 |
| 8,162,794 | B2 * | 4/2012 | Hori et al. | 475/331 |
| 8,240,316 | B2 * | 8/2012 | Luo | 132/218 |
| 8,303,205 | B2 * | 11/2012 | Luo | 401/126 |
| 8,327,858 | B2 * | 12/2012 | Neuner et al. | 132/218 |
| 8,327,859 | B2 * | 12/2012 | Pastore | 132/218 |

(Continued)

*Primary Examiner* — Rachel Steitz

(57) ABSTRACT

A device for the purpose of applying cosmetic product which can be made to shear cosmetic product held within its chamber prior to loading a portion of cosmetic product evenly onto the applicator head by way of separating the detachable container from the handle. After separation, the direction of the rotation motion is chosen and the device is activated. Once activated, the drive mechanism converts rotation motion into a reciprocating rotation motion thereby enabling the applicator head to simultaneously travel back and forth and rotate for purposes of applying cosmetic product. The applicator head via transfer vibration can be vibrated along or in conjunction with the reciprocation rotating motion for purposes of apply cosmetic product.

19 Claims, 30 Drawing Sheets

(56) References Cited

U.S. PATENT DOCUMENTS

| | | | | |
|---|---|---|---|---|
| 8,469,041 | B2 * | 6/2013 | Pires et al. | 132/218 |
| 8,529,147 | B2 * | 9/2013 | Delage | 401/127 |
| 8,985,883 | B2 * | 3/2015 | Wyatt et al. | 401/126 |
| 2003/0192564 | A1 * | 10/2003 | Johnson | 132/119.1 |
| 2007/0186948 | A1 * | 8/2007 | Kim et al. | 132/218 |
| 2008/0011316 | A1 * | 1/2008 | Malvar et al. | 132/218 |
| 2009/0188528 | A1 * | 7/2009 | Junkins | 134/6 |
| 2010/0089414 | A1 * | 4/2010 | Wyatt et al. | 132/217 |
| 2010/0101597 | A1 * | 4/2010 | Tsai | 132/218 |
| 2010/0239352 | A1 * | 9/2010 | Huang | 401/121 |
| 2010/0300474 | A1 * | 12/2010 | Tsai | 132/218 |
| 2011/0180095 | A1 * | 7/2011 | Chen | 132/218 |
| 2013/0269457 | A1 * | 10/2013 | Palmieri | 74/57 |
| 2014/0007897 | A1 * | 1/2014 | Huang et al. | 132/218 |
| 2015/0034113 | A1 * | 2/2015 | Yamagishi et al. | 132/200 |

* cited by examiner

RECIPROCATING ROTATING VIBRATING BIDIRECTIONAL ELECTRIC COSMETIC APPLICATOR

This application claims priority in-part to the U.S. Provisional No. 61/845,376 Filed on Jul. 12, 2013.

FIELD OF THE INVENTION

The present invention relates to a device not limited to the application of a cosmetic product, such as mascara to the eyelashes. However and more particularly, the present invention relates to a reciprocating, rotating, vibrating, bidirectional applicator in which the applicator head to touch the face is electrically driven. The present invention also provides for a vibration only means of the applicator head.

BACKGROUND OF THE INVENTION

Many devices such as the rotary mascara applicator; the vibrating mascara applicator; the vibratable and reversibly rotatable mascara applicator; and the reciprocating rotating vibrating bidirectional mascara applicator have been developed that provide a means to apply cosmetic product, such as mascara to eyelashes. However, none provide the advanced mechanical means for the applicator head to simultaneously reciprocate, bidirectionally rotate and vibrate for purposes of applying cosmetic product, such as mascara to the eyelashes as the present invention.

SUMMARY OF THE INVENTION

In view of the foregoing disadvantages inherent in the known prior art, the present invention provides a new reciprocating, rotating, vibrating, bidirectional electric applicator in which the applicator head simultaneously reciprocates, rotates and vibrates for purposes of applying cosmetic product to the face including mascara to the eyelashes eliminating the need to manually rotate and move in a back and forth direction the applicator head of a vibrating applicator; and eliminating the need to manually move in a back and forth direction the applicator head of the vibrating and rotating applicator; and eliminating the need to manually move in a back and forth direction the applicator head of the rotary mascara applicator when applying mascara to the eyelashes.

This new reciprocating, rotating, vibrating, bidirectional electric applicator is characterized in that it comprises a means for loading mascara evenly onto an applicator head; a means for choosing when to activate and deactivate the device; a means for rotation; a means for choosing the direction of the rotation; a means for converting a rotation motion into a reciprocating rotating motion enabling the applicator head to simultaneously travel back and forth and rotate for the purposes of applying cosmetic product to the face including mascara to the eyelashes; a means for vibration of an applicator head in conjunction with the reciprocating rotating motion for purposes of applying cosmetic product to the face including mascara to the eyelashes; and a means for vibration of an applicator head alone for purposes of applying cosmetic product to the face including mascara to the eyelashes.

BRIEF DESCRIPTION OF THE DRAWINGS

For the sake of illustration the preferred features of the invention will now be described with reference to the following figures in which.

DETAILED DESCRIPTION OF PREFERRED EMBODIMENTS

Figure 1:
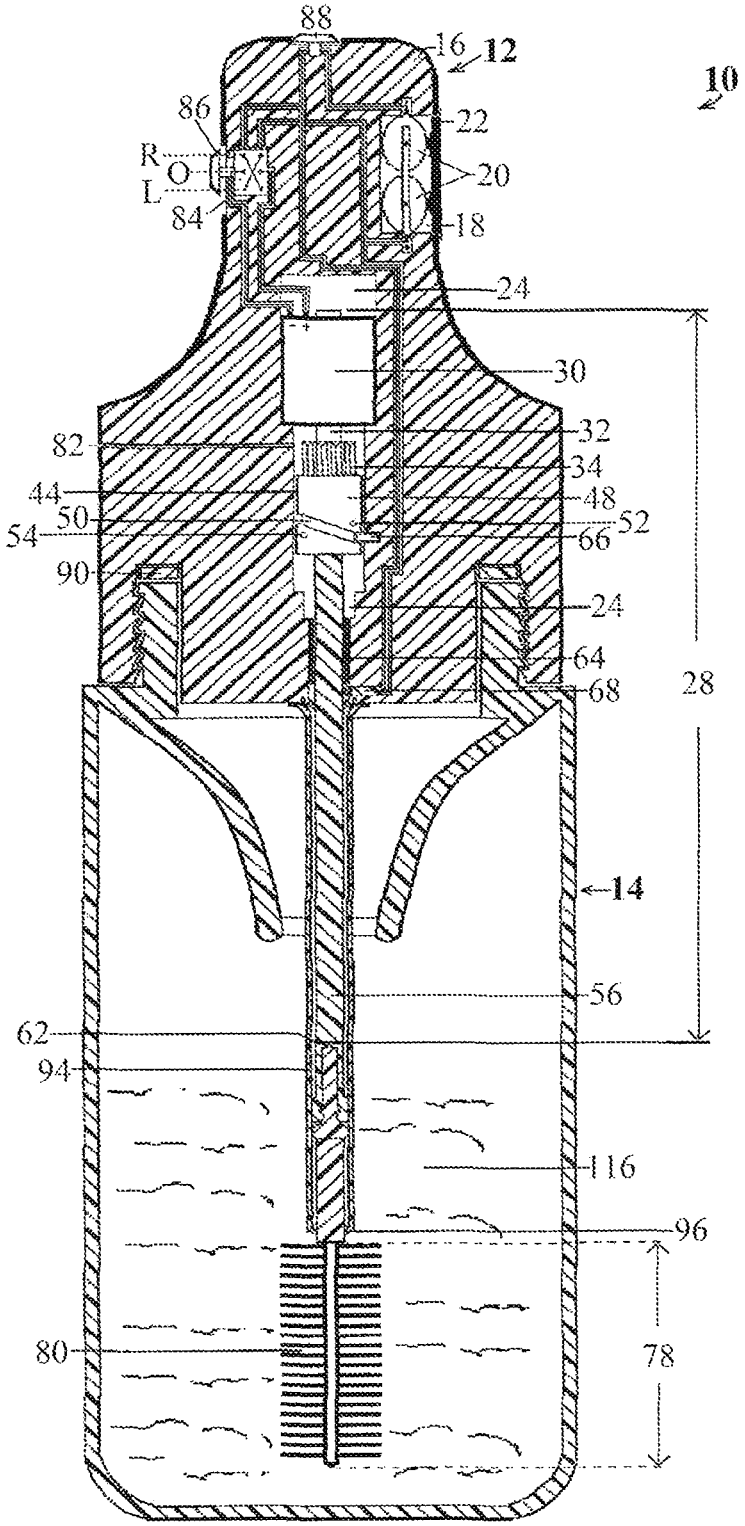
FIG. 1 is a cross-sectional view illustrating the present embodiment of the reciprocating, rotating, vibrating, bidirectional electric cosmetic applicator.
Figure 2:
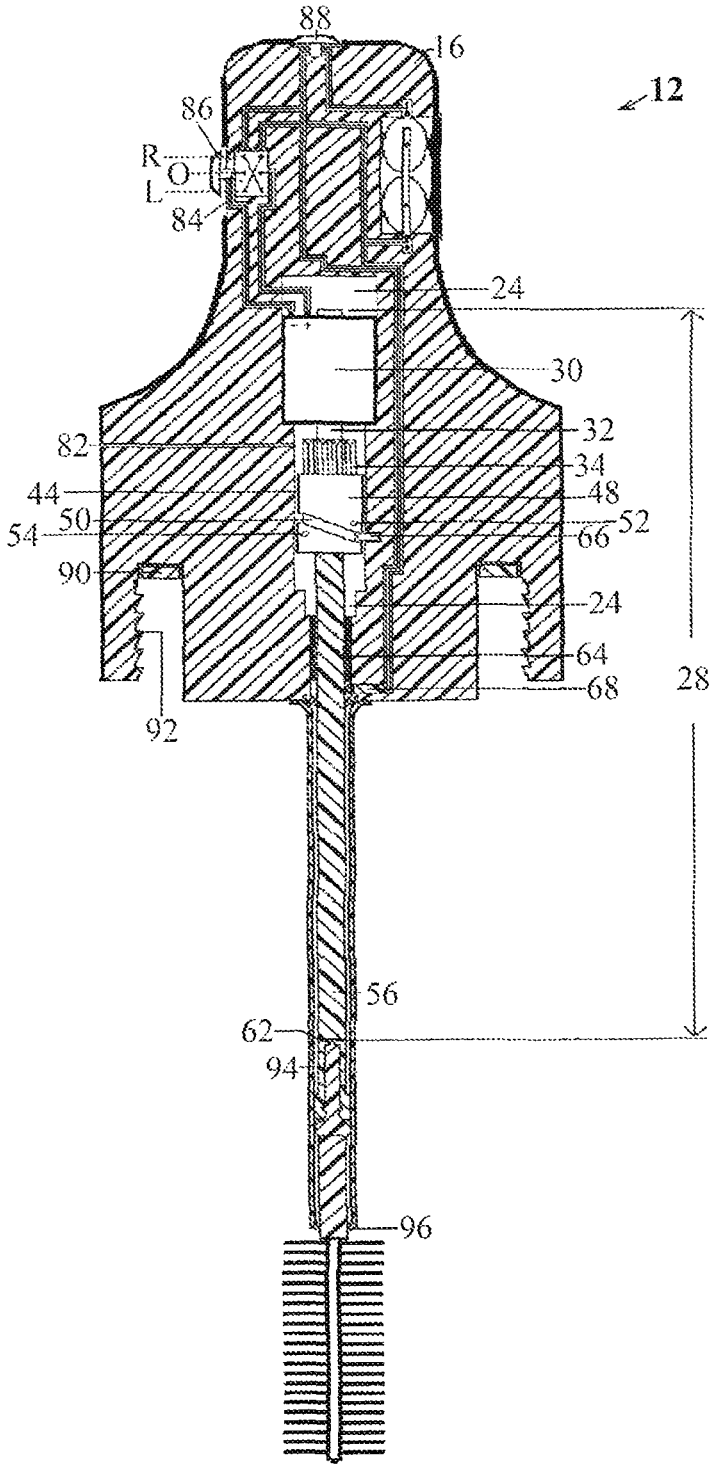
FIG. 2 is a cross-sectional view illustrating a handle portion of the reciprocating, rotating, vibrating, bidirectional electric cosmetic applicator shown in FIG. 1.
Figure 3:
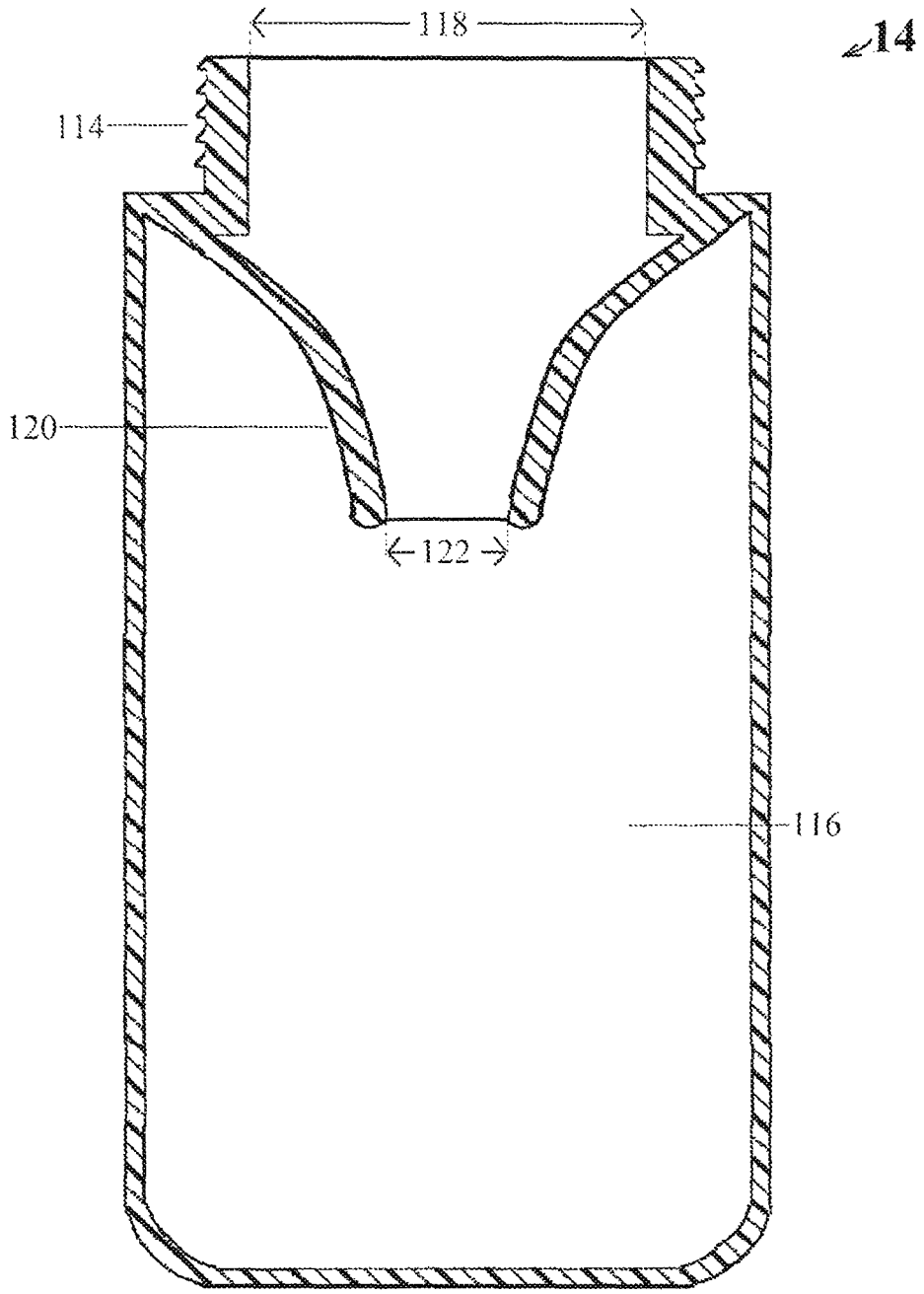
FIG. 3 is an enlarged cross-sectional view illustrating a detachable container portion of the reciprocating, rotating, vibrating, bidirectional electric cosmetic applicator shown in FIG. 1.
Figure 4:
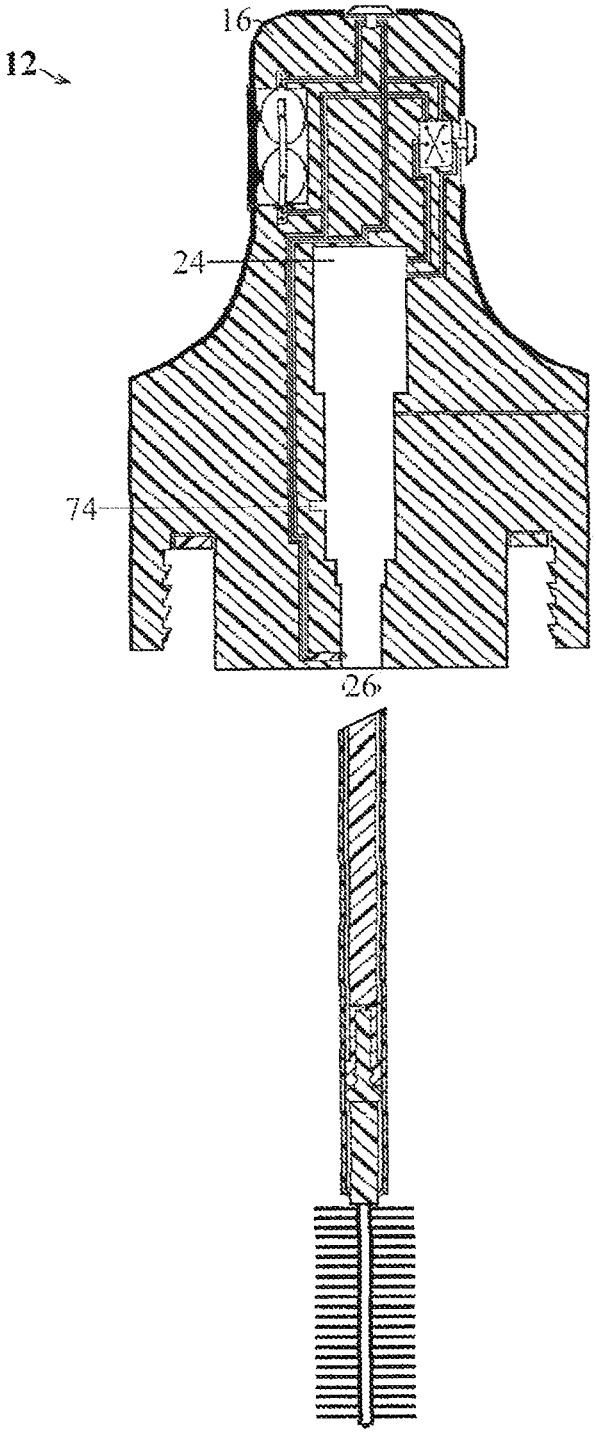
FIG. 4 is a cross-sectional view illustrating an open drive mechanism compartment within the handle housing of the reciprocating, rotating, vibrating, bidirectional electric cosmetic applicator shown in FIG. 1.
Figure 15:
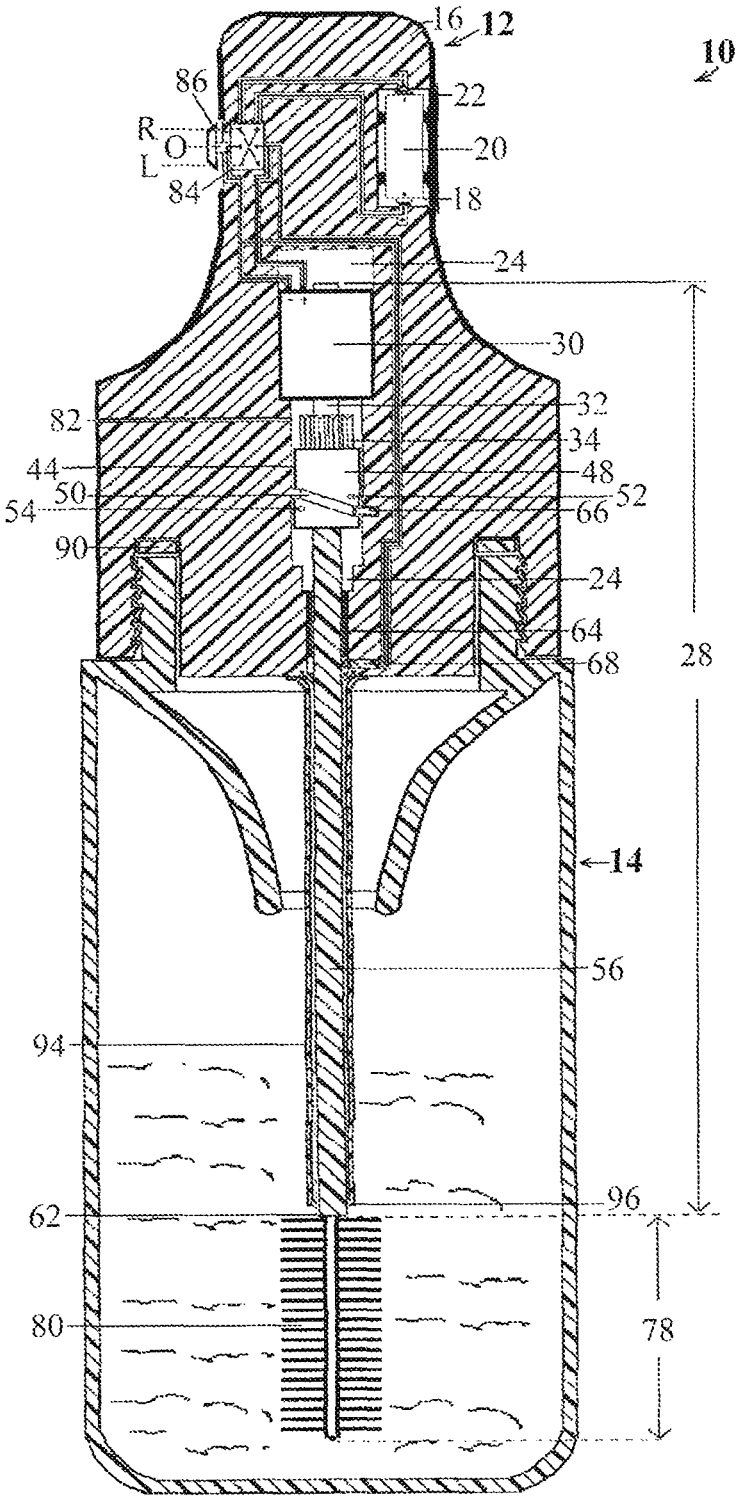
FIG. 15 is a cross-sectional view illustrating an alternative embodiment in which the Push-On/Push-Off switch, the disk coin-type vibration motor and the transfer head are taken out from the reciprocating, rotating, vibrating, bidirectional electric cosmetic applicator shown in FIG. 1.

FIG. 1 shows a Reciprocating Rotating Vibrating Bidirectional Electric Cosmetic Applicator 10. The Reciprocating Rotating Vibrating Bidirectional Electric Cosmetic Applicator 10 comprises handle 12, as shown in FIGS. 1 and 2 and detachable container 14, as shown in FIGS. 1 and 3. Handle 12, as shown in FIG. 1 comprises housing 16; a battery compartment 18 formed within housing 16 houses batteries 20, which can be any kind of Alkaline, Lithium or other suitable batteries, e.g. "AA" or "AAA", as shown in FIG. 15 or "Button Cell" type batteries, as shown in FIG.1; a lid 22 which securely holds batteries 20 within battery compartment 18; and an open drive mechanism compartment 24 formed within housing 16, as shown in FIGS. 1 and 4, having a circular opening 26, as shown in FIG. 4. The boundary and form of the open drive mechanism compartment 24 having a circular opening 26 is illustrated in FIG. 4.

Handle 12 further comprises a drive mechanism 28, as shown in FIGS. 1, 2, and 5 thru 11. The drive mechanism 28 is partially contained within the open drive mechanism compartment 24, as shown in FIG. 1. The drive mechanism 28, as shown in FIGS. 1, 2, and 5 thru 11 comprises a torque gear box motor 30 which includes a motor shaft 32 (In some embodiments, torque gear box motor 30 may be a three wire reversible 3V DC Torque Gear Box Motor.). The torque gear box motor 30 is embedded within the open drive mechanism compartment 24 formed within housing 16, as shown in FIG. 1.

The drive mechanism 28 further comprises a mating male spline gear 34 carried on motor shaft 32, as shown in FIGS.

Figure 5:
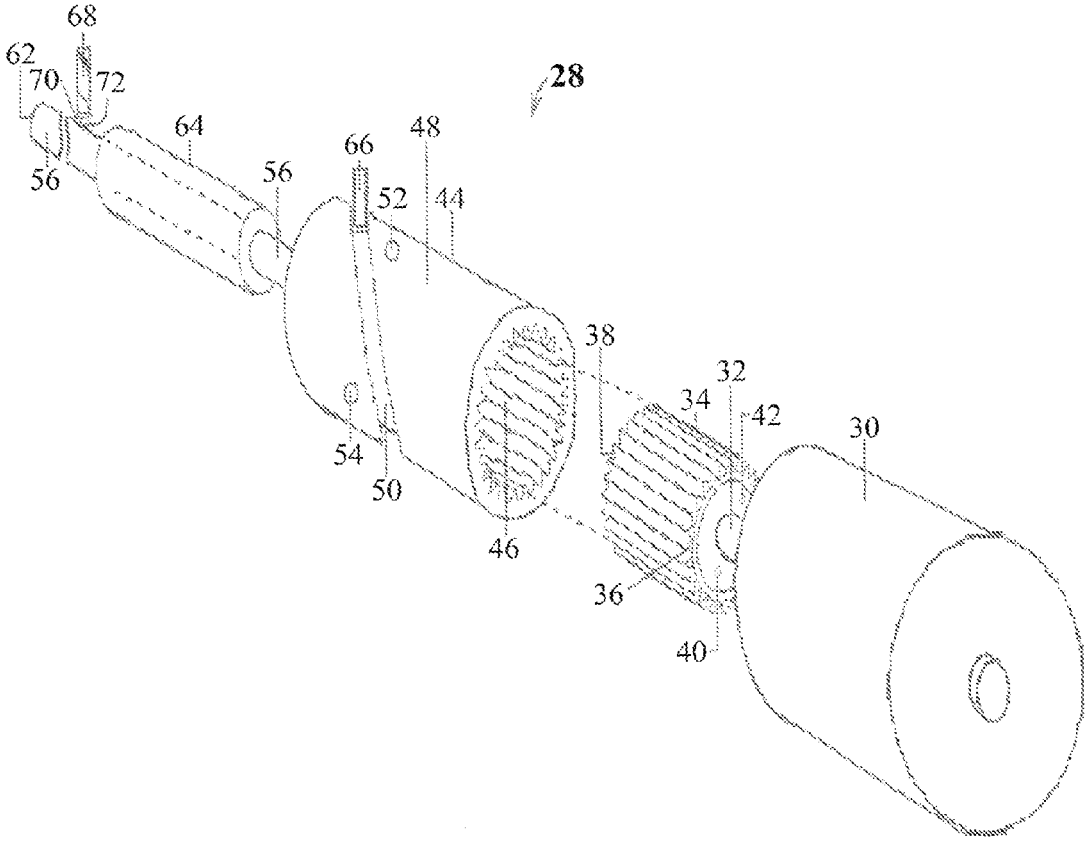
FIG. 5 is a top perspective schematic view illustrating the drive mechanism of the reciprocating, rotating, vibrating, bidirectional electric cosmetic applicator shown in FIG. 1.

1, 2, and 5 thru 11 having a series of narrow keys (external splines) 36, as shown in FIG. 5, formed longitudinally around the outer circumference of the mating male spline gear 34; an end 38; and an air flow shaft 40 and air flow shaft 42. Air flow shafts 40 and 42 reduce compressed air resistance during operation. In some embodiments, the mating male spline gear 34 can be cut or shaped at the very end of motor shaft 32.

The drive mechanism 28 still further comprises a mating female slidable oblong multipurpose component 44, as shown in FIGS. 1, 2 and 5 thru 11, having a series of corresponding grooves (internal splines) 46, as shown in FIG. 5, formed longitudinally around the inner circumference of the mating female slidable oblong multipurpose component 44 for slidable mating with the series of narrow keys (external splines) 36 of the mating male spline gear 34; and an elongated surface 48, as shown in FIGS. 1, 2 and 5 thru 11, on which a looping cam groove track 50 is embedded, as shown in FIGS. 1, 2 and 5 thru 11, having a defined profile that dictates the length, frequency and sequence of each stroke of the reciprocating cycle. The looping cam groove track 50 profile can vary in the length, frequency and the sequence of each stroke of the reciprocating cycle, as shown in FIGS. 22 thru 29.

The mating female slidable oblong multipurpose component 44 of the drive mechanism 28 further comprises an air passageway 52 and air passageway 54 located in the elongated surface 48 near the closed end of the mating female slidable oblong multipurpose component 44, as shown in FIGS. 1, 2, 5, 6 and 11 providing for the passage of air movement created by the reciprocating and rotating interaction of the mating female slidable oblong multipurpose component 44 and the rotating mating male spline gear 34 during operation. The drive mechanism 28 still further comprises a rotatable shaft 56 of sufficient length, as shown in FIGS. 1, 2 and 5 thru 12, having a first end 58 centrally affixed to closed end 60 of the mating female slidable oblong multipurpose component 44, as shown in FIG. 12, and a second end 62, as shown in FIGS. 1, 2 and 5 thru 12; a bushing 64, as shown in FIGS. 1, 2 and 5 thru 12 of sufficient length secured within the open drive mechanism compartment 24 of housing 16, as shown in FIGS. 1 and 2, which freely supports the rotatable shaft 56 when at rest or when the rotatable shaft 56 is driven to simultaneously rotate clockwise or counterclockwise and reciprocate. The drive mechanism 28 further comprises a stationary cam follower 66, as shown in FIGS. 1, 2 and 5 thru 11; a disk coin-type vibration motor 68, as shown in FIGS. 1, 2 and 5 thru 11 and 13, is illustrated as being embedded within housing 16 in FIGS. 1, 2 and 13; a transfer head 70, as shown in FIG. 13, whose base 508 is affixed to the tip of the disk coin-type vibration motor 68 and whose domed portion 72, also shown in FIG. 13, rest snugly against the rotatable shaft 56.

The open drive mechanism compartment 24 formed within housing 16 of handle 12 further comprises a cam follower seat 74 at a predetermined location, as shown in FIG. 4, which is directly in line with the looping cam groove track 50 of the mating female slidable oblong multipurpose component 44 so that after a predetermined portion of the stationary cam follower 66 is affixed into the cam follower seat 74 the remaining portion of the stationary cam follower 66 is freely received to slide within the looping cam groove track 50 of the mating female slidable oblong multipurpose component 44, as shown in FIGS. 1 and 2. In some embodiments, the stationary cam follower 66 can be included as part of the housing 16 casting thereby eliminating the need for a cam follower seat 74.

Figure 13:
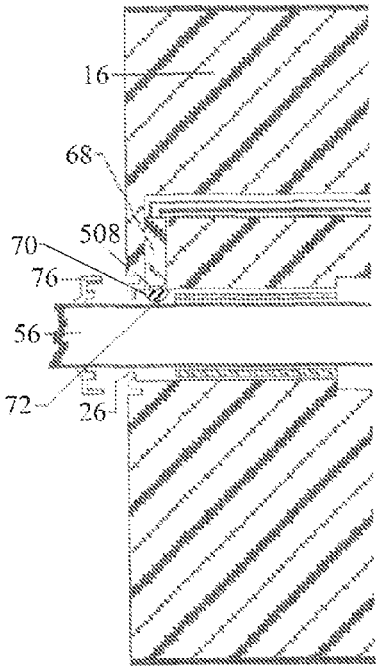
FIG. 13 is an enlarged cross-sectional view illustrating the points of contact of the vibrational means elements with the rotatable shaft of the handle portion of the reciprocating, rotating, vibrating, bidirectional electric cosmetic applicator shown in FIG. 1.
Figure 14:
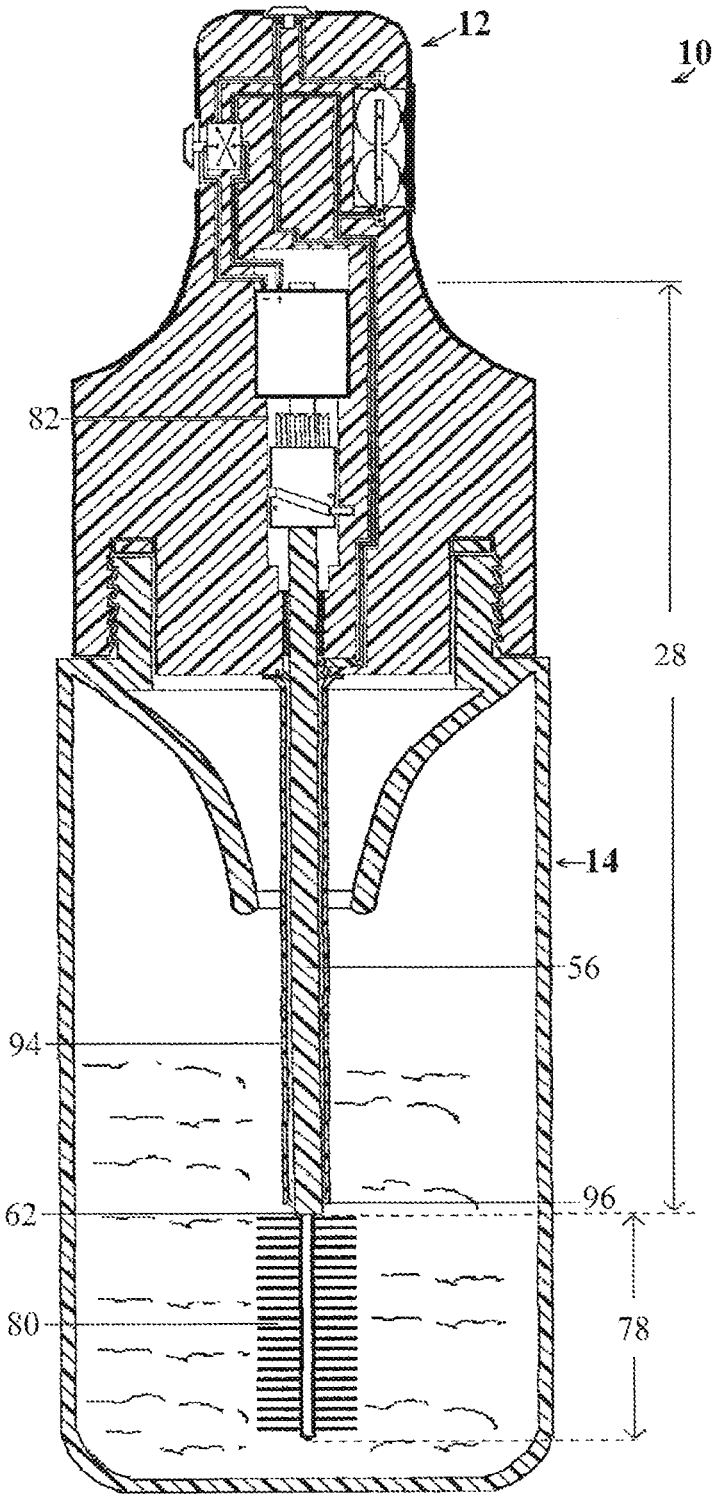
FIG. 14 is a cross-sectional view illustrating an applicator head affixed to a rotatable shaft of the reciprocating, rotating, vibrating, bidirectional electric cosmetic applicator shown in FIG. 1.

Handle 12 still further comprises an affixable seal 76, as shown in FIG. 13, that is affixed to housing 16 thereby sealing the space between the outer circumference of the rotatable shaft 56 and the inner circumference of circular opening 26; a connectable applicator head 78 having plurality of protrusions 80 spaced to define gaps during rotation, as shown in FIGS. 1 and 14, is affixed to the second end 62 of the rotatable shaft 56; an air flow shaft 82, as shown in FIGS. 1, 2 and 14, provides a passageway for air to enter and exit the open drive mechanism compartment 24 during the operation of drive mechanism 28; an ON(L)-OFF(O)-ON (R) directional switch 84 having a switching, means 86, as shown in FIGS. 1 and 2; a Push-On/Push-Off switch 88, as shown in FIGS. 1 and 2; a gasket 90, as shown in FIGS. 1 and 2; and a matched inner helical ridge 92, as shown in FIG. 2.

Batteries 20, the Push-On/Push-Off switch 88 and switching means 86 of the ON(L)-OFF(O)-ON(R) directional switch 84 are electrically and operatively connected to torque gear box motor 30, as shown in FIG. 1. In addition, batteries 20 and the Push-On/Push-Off switch 88 are also electrically and operatively connected to the disk coin-type vibration motor 68, shown in FIG. 1. The switching means 86 of the ON(L)-OFF(O)-ON(R) directional switch 84 enables controlling the directional flow of the electrical current from batteries 20 to the torque gear box motor 30 when the Push-On/Push-Off switch 88 is in the ON position. As example, when switching means 86 is in the ON(R) position and the Push-On/Push-Off switch 88 is in the ON position the flow of electrical current would result in the torque gear box motor 30 rotating motor shaft 32 in a clockwise direction and the disk coin-type vibration motor 68 to vibrate simultaneously; and when switching means 86 is in the ON(L) position and the Push-On/Push-Off switch 88 is in the ON position the flow of electrical current would result in the torque gear box motor 30 rotating motor shaft 32 in a counterclockwise direction and the disk coin-type vibration motor 68 to vibrate simultaneously. Lastly, when switching means 86 is in the OFF(O) position and the Push-On/Push-Off switch 88 is in the ON position the disk coin-type vibration motor 68 will vibrate and the torque gear box motor 30 does not rotate motor shaft 32 in neither a clockwise or counterclockwise direction. Because the directional flow of the electrical current to the disk coin-type vibration motor 68 is reversible a disk coin-type vibration motor such as the Precision Microdrives 308-100 Pico Viben" 8 mm Shaftless/Coin Vibrator Motor which produces vibration regardless of the directional flow of the electrical current received is preferred.

In some embodiments, the Push-On/Push-Off switch 88, the disk coin-type vibration motor 68, the transfer head 70 and all related electrical connections are removed, as shown in FIG. 15. Thereby, in some embodiments, batteries 20 and the switching means 86 of the ON(L)-OFF(O)-ONE) directional switch 84 are electrically and operatively connected to torque gear box motor 30. The ON(L)-OFF(O)-ON(R) directional switch 84 enables controlling the directional flow of the electrical current from batteries 20 to the torque gear box motor 30. More particularly, when switching means 86 of the ON(L)-OFF(O)-ONE) directional switch 84 is in the ON(R) position the directional flow of electrical current would result in the torque gear box motor 30 rotating motor shaft 32 in a clockwise direction; when switching means 86 of the ON(L)-OFF(O)-ONE) directional switch 84 is in the ON(L) position the directional flow of electrical current would result in the torque gear box motor 30 rotating motor shaft 32 in a counterclockwise direction; and lastly when switching means 86 of the ON(L)-OFF(O)-ONE) directional switch 84 is in the OFF(O) position no flow of electrical current from batteries 20 exists.

Figure 16:
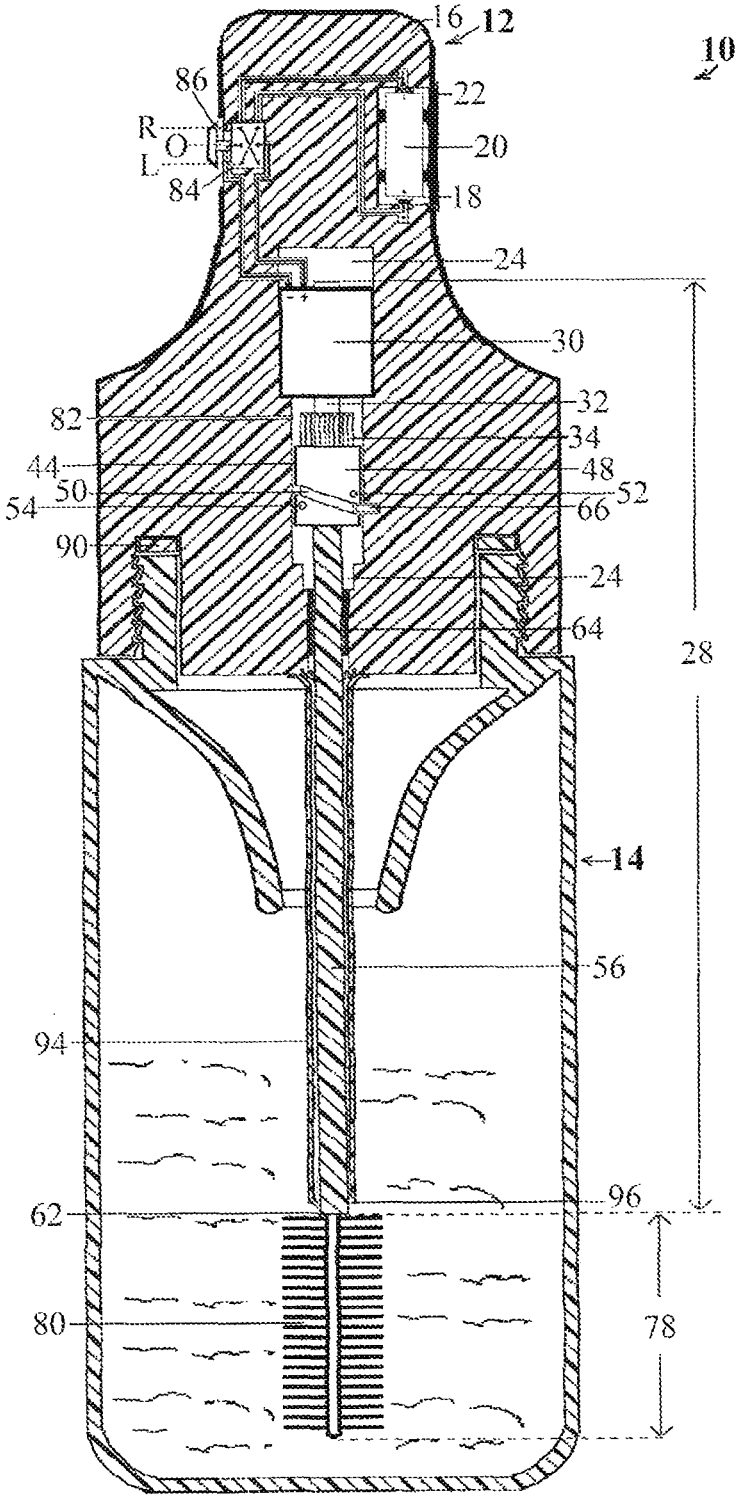
FIG. 16 is a cross-sectional view illustrating an alternative embodiment in which the Push-On/Push-Off switch is removed from the reciprocating, rotating, vibrating, bidirectional electric cosmetic applicator shown in FIG. 1.

In yet another embodiment, as shown in FIG. 16, batteries 20 and switching means 86 of the ON(L)-OFF(O)-ON(R) directional switch 84 are electrically and operatively connected to the torque gear box motor 30 and the disk coin-type vibration motor 68. The ON(L)-OFF(O)-ON(R) directional switch 84 enables controlling the directional flow of the electrical current from batteries 20 to the torque gear box motor 30 and to the disk coin-type vibration motor 68. More particularly, when switching means 86 of the ON(L)-OFF(O)-ONE) directional switch 84 is in the ON(R) position the flow of electrical current would result in the torque gear box motor 30 rotating motor shaft 32 in a clockwise direction and the disk coin-type vibration motor 68 to vibrate simultaneously; and when switching means 86 of the ON(L)-OFF(O)-ONE) directional switch 84 is in the ON(L) position the flow of electrical current would result in the torque gear box motor 30 rotating motor shaft 32 in a counterclockwise direction and the disk coin-type vibration motor 68 to vibrate simultaneously. In addition, when switching means 86 of the ON(L)-OFF(O)-ONE) directional switch 84 is in the OFF(O) position no flow of electrical current from batteries 20 exists.

Figure 17:
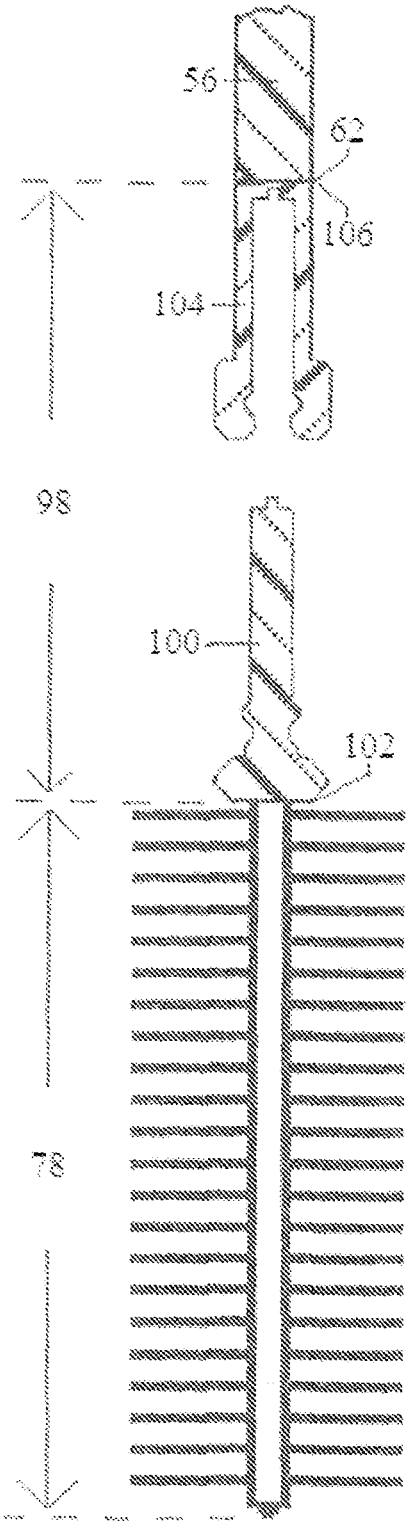
FIG. 17 is an enlarged cross-sectional view illustrating the applicator head and rotatable shaft disengaged locking mechanism of the reciprocating, rotating, vibrating, bidirectional electric cosmetic applicator shown in FIG. 1.
Figure 18:
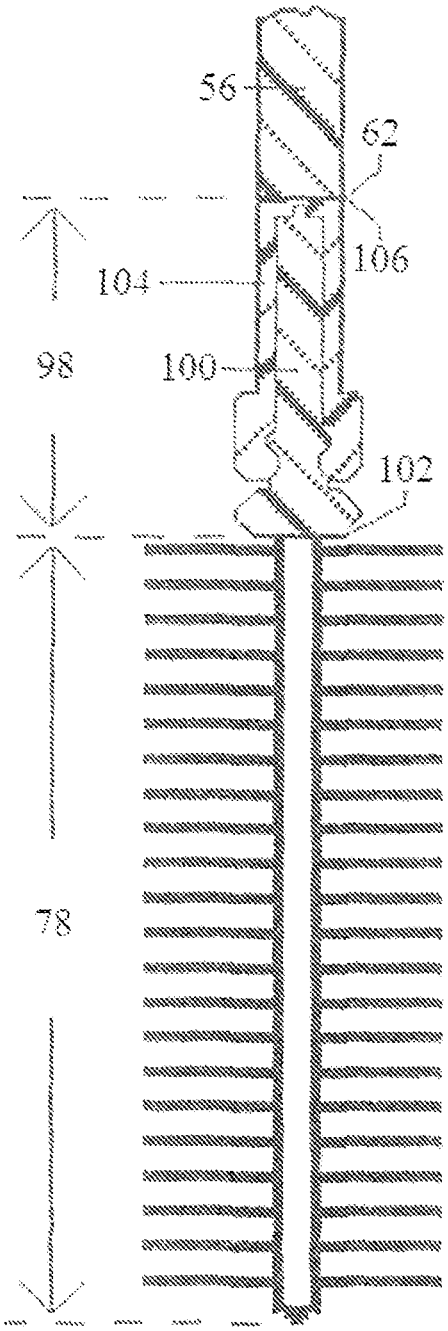
FIG. 18 is an enlarged cross-sectional view illustrating the applicator head and rotatable shaft engaged locking mechanism of the reciprocating, rotating, vibrating, bidirectional electric cosmetic applicator shown in FIG. 1.
Figure 19:
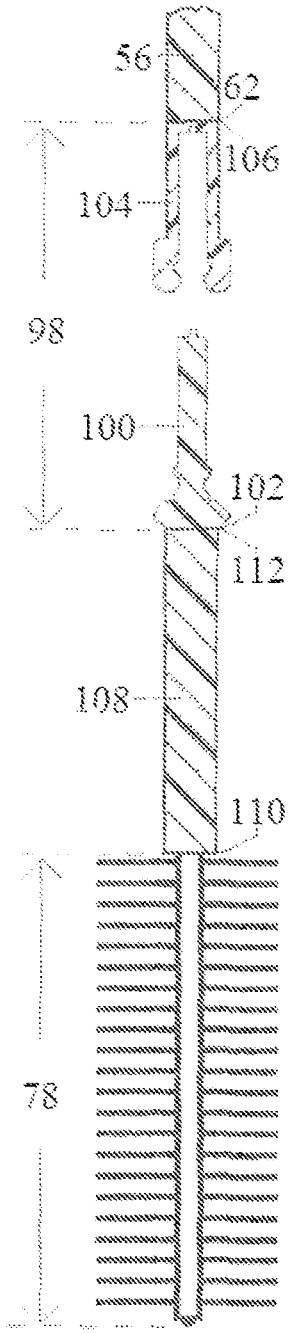
FIG. 19 is an enlarged cross-sectional view illustrating a stem and rotatable shaft disengaged locking mechanism of the reciprocating, rotating, vibrating, bidirectional electric cosmetic applicator shown in FIG. 1.
Figure 20:
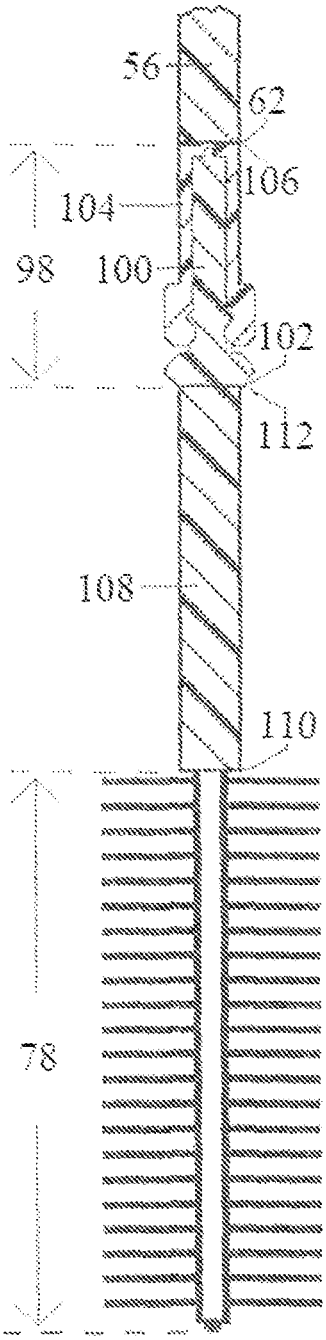
FIG. 20 is an enlarged cross-sectional view illustrating a stem and rotatable shaft engaged locking mechanism of the reciprocating, rotating, vibrating, bidirectional electric cosmetic applicator shown in FIG. 1.

Handle 12 further comprises a shaft shield 94 having a seal 96, as shown in FIGS. 1 and 2 and 14 thru 16; a locking mechanism 98, shown in FIG. 17, comprising a male connectable section 100 having an end 102 affixed to applicator head 78 and a female connectable section 104 having an end 106 affixed to the second end 62 of the rotatable shaft 56 of drive mechanism 28. The locking mechanism 98 is disengaged, as shown in FIG. 17 and engaged, as shown in FIG. 18. Handle 12 still further comprises a stem 108 extending a distance between applicator head 78 and locking mechanism 98 having an end 110 that is affixed to the applicator head 78 and having an end 112 that is affixed to end 102 of the locking mechanism 98, as shown in FIG. 19. The locking mechanism 98 having an affixed stem 108 is disengaged, as shown in FIG. 19, and engaged as shown in FIG. 20. The applicator head 78 and the applicator head 78 and stem 108 are replaceable. Applicator head 78 may be of a variety of customized applicators. Locking mechanism 98 provides the means to remove and replace applicator head 78 and/or applicator head 78 and stem 108.

The detachable container 14, as shown in FIG. 3, comprises a matched outer helical ridge 114; a chamber 116 having opening 118; a surface stripper 120 having an opening 122. The chamber 116 of the detachable container 14 stores cosmetic product, such as mascara. Other types of cosmetic product may be stored in the detachable container 14. Gasket 90, as shown in FIG. 1, seals the chamber 116 when the detachable container 14 is snugly fastened to handle 12. The detachable container 14 is replaceable and may or may not contain cosmetic product at the time of its replacement. The detachable container 14 is replaced at the same time that the applicator head 78 and/or the applicator head 78 and stem 108 is replaced and after the shaft shield 94, seal 96 and other surrounding surfaces at the base of shaft shield 94 have been disinfected.

The surface stripper 120 is disposed at or near the opening 118 of the detachable container 14, as shown in FIG. 3. As the applicator head 78 is removed from the detachable container 14, it first passes through opening 122 of the surface stripper 120 where applicator head 78 brushes or rubs against the wall of the opening 122 removing excessive cosmetic product and distributing the cosmetic product evenly upon applicator head 78 and then passes through opening 118.

Figure 23:
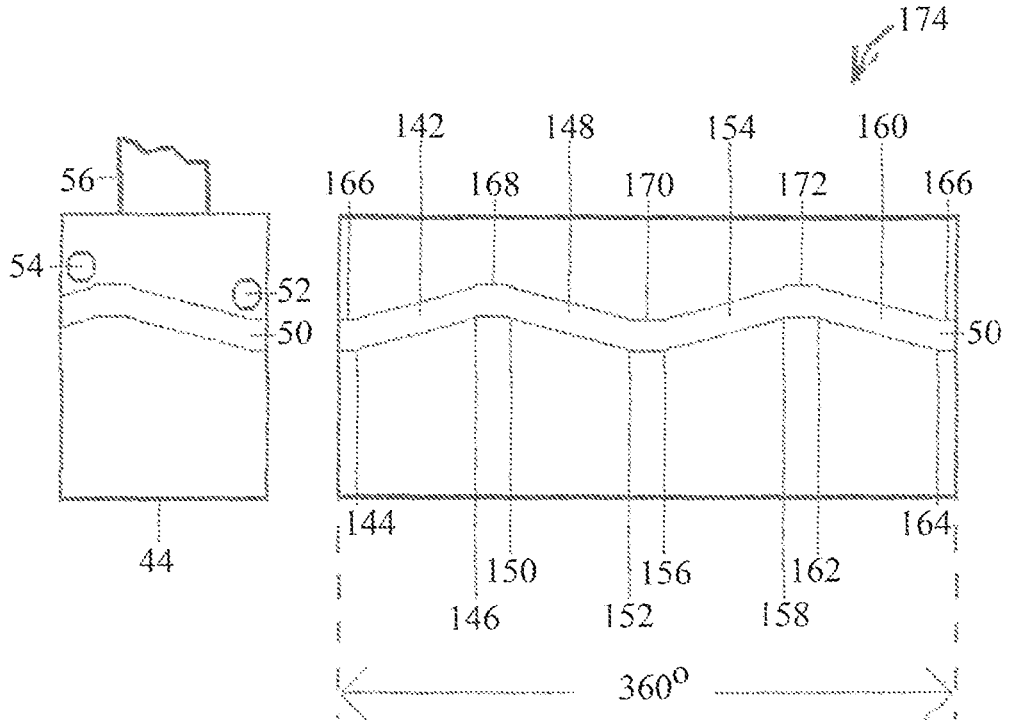
FIG. 23 is a 360° flat elongated surface diagram of the elongated surface of the mating female slidable oblong multipurpose component illustrating a four-stroke looping cam groove track profile of a drive mechanism of the reciprocating, rotating, vibrating, bidirectional electric cosmetic applicator shown in FIG. 1.
Figure 24:
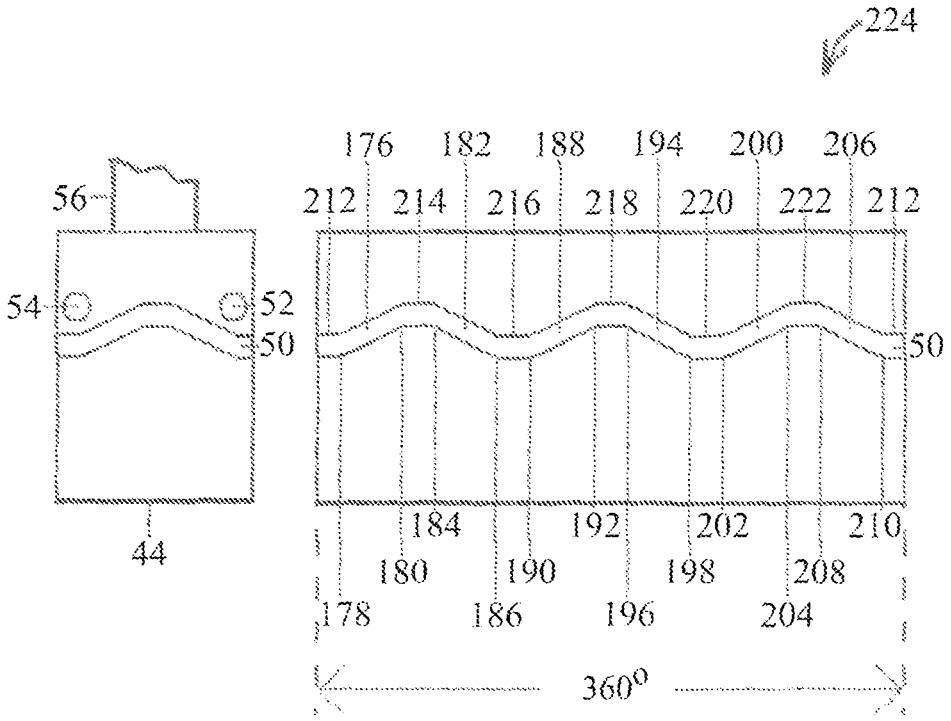
FIG. 24 is a 360° flat elongated surface diagram of the elongated surface of the mating female slidable oblong multipurpose component illustrating a six-stroke looping cam groove track profile of a drive mechanism of the reciprocating, rotating, vibrating, bidirectional electric cosmetic applicator shown in FIG. 1.
Figure 25:
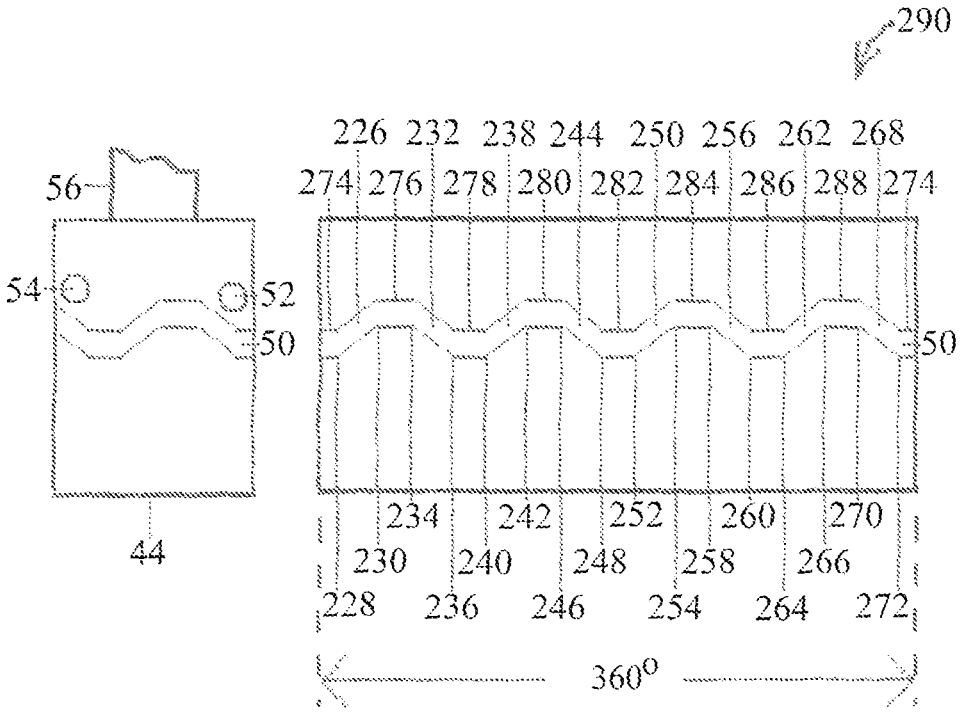
FIG. 25 is a 360° flat elongated surface diagram of the elongated surface of the mating female slidable oblong multipurpose component illustrating an eight-stroke looping cam groove track profile of a drive mechanism of the reciprocating, rotating, vibrating, bidirectional electric cosmetic applicator shown in FIG. 1.
Figure 26:
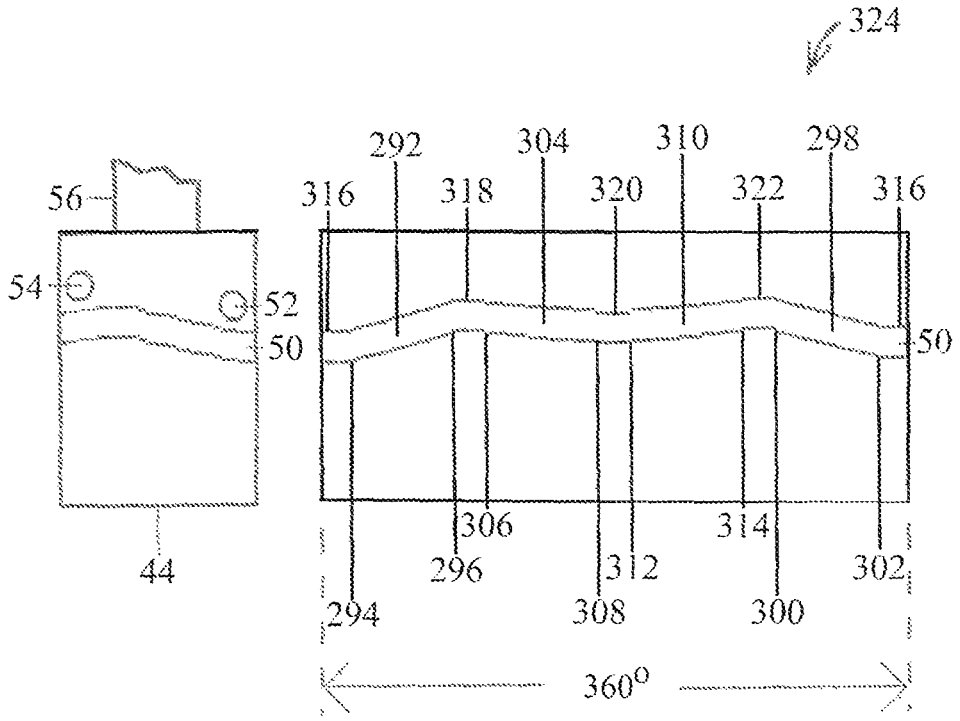
FIG. 26 is a 360° flat elongated surface diagram of the elongated surface of the mating female slidable oblong multipurpose component illustrating a four-stroke looping cam groove track profile having length segment variations of a drive mechanism of the reciprocating, rotating, vibrating, bidirectional electric cosmetic applicator shown in FIG. 1.
Figure 27:
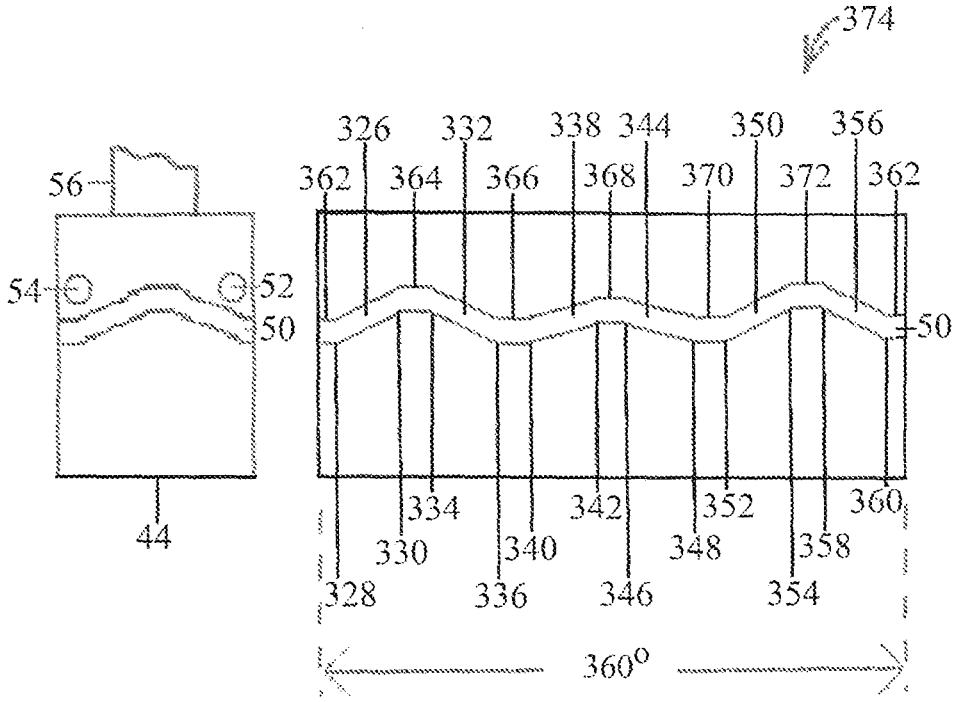
FIG. 27 is a 360° flat elongated surface diagram of the elongated surface of the mating female slidable oblong multipurpose component illustrating a six-stroke looping cam groove track profile having length segment variations of a drive mechanism of the reciprocating, rotating, vibrating, bidirectional electric cosmetic applicator shown in FIG. 1.
Figure 28:
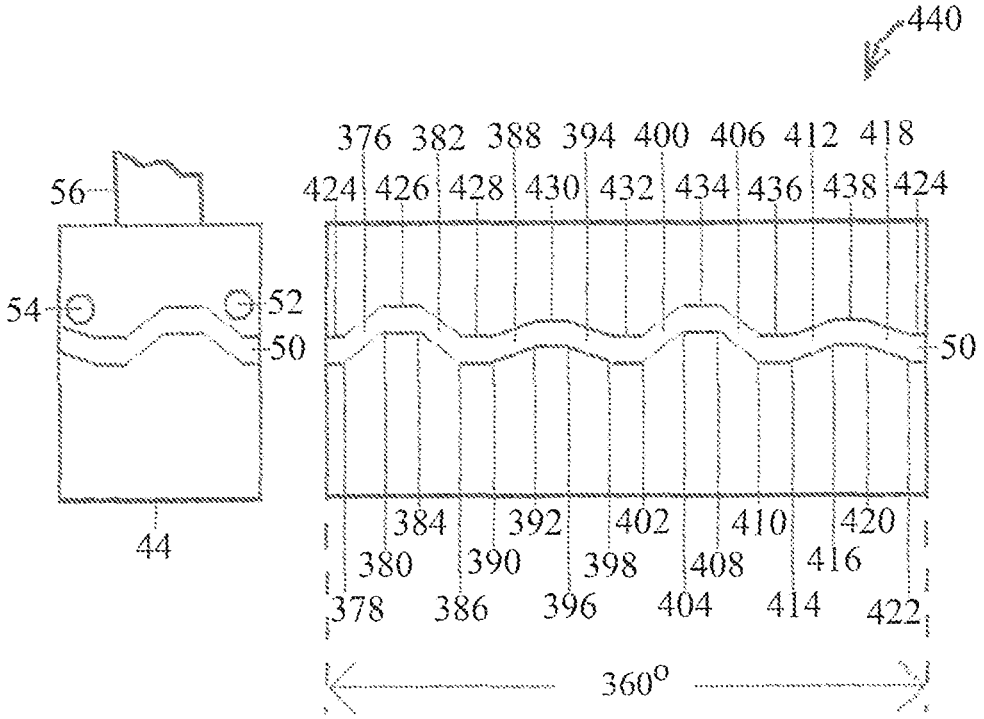
FIG. 28 is a 360° flat elongated surface diagram of the elongated surface of the mating female slidable oblong multipurpose component illustrating an eight-stroke looping cam groove track profile having length segment variations of a drive mechanism of the reciprocating, rotating, vibrating, bidirectional electric cosmetic applicator shown in FIG. 1.
Figure 29:
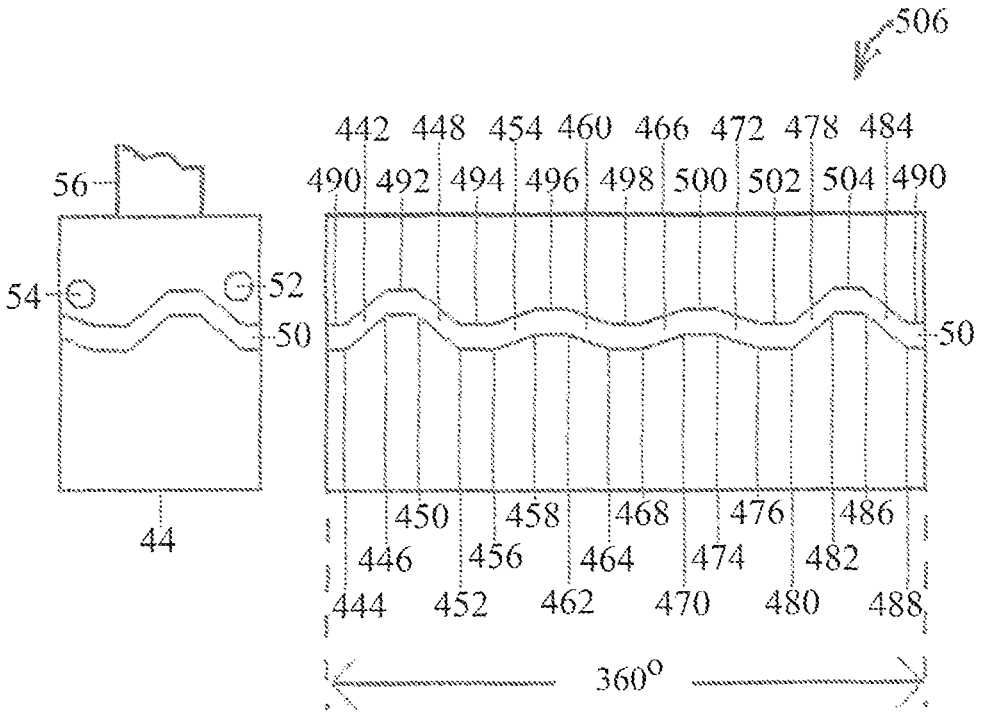
FIG. 29 is a 360° flat elongated surface diagram of the elongated surface of the mating female slidable oblong multipurpose component illustrating an eight-stroke looping cam groove track profile having other length segment variations of a drive mechanism of the reciprocating, rotating, vibrating, bidirectional electric cosmetic applicator shown in FIG. 1.

The drive mechanism 28 further comprises a looping cam groove track 50 profile group 510. Looping cam groove track 50 profile group 510 comprises a two-stroke looping cam groove track profile, as shown in FIG. 22; a four-stroke looping cam groove track profile, as shown in FIG. 23; a six-stroke looping cam groove track profile, as shown in FIG. 24; an eight-stroke looping cam groove track profile, as shown in FIG. 25; a four-stroke looping cam groove track profile having length segment variations, as shown in FIG. 26; a six-stroke looping cam groove track profile having length segment variations, as shown in FIG. 27; an eight-stroke looping cam groove track profile having length segment variations, as shown in FIG. 28; and an eight-stroke looping cam groove track profile having other length segment variations, as shown in FIG. 29.

Figure 22:
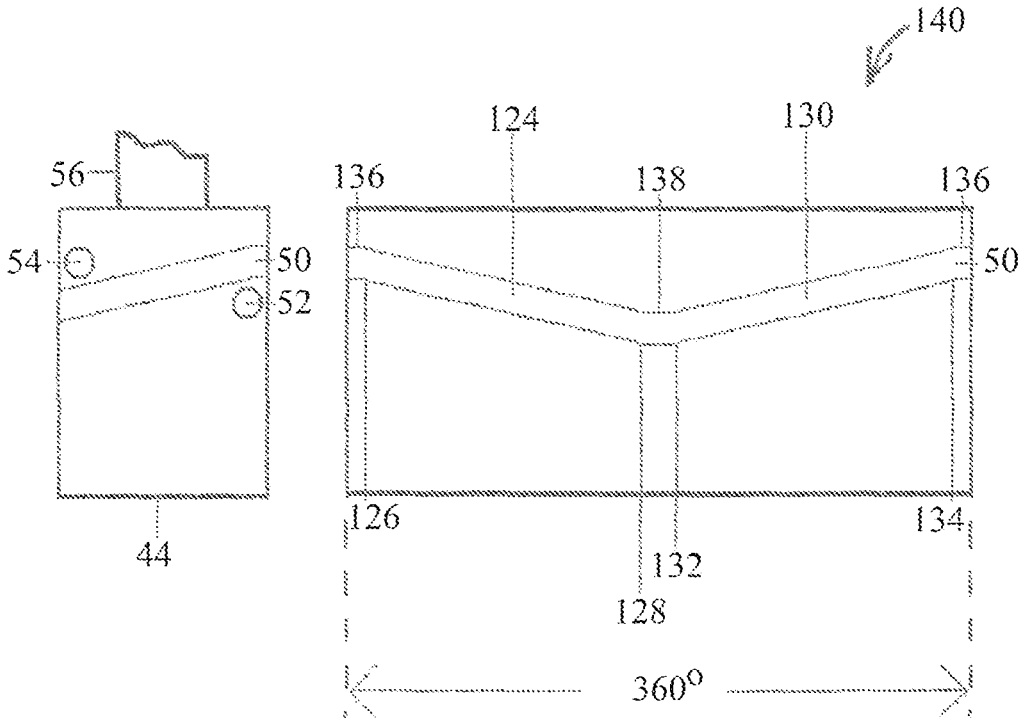
FIG. 22 is a 360° flat elongated surface diagram of the elongated surface of the mating female slidable oblong multipurpose component illustrating a two-stroke looping cam groove track profile of a drive mechanism of the reciprocating, rotating, vibrating, bidirectional electric cosmetic applicator shown in FIG. 1.

The two-stroke looping cam groove track 50 profile of the looping cam groove track 50 profile group 510 comprises a first equal length segment 124 having a first end 126 and a second end 128; a second equal length segment 130 having a first end 132 and a second end 134; a first looping joint 136; and a second looping joint 138 as illustrated in the 360° flat elongated surface of the mating female slidable oblong multipurpose component 44 diagram 140 shown in FIG. 22.

At the furthest backward point of the reciprocating cycle of the two-stroke looping cam groove track 50 profile first end 126 of the first equal length segment 124 is adjoined to one end of the first looping joint 136 while second end 134 of the second equal length segment 130 is adjoined to the other end of the first looping joint 136 and at the furthest forward point of the reciprocating cycle of the two-stroke looping cam groove track 50 profile second end 128 of the first equal length segment 124 is adjoined to one end of the second looping joint 138 while first end 132 of the second equal length segment 130 is adjoined to the other end of the second looping joint 138 thereby forming the reciprocating cycle of the two-stroke looping cam groove track 50 profile as illustrated in the 360° flat elongated surface of the mating female slidable oblong multipurpose component 44 diagram 140 shown in FIG. 22.

A characteristic of the Reciprocating Rotating Vibrating Bidirectional Electric Cosmetic Applicator 10 when a two-stroke looping cam groove track 50 profile of the looping cam groove track 50 profile group 510 is utilized is that for every revolution of motor shaft 32 by torque gear box motor 30 the applicator head 78 simultaneously revolved once in the same rotational direction of the motor shaft 32, vibrated continuously and traveled once forward and once backward equally in distance according to the reciprocating cycle shown in the 360° flat elongated surface of the mating female slidable oblong multipurpose component 44 diagram 140 shown in FIG. 22.

The four-stroke looping cam groove track 50 profile of the looping cam groove track 50 profile group 510 comprises a first equal length segment 142 having a first end 144 and a second end 146, a second equal length segment 148 having a first end 150 and a second end 152; a third equal length segment 154 having a first end 156 and a second end 158; a fourth equal length segment 160 having a first end 162 and a second end 164; a first looping joint 166; a second looping joint 168; a third looping joint 170 and a fourth looping joint 172 as illustrated in the 360° flat elongated surface of the mating female slidable oblong multipurpose component 44 diagram 174 of FIG. 23.

At the first furthest forward point of the reciprocating cycle of the four-stroke looping cam groove track 50 profile the first end 144 of the first equal length segment 142 is adjoined to one end of the first looping joint 166 while the second end 164 of the fourth equal length segment 160 is adjoined to the other end of the first looping joint 166 and at the first furthest backward point of the reciprocating cycle of a four-stroke looping cam groove track 50 profile the second end 146 of the first equal length segment 142 is adjoined to one end of the second looping joint 168 while the first end 150 of the second equal length segment 148 is adjoined to the other end of the second looping joint 168 and at the second furthest forward point of the reciprocating cycle of a four-stroke looping cam groove track 50 profile the second end 152 of the second equal length segment 148 is adjoined to one end of the third looping joint 170 while the first end 156 of the third equal length segment 154 is adjoined to the other end of the third looping joint 170 and at the second furthest backward point of the reciprocating cycle of a four-stroke looping cam groove track 50 profile the second end 158 of the third equal length segment 154 is adjoined to one end of the fourth looping joint 172 while the first end 162 of the fourth equal length segment 160 is adjoined to the other end of the fourth looping joint 172 thereby forming the reciprocating cycle of the four-stroke looping cam groove track 50 profile as illustrated in the 360° flat elongated surface of the mating female slidable oblong multipurpose component 44 diagram 174 of FIG. 23.

A characteristic of the Reciprocating Rotating Vibrating Bidirectional Electric Cosmetic Applicator 10 when a four-stroke looping cam groove track 50 profile of the looping cam groove track 50 profile group 510 is utilized is that for every revolution of motor shaft 32, by torque gear box motor 30, the applicator head 78 simultaneously revolved once, in the same rotational direction of the motor shaft 32, vibrated continuously and traveled backward, forward, backward and forward equally in distance according to the reciprocating cycle shown in the 360° flat elongated surface of the mating female slidable oblong multipurpose component 44 diagram 174 of FIG. 23.

The six-stroke looping cam groove track 50 profile of the looping cam groove track 50 profile group 510 comprises a first equal length segment 176 having a first end 178 and a second end 180; a second equal length segment 182 having a first end 184 and a second end 186; a third equal length segment 188 having a first end 190 and a second end 192; a fourth equal length segment 194 having a first end 196 and a second end 198; a fifth equal length segment 200 having a first end 202 and a second end 204; a sixth equal length segment 206 having a first end 208 and a second end 210; a first looping joint 212; a second looping joint 214; a third looping joint 216; a fourth looping joint 218; a fifth looping joint 220 and a six looping joint 222 as illustrated in the 360° flat elongated surface of the mating female slidable oblong multipurpose component 44 diagram 224 of FIG. 24.

At the first furthest forward point of the reciprocating cycle of a six-stroke looping cam groove track 50 profile the first end 178 of the first equal length segment 176 is adjoined to one end of the first looping joint 212 while the second end 210 of the sixth equal length segment 206 is adjoined to the other end of the first looping joint 212 and at the first furthest backward point of the reciprocating cycle of a six-stroke looping cam groove track 50 profile the second end 180 of the first equal length segment 176 is adjoined to one end of the second looping joint 214 while first end 184 of the second equal length segment 182 is adjoined to the other end of the second looping joint 214 and at the second furthest forward point of the reciprocating cycle of a six-stroke looping cam groove track 50 profile the second end 186 of the second equal length segment 182 is adjoined to one end of the third looping joint 216 while the first end 190 of the third equal length segment 188 is adjoined to the other end of the third looping joint 216 and at the second furthest backward point of the reciprocating cycle of a six-stroke looping cam groove track 50 profile the second end 192 of the third equal length segment 188 is adjoined to one end of the fourth looping joint 218 while the first end 196 of the fourth equal length segment 194 is adjoined to the other end of the fourth looping joint 218 and at the third furthest forward point of the reciprocating cycle of a six-stroke looping cam groove track 50 profile the second end 198 of the fourth equal length segment 194 is adjoined to one end of the fifth looping joint 220 while the first end 202 of the fifth equal length segment 200 is adjoined to the other end of the fifth looping joint 220 and at the third furthest backward point of the reciprocating cycle of a six-stroke looping cam groove track 50 profile the second end 204 of the fifth equal length segment 200 is adjoined to one end of the sixth looping joint 222 while the first end 208 of the sixth equal length segment 206 is adjoined to the other end of the sixth looping joint 222 thereby forming the reciprocating cycle of the six-stroke looping cam groove track 50 profile as illustrated in the 360° flat elongated surface of the mating female slidable oblong multipurpose component 44 diagram 224 of FIG. 24.

A characteristic of the Reciprocating Rotating Vibrating Bidirectional Electric Cosmetic Applicator 10 when a six-stroke looping cam groove track 50 profile of the looping cam groove track 50 profile group 510 is utilized is that for every revolution of motor shaft 32 by torque gear box motor 30, the applicator head 78 simultaneously revolves once, in the same rotational direction of the motor shaft 32, vibrated continuously and traveled backward, forward, backward, forward, backward and forward equally in distance according to the reciprocating cycle shown in the 360° flat elongated surface of the mating female slidable oblong multipurpose component 44 diagram 224 of FIG. 24.

The eight-stroke looping cam groove track 50 profile of the looping cam groove track 50 profile group 510 comprises a first equal length segment 226 having a first end 228 and a second end 230; a second equal length segment 232 having a first end 234 and a second end 236; a third equal length segment 238 having a first end 240 and a second end 242; a fourth equal length segment 244 having a first end 246 and a second end 248; a fifth equal length segment 250 having a first end 252 and a second end 254; a sixth equal length segment 256 having a first end 258 and a second end 260; a seventh equal length segment 262 having a first end 264 and a second end 266; an eight equal length segment 268 having a first end 270 and a second end 272; a first looping joint 274; a second looping joint 276; a third looping joint 278; a fourth looping joint 280; a fifth looping joint 282; a six looping joint 284; a seventh looping joint 286 and an eighth looping joint 288 as illustrated in the 360° flat elongated surface of the mating female slidable oblong multipurpose component 44 diagram 290 of FIG. 25.

At the first furthest forward point of the reciprocating cycle of an eight-stroke looping cam groove track 50 profile the first end 228 of the first equal length segment 226 is adjoined to one end of the first looping joint 274 while second end 272 of the eight equal length segment 268 is adjoined to the other end of the first looping joint 274 and at the first furthest backward point of the reciprocating cycle of an eight-stroke looping cam groove track 50 profile the second end 230 of the first equal length segment 226 is adjoined to one end of the second looping joint 276 while first end 234 of the second equal length segment 232 is adjoined to the other end of the second looping joint 276 and at the second furthest forward point of the reciprocating cycle of an eight-stroke looping cam groove track 50 profile the second end 236 of the second equal length segment 232 is adjoined to one end of the third looping joint 278 while the first end 240 of the third equal length segment 238 is adjoined to the other end of the third looping joint 278 and at the second furthest backward point of the reciprocating cycle of an eight-stroke looping cam groove track 50 profile the second end 242 of the third equal length segment 238 is adjoined to one end of the fourth looping joint 280 while the first end 246 of the fourth equal length segment 244 is adjoined to the other end of the fourth looping joint 280 and at the third furthest forward point of the reciprocating cycle of an eight-stroke looping cam groove track 50 profile the second end 248 of the fourth equal length segment 244 is adjoined to one end of the fifth looping joint 282 while the first end 252 of the fifth equal length segment 250 is adjoined to the other end of the fifth looping joint 282 and at the third furthest backward point of the reciprocating cycle of an eight-stroke looping cam groove track 50 profile the second end 254 of the fifth equal length segment 250 is adjoined to one end of the sixth looping joint 284 while the first end 258 of the sixth equal length segment 256 is adjoined to the other end of the sixth looping joint 284 and at the fourth furthest forward point of the reciprocating cycle of an eight-stroke looping cam groove track 50 profile the second end 260 of the sixth equal length segment 256 is adjoined to one end of the seventh looping joint 286 while the first end 264 of the seventh equal length segment 262 is adjoined to the other end of the seventh looping joint 286 and at the fourth furthest backward point of the reciprocating cycle of an eight-stroke looping cam groove track 50 profile the second end 266 of the seventh equal length segment 262 is adjoined to one end of the eighth looping joint 288 while the first end 270 of the eight equal length segment 268 is adjoined to the other end of the eighth looping joint 288 thereby forming the reciprocating cycle of the eight-stroke looping cam groove track 50 profile as illustrated in the 360° flat elongated surface of the mating female slidable oblong multipurpose component 44 diagram 290 of FIG. 25.

A characteristic of the Reciprocating Rotating Vibrating Bidirectional Electric Mascara Applicator 10 when an eight-stroke looping cam groove track 50 profile of the looping cam groove track 50 profile group 510 is utilized is that for every revolution of motor shaft 32 by torque gear box motor 30, the applicator head 78 simultaneously revolves once, in the same rotational direction of the motor shaft 32, vibrated continuously and traveled backward, forward, backward, forward, backward, forward, backward and forward equally in distance according to the reciprocating cycle shown in the 360° flat elongated surface of the mating female slidable oblong multipurpose component 44 diagram 290 of FIG. 25.

The four-stroke looping cam groove track 50 profile of the looping cam groove track 50 profile group 510 having length segment variations comprises an first long equal length segment 292 having an first end 294 and an second end 296; an second long equal length segment 298 having an first end 300 and an second end 302; an first short equal length segment 304 having an first end 306 and an second end 308; an second short equal length segment 310 having an first end 312 and an second end 314; an first looping joint 316; an second looping joint 318, an third looping joint 320 and an fourth looping joint 322 as illustrated in the 360° flat elongated surface of the mating female slidable oblong multipurpose component 44 diagram 324 of FIG. 26.

A characteristic of the Reciprocating Rotating Vibrating Bidirectional Electric Cosmetic Applicator 10 when an eight-stroke looping cam groove track 50 profile of the looping cam groove track 50 profile group 510 is utilized is that for every revolution of motor shaft 32 by torque gear box motor 30, the applicator head 78 simultaneously revolves once, in the same rotational direction of the motor shaft 32, vibrated continuously and traveled backward, forward, backward, forward, backward, forward, backward and forward equally in distance according to the reciprocating cycle shown in the 360° flat elongated surface of the mating female slidable oblong multipurpose component 44 diagram 290 of FIG. 25.

The four-stroke looping cam groove track 50 profile of the looping cam groove track 50 profile group 510 having length segment variations comprises a first long equal length segment 292 having a first end 294 and a second end 296; a second long equal length segment 298 having a first end 300 and a second end 302; a first short equal length segment 304 having a first end 306 and a second end 308; a second short equal length segment 310 having a first end 312 and a second end 314; a first looping joint 316; a second looping joint 318, a third looping joint 320 and a fourth looping joint 322 as illustrated in the 360° flat elongated surface of the mating female slidable oblong multipurpose component 44 diagram 324 of FIG. 26.

At the first furthest forward point of the reciprocating cycle of a four-stroke looping cam groove track 50 profile having length segment variations the first end 294 of the first long equal length segment 292 is adjoined to one end of the first looping joint 316 while second end 302 of the second long equal length segment 298 is adjoined to the other end of the first looping joint 316 and at the first furthest backward point of the reciprocating cycle of a four-stroke looping cam groove track 50 profile having length segment variations the second end 296 of the first long equal length segment 292 is adjoined to one end of the second looping joint 318 while first end 306 of the first short equal length segment 304 is adjoined to the other end of the second looping joint 318 and at a lesser forward point of the reciprocating cycle of a four-stroke looping cam groove track 50 profile having length segment variations the second end 308 of the first short equal length segment 304 is adjoined to one end of the third looping joint 320 while the first end 312 of the second short equal length segment 310 is adjoined to the other end of the third looping joint 320 and at the second furthest backward point of the reciprocating cycle of a four-stroke looping cam groove track 50 profile having length segment variations the second end 314 of the second short equal length segment 310 is adjoined to one end of the fourth looping joint 322 while the first end 300 of the second long equal length segment 298 is adjoined to the other end of the fourth looping joint 322 thereby forming the reciprocating cycle of the eight-stroke looping cam groove track 50 profile having length segment variations as illustrated in the 360° flat elongated surface of the mating female slidable oblong multipurpose component 44 diagram 324 of FIG. 26.

A characteristic of the Reciprocating Rotating Vibrating Bidirectional Electric Cosmetic Applicator 10 when a four-stroke looping cam groove track 50 profile having length segment variations is utilized is that for every revolution of motor shaft 32 by torque gear box motor 30 the applicator head 78 simultaneously revolves once, in the same rotational direction of the motor shaft 32, vibrated continuously and traveled backward a greater distance, forward a lesser distance, backward a lesser distance and forward a greater distance according to the reciprocating cycle shown in the 360° flat elongated surface of the mating female slidable oblong multipurpose component 44 diagram 324 of FIG. 26.

The six-stroke looping cam groove track 50 profile having length segment variations of the looping cam groove track 50 profile group 510 comprises a first long equal length segment 326 having a first end 328 and a second end 330; a second long equal length segment 332 having a first end 334 and a second end 336; a first short equal length segment 338 having a first end 340 and a second end 342; a second short equal length segment 344 having a first end 346 and a second end 348; a third long equal length segment 350 having a first end 352 and a second end 354; a fourth long equal length segment 356 having a first end 358 and a second end 360; a first looping joint 362; a second looping joint 364; a third looping joint 366; a fourth looping joint 368; a fifth looping joint 370 and a sixth looping joint 372 as illustrated in the 360° flat elongated surface of the mating female slidable oblong multipurpose component 44 diagram 374 of FIG. 27.

At the first furthest forward point of the reciprocating cycle of a six-stroke looping cam groove track 50 profile having length segment variations the first end 328 of the first long equal length segment 326 is adjoined to one end of the first looping joint 362 while second end 360 of the fourth long equal length segment 356 is adjoined to the other end of the first looping joint 362 and at the first furthest backward point of the reciprocating cycle of a six-stroke looping cam groove track 50 profile having length segment variations the second end 330 of the first long equal length segment 326 is adjoined to one end of the second looping joint 364 while first end 334 of the second long equal length segment 332 is adjoined to the other end of the second looping joint 364 and at the second furthest forward point of the reciprocating cycle of a six-stroke looping cam groove track 50 profile having length segment variations the second end 336 of the second long equal length segment 332 is adjoined to one end of the third looping joint 366 while the first end 340 of the first short equal length segment 338 is adjoined to the other end of the third looping joint 366 and at the lesser backward point of the reciprocating cycle of a six-stroke looping cam groove track 50 profile having length segment variations the second end 342 of the first short equal length segment 338 is adjoined to one end of the fourth looping joint 368 while the first end 346 of the second short equal length segment 344 is adjoined to the other end of the fourth looping joint 368 and at the third furthest forward point of the reciprocating cycle of a six-stroke looping cam groove track 50 profile having length segment variations the second end 348 of the second short equal length segment 344 is adjoined to one end of the fifth looping joint 370 while the first end 352 of the third long equal length segment 350 is adjoined to the other end of the fifth looping joint 370 and at the second furthest backward point of the reciprocating cycle of a six-stroke looping cam groove track 50 profile having length segment variations the second end 354 of the third long equal length segment 350 is adjoined to one end of the sixth looping joint 372 while the first end 358 of the fourth long equal length segment 356 is adjoined to the other end of the sixth looping joint 372 thereby forming the reciprocating cycle of the six-stroke looping cam groove track 50 profile having length segment variations as illustrated in the 360° flat elongated surface of the mating female slidable oblong multipurpose component 44 diagram 374 of FIG. 27.

A characteristic of the Reciprocating Rotating Vibrating Bidirectional Electric Cosmetic Applicator 10 when a six-stroke looping cam groove track 50 profile having length segment variations is utilized is that for every revolution of motor shaft 32 by torque gear box motor 30, the applicator head 78 simultaneously revolves once, in the same rotational direction of the motor shaft 32, vibrated continuously and traveled backward a great distance, forward a great distance, backward a less distance, forward a less distance, backward a great distance and forward a great distance according to the reciprocating cycle shown in the 360° flat elongated surface of the mating female slidable oblong multipurpose component 44 diagram 374 of FIG. 27.

The eight-stroke looping cam groove track 50 profile having length segment variations of the looping cam groove track 50 profile group 510 comprises a first long equal length segment 376 having a first end 378 and a second end 380; a second long equal length segment 382 having a first end 384 and a second end 386; a first short equal length segment 388 having a first end 390 and a second end 392; a second short equal length segment 394 having a first end 396 and a second end 398; a third long equal length segment 400 having a first end 402 and a second end 404 a fourth long equal length segment 406 having a first end 408 and a second end 410; a third short equal length segment 412 having a first end 414 and a second end 416; a fourth short equal length segment 418 having a first end 420 and a second end 422; a first looping joint 424; a second looping joint 426; a third looping joint 428; a fourth looping joint 430; a fifth looping joint 432; a sixth looping joint 434; a seventh looping joint 436 and an eighth looping joint 438 as illustrated in the 360° flat elongated surface of the mating female slidable oblong multipurpose component 44 diagram 440 of FIG. 28.

At the first furthest forward point of the reciprocating cycle of an eight-stroke looping cam groove track 50 profile, having length segment variations, the first end 378 of the first long equal length segment 376 is adjoined to one end of the first looping joint 424 while second end 422 of the fourth short equal length segment 418 is adjoined to the other end of the first looping joint 424 and at the first furthest backward point of the reciprocating cycle of an eight-stroke looping cam groove track 50 profile, having length segment variations, the second end 380 of the first long equal length segment 376 is adjoined to one end of the second looping joint 426 while first end 384 of the second long equal length segment 382 is adjoined to the other end of the second looping joint 426 and at the second furthest forward point of the reciprocating cycle of an eight-stroke looping cam groove track 50 profile, having length segment variations, the second end 386 of the second long equal length segment 382 is adjoined to one end of the third looping joint 428 while the first end 390 of the first short equal length segment 388 is adjoined to the other end of the third looping joint 428 and at the first lesser backward point of the reciprocating cycle of an eight-stroke looping cam groove track 50 profile, having length segment variations, the second end 392 of the first short equal length segment 388 is adjoined to one end of the fourth looping joint 430 while the first end 396 of the second short equal length segment 394 is adjoined to the other end of the fourth looping joint 430 and at the third furthest forward point of the reciprocating cycle of an eight-stroke looping cam groove track 50 profile, having length segment variations, the second end 398 of the second short equal length segment 394 is adjoined to one end of the fifth looping joint 432 while the first end 402 of the third long equal length segment 400 is adjoined to the other end of the fifth looping joint 432 and at the second furthest backward point of the reciprocating cycle of an eight-stroke looping cam groove track 50 profile, having length segment variations, the second end 404 of the third long equal length segment 400 is adjoined to one end of the sixth looping joint 434 while the first end 408 of the fourth long equal length segment 406 is adjoined to the other end of the sixth looping joint 434 and at the fourth furthest forward point of the reciprocating cycle of an eight-stroke looping cam groove track 50 profile, having length segment variations, the second end 410 of the fourth long equal length segment 406 is adjoined to one end of the seventh looping joint 436 while the first end 414 of the third short equal length segment 412 is adjoined to the other end of the seventh looping joint 436 and at the second lesser backward point of the reciprocating cycle of an eight-stroke looping cam groove track 50 profile, having length segment variations, the second end 416 of the third short equal length segment 412 is adjoined to one end of the eighth looping joint 438 while the first end 420 of the fourth short equal length segment 418 is adjoined to the other end of the eighth looping joint 438 thereby forming the reciprocating cycle of the eight-stroke looping cam groove track 50 profile having length segment variations as illustrated in the 360° flat elongated surface of the mating female slidable oblong multipurpose component 44 diagram 440 of FIG. 28.

A characteristic of the Reciprocating Rotating Vibrating Bidirectional Electric Cosmetic Applicator 10 when an eight-stroke looping cam groove track 50 profile having length segment variations as described directly above is utilized is that for every revolution of motor shaft 32, by torque gear box motor 30, the applicator head 78 simultaneously revolves once, in the same rotational direction of the motor shaft 32, vibrated continuously and traveled backward a great distance, forward a great distance, backward a less distance, forward a less distance, backward a great distance, forward a great distance, backward a less distance and forward a less distance according to the reciprocating cycle shown in the 360° flat elongated surface of the mating female slidable oblong multipurpose component 44 diagram 440 of FIG. 28.

The eight-stroke looping cam groove track 50 profile having other length segment variations of the looping cam groove track 50 profile group 510 comprises a first long equal length segment 442 having a first end 444 and a second end 446; a second long equal length segment 448 having a first end 450 and a second end 452; a first short equal length segment 454 having a first end 456 and a second end 458, a second short equal length segment 460 having a first end 462 and a second end 464; a third short equal length segment 466 having a first end 468 and a second end 470; a fourth short equal length segment 472 having a first end 474 and a second end 476; a third long equal length segment 478 having a first end 480 and a second end 482; a fourth long equal length segment 484 having a first end 486 and a second end 488; a first looping joint 490, a second looping joint 492; a third looping joint 494; a fourth looping joint 496; a fifth looping joint 498; a six looping joint 500; a seventh looping joint 502 and an eighth looping joint 504 as illustrated in the 360° flat elongated surface of the mating female slidable oblong multipurpose component 44 diagram 506 of FIG. 29.

At the first furthest forward point of the reciprocating cycle of an eight-stroke looping cam groove track 50 profile, having other length segment variations, the first end 444 of the first long equal length segment 442 is adjoined to one end of the first looping joint 490 while second end 488 of the fourth long equal length segment 484 is adjoined to the other end of the first looping joint 490 and at the first furthest backward point of the reciprocating cycle of an eight-stroke looping cam groove track 50 profile having other length segment variations, the second end 446 of the first long equal length segment 442 is adjoined to one end of the second looping joint 492 while first end 450 of the second long equal length segment 448 is adjoined to the other end of the second looping joint 492 and at the second furthest forward point of the reciprocating cycle of an eight-stroke looping cam groove track 50 profile, having other length segment variations, the second end 452 of the second long equal length segment 448 is adjoined to one end of the third looping joint 494 while the first end 456 of the first short equal length segment 454 is adjoined to the other end of the third looping joint 494 and at the first lesser backward point of the reciprocating cycle of an eight-stroke looping cam groove track 50 profile, having other length segment variations, the second end 458 of the first short equal length segment 454 is adjoined to one end of the fourth looping joint 496 while the first end 462 of the second short equal length segment 460 is adjoined to the other end of the fourth looping joint 496 and at the third furthest forward point of the reciprocating cycle of an eight-stroke looping cam groove track 50 profile, having other length segment variations, the second end 464 of the second short equal length segment 460 is adjoined to one end of the fifth looping joint 498 while the first end 468 of the third short equal length segment 466 is adjoined to the other end of the fifth looping joint 498 and at second lesser backward point of the reciprocating cycle of an eight-stroke looping cam groove track 50 profile, having other length segment variations, the second end 470 of the third short equal length segment 466 is adjoined to one end of the sixth looping joint 500 while the first end 474 of the fourth short equal length segment 472 is adjoined to the other end of the sixth looping joint 500 and at the fourth furthest forward points of the reciprocating cycle of an eight-stroke looping cam groove track 50 profile, having other length segment variations, the second end 476 of the fourth short equal length segment 472 is adjoined to one end of the seventh looping joint 502 while the first end 480 of the third long equal length segment 478 is adjoined to the other end of the seventh looping joint 502 and at the second furthest backward point of the reciprocating cycle of an eight-stroke looping cam groove track 50 profile, having other length segment variations, the second end 482 of the third long equal length segment 478 is adjoined to one end of the eighth looping joint 504 while the first end 486 of the fourth long equal length segment 484 is adjoined to the other end of the eighth looping joint 504 thereby forming the reciprocating cycle of the eight-stroke looping cam groove track 50 profile having other length segment variations as illustrated in the 360° flat elongated surface of the mating female slidable oblong multipurpose component 44 diagram 506 of FIG. 29.

A characteristic of the Reciprocating Rotating Vibrating Bidirectional Electric Cosmetic Applicator 10 when an eight-stroke looping cam groove track 50 profile having other length segment variations is utilized is that for every revolution of motor shaft 32 by torque gear box motor 30, the applicator head 78 simultaneously revolves once, in the same rotational direction of the motor shaft 32, vibrated continuously and traveled backward a great distance, forward a great distance, backward a less distance, forward a less distance, backward a less distance, forward a less distance, backward a great distance and forward a great distance according to the reciprocating cycle shown in the 360° flat elongated surface of the mating female slidable oblong multipurpose component 44 diagram 506 of FIG. 29.

The nature of drive mechanism 28 is such that when the torque gear box motor 30 rotates motor shaft 32, the mating male spline gear 34 that is carried on motor shaft 32 also rotates in the same direction and transmits that rotation to the mating female slidable oblong multipurpose component 44 by way of the series of narrow keys (external splines) 36 of the mating male spline gear 34 to the series of corresponding grooves (internal splines) 46 of the mating female slidable oblong multipurpose component 44, shown in FIG. 5, thereby enabling the stationary cam follower 66 that is engaged with the embedded looping cam groove track 50 of the mating female slidable oblong multipurpose component 44, shown in FIGS. 1, 2 and 14 thru 16, to begin to continuously dictate the embedded looping cam groove track 50 profile to the mating female slidable oblong multipurpose component 44 causing the mating female slidable oblong multipurpose component 44 to reciprocate while being rotated. Regardless of whether the mating female slidable oblong multipurpose component 44 of the drive mechanism 28 receives clockwise or counterclockwise transmission rotation from the mating male spline gear 34, the direction of reciprocation of the mating female slidable oblong multipurpose component 44 can commence in a forward or backward direction. That point within the rotating cycle and reciprocating cycle of the mating female slidable oblong multipurpose component 44 at which the commencement of rotation and reciprocation begins will always be random and is always established at the time of the most recent deactivation of the Reciprocating Rotating Vibrating Bidirectional Electric Cosmetic Applicator 10 by way of the Push-On/Push-Off switch 88 being positioned to the OFF position, in this and other embodiments, or by way of positioning the ON(L)-OFF(O)-ON(R) directional switch 84 to the OFF(O) position, in this and other embodiments. In addition, at that very moment in time when the torque gear box motor 30 began to rotate motor shaft 32 the disk coin-type vibration motor 68 commenced vibration and vibrated base 508 of transfer head 70, domed portion 72 of transfer head 70 and the rotatable shaft 56.

A characteristic of the Reciprocating Rotating Vibrating Bidirectional Electric Cosmetic Applicator 10 is that the maximum number of revolutions per minute (RPM) of motor shaft 32 by torque gear box motor 30 depends solely on the RPM ratings of the Torque Gear Box motor 30. In this present embodiment and other embodiments, when a 3Volt DC 10 RPM Torque Gear Box Motor is the Torque Gear Box motor 30 then the maximum number of revolutions that applicator head 78 revolves is 10 revolutions per minute. In this present embodiment and other embodiments, when a 3Volt DC 30 RPM Torque Gear Box Motor is the Torque Gear Box motor 30 then the maximum number of revolutions that applicator head 78 revolves is 30 revolutions per minute. In some embodiments where the voltage is great enough the speed of the Torque Gear Box motor 30 can be controlled by using a potentiometer or a switched-mode controller. Any reduction of voltage will reduce automatically the number of revolutions of the applicator head 78 per minute.

Another characteristic of the Reciprocating Rotating Vibrating Bidirectional Electric Cosmetic Applicator 10 is that the measured distance that the applicator head 78 travels forward from the beginning of the forward stroke of a reciprocating cycle to the end of the forward stroke of a reciprocating cycle will always be identical to the measured distance that the applicator head 78 travels backward from the beginning of the backward stroke of a reciprocating cycle to the end of the backward stroke of a reciprocating cycle, except in those instances when the looping cam groove track 50 profile having length segment variations is utilized. In addition, the measured distance that the applicator head 78 travels forward from the beginning of the forward stroke of a reciprocating cycle to the end of the forward stroke of a reciprocating cycle depends solely on the length of that segment of looping cam groove track 50 profile of the mating female slidable oblong multipurpose component 44.

Figure 21:
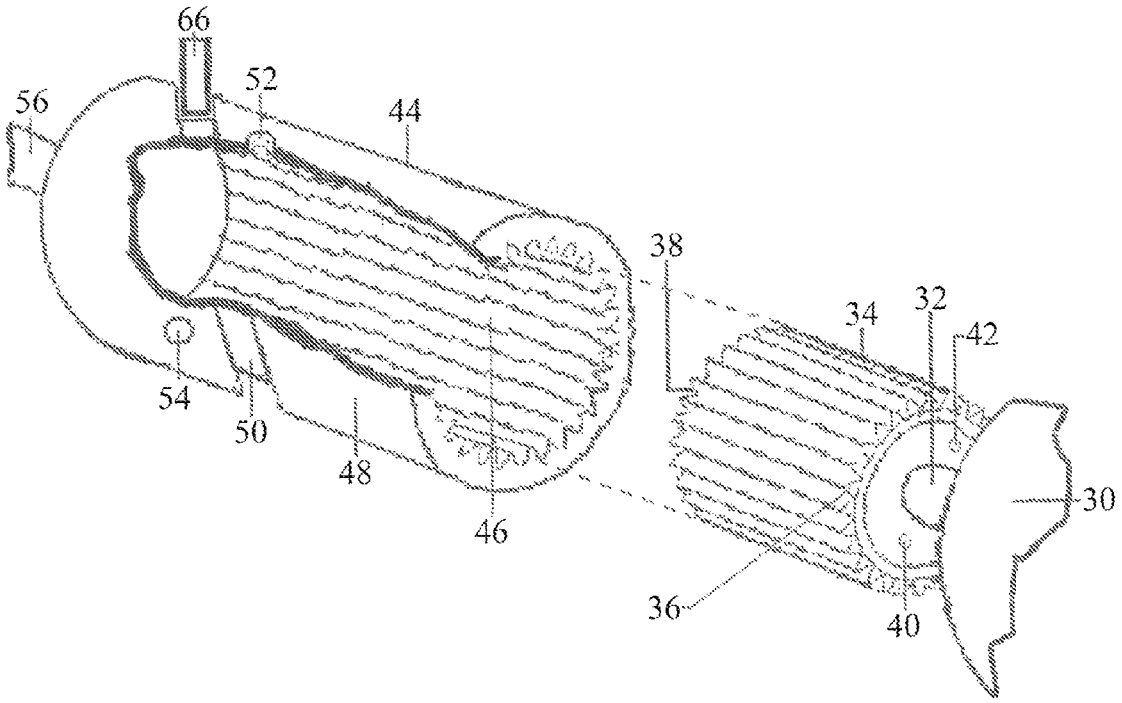
FIG. 21 is a top perspective cut-away schematic view illustrating a portion of a drive mechanism of the reciprocating, rotating, vibrating, bidirectional electric cosmetic applicator shown in FIG. 1.

A further characteristic of the Reciprocating Rotating Vibrating Bidirectional Electric Cosmetic Applicator 10 is that during the reciprocation of the mating female slidable oblong multipurpose component 44 the furthest backward point of the reciprocating cycle reached by the backward stroke of the reciprocation strokes is such that it will never be great enough to allow end 38 of the mating male spline gear 34 to travel beyond air passageway 52 and air passageway 54 of the mating female slidable oblong multipurpose component 44. The top perspective cut-away schematic view of the mating female slidable oblong multipurpose component 44, illustrated in FIG. 21, depicts a pictorial understanding of the internal interaction between the mating female slidable oblong multipurpose component 44 and the mating male spline gear 34.

In the embodiments of the invention presented the connectable applicator head 78 may rest, be driven to simultaneously rotate in either a clockwise or counterclockwise direction, reciprocate and vibrate; or be driven to simultaneously rotate in either a clockwise or counterclockwise direction and reciprocate; or just vibrate.

The Present Invention in Operation

Figure 6:
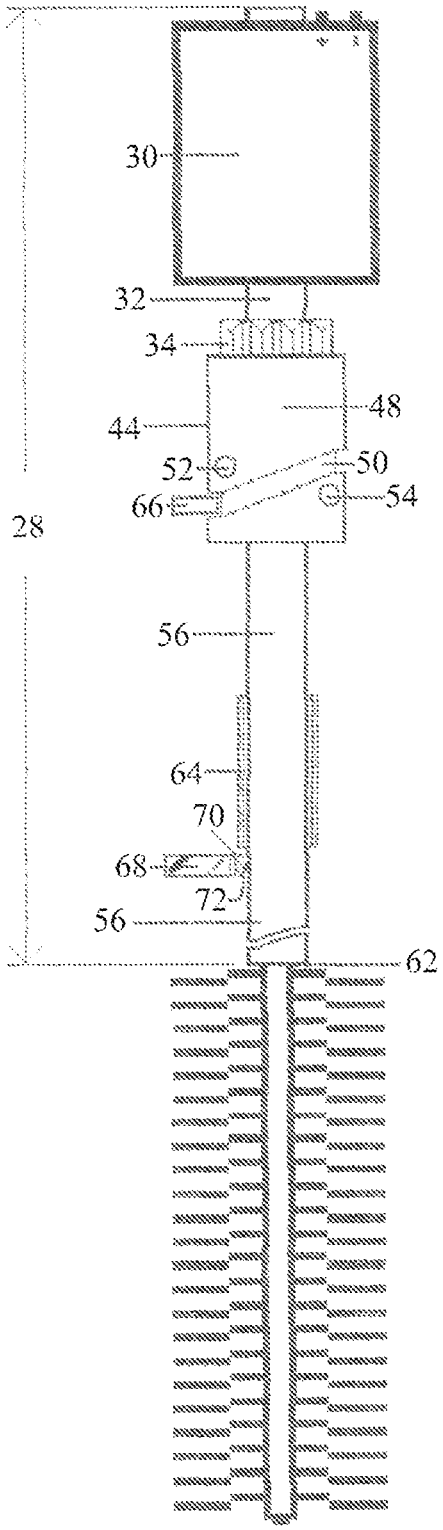
FIG. 6 is a side view illustrating the very beginning of the forward stroke of the reciprocating cycle of a two-stroke looping cam groove track profile of the reciprocating, rotating, vibrating, bidirectional electric cosmetic applicator shown in FIG. 1.
Figure 7:
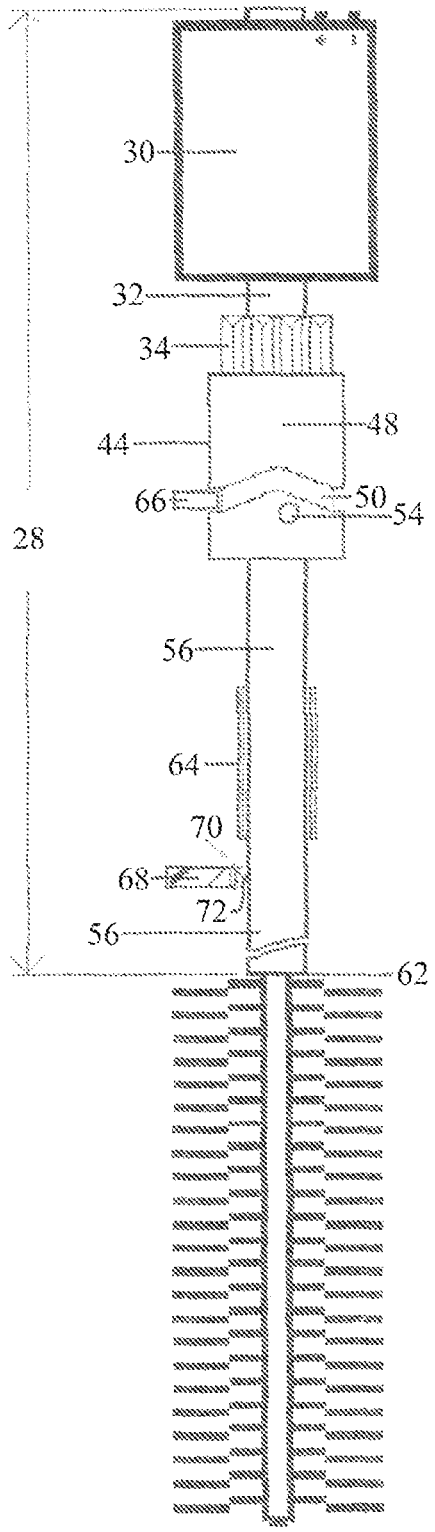
FIG. 7 is a side view illustrating the half-way position of the forward stroke of the reciprocating cycle of a two-stroke looping cam groove track profile of the reciprocating, rotating, vibrating, bidirectional electric cosmetic applicator shown in FIG. 1.

When the ON(L)-OFF(O)-ON(R) Directional Switch 84 is in the R Position and the Push-On/Push-Off Switch 88 is in an ON Position In order to fully explain accurately the operation of the Reciprocating Rotating Vibrating Bidirectional Electric Cosmetic Applicator 10 it must first be made known that a two-stroke looping cam groove track 50 profile of the looping cam groove track 50 profile group 510, shown in FIG. 22, is being utilized as looping cam groove track 50 of a mating female slidable oblong multipurpose component 44, and secondly, that an established operational commencing point of the reciprocating cycle of the two-stroke looping cam groove track 50 profile must be assigned for purposes of explanation due to the reciprocating nature of the drive mechanism 28 as described above. Therefore, the very beginning of the forward stroke of the reciprocating cycle of the two-stroke looping cam groove track 50 profile shall be the established operational commencing point, as shown in FIG. 6. Hereafter, the operational commencing point will always be determined at that point within the reciprocating cycle when the most recent deactivation of the flow of electrical current from batteries 20 occurred by way of the Push-On/Push-Off switch 88 being positioned to the OFF position or by way of switching means 86 of the ON(L)-OFF(O)-ON(R) directional switch 84 being positioned to the OFF(O) position.

Before a User operates the present invention a User must be informed that mascara carried on applicator head 78 may be applied to any group of eyelashes when the switching means 86 of the ON(L)-OFF(O)-ON(R) directional switch 84 is in the OFF(O) position, however, when the switching means 86 of the ON(L)-OFF(O)-ON(R) directional switch 84 is in the ON(R) position and the Push-On/Push-Off switch 88 is in the ON position the mascara carried on applicator head 78 must only be applied to the Right Eye-Upper Group of eyelashes and/or the Left Eye-Lower Group of eyelashes due to the clockwise rotation of applicator head 78; and when the switching means 86 of the ON(L)-OFF(O)-ON(R) directional switch 84 is in the ON(L) position and the Push-On/Push-Off switch 88 is in the ON position the mascara carried on applicator head 78 must only be applied to the Left Eye-Upper Group of eyelashes and/or the Right Eye-Lower Group of eyelashes due to the counterclockwise rotation of applicator head 78. In addition, a User is informed that it is recommended to have the Push-On/Push-Off switch 88 in the OFF position during the insertion of the applicator head 78 through opening 118 of the detachable container 14 and then through opening 122 of the surface stripper 120 into the chamber 116. Once the applicator head 78 is fully within the chamber 116 of the detachable container 14 the Push-On/Push-Off switch 88 may be positioned to the ON position momentarily thereby shearing the mascara within the chamber 116 thus lowering the viscosity of the mascara to be loaded onto applicator head 78 for the eventual depositing of the mascara to the eyelashes.

In operation of the Reciprocating Rotating Vibrating Bidirectional Electric Cosmetic Applicator 10, a User may first separate the detachable container 14 from the handle 12 by holding the detachable container 14 firmly while rotating the handle 12 to the left until the continued rotation of handle 12 causes the complete separation of the matched outer helical ridge 114 of the detachable container 14 from the matched inner helical ridge 92 of handle 12. A User then pulls the applicator head 78 of handle 12 through opening 122 of the surface stripper 120 of the detachable container 14 thus evenly compressing and distributing the mascara onto applicator head 78 for application purposes; and then guides the applicator head 78 through opening 118 of the detachable container 14. The compressed and evenly distributed mascara carried on applicator head 78 may be applied to any group of eyelashes when the switching means 86 of the ON(L)-OFF(O)-ON(R) directional switch 84 is in the OFF(O) position, however, when the switching means 86 of the ON(L)-OFF(O)-ON(R) directional switch 84 is in the ON(R) position and the Push-On/Push-Off switch 88 is in the ON position the mascara carried on applicator head 78 must only be applied to the Right Eye-Upper Group of eyelashes and/or the Left Eye-Lower Group of eyelashes due to the clockwise rotation of applicator head 78; and when the switching means 86 of the ON(L)-OFF(O)-ON(R) directional switch 84 is in the ON(L) position and the Push-On/Push-Off switch 88 is in the ON position the mascara carried on applicator head 78 must only be applied to the Left Eye-Upper Group of eyelashes and/or the Right Eye-Lower Group of eyelashes due to the counterclockwise rotation of applicator head 78.

A User then positions the switching means 86 of the ON(L)-OFF(O)-ON(R) directional switch 84 from the OFF (O) position to the ON(R) position, thereby establishing the desired electrical circuit for the electrical current to flow from batteries 20 to and through the Push-On/Push-Off switch 88 and to and through the ON(L)-OFF(O)-ON(R) directional switch 84 to the torque gear box motor 30. This operational step of positioning the switching means 86 of the ON(L)-OFF(O)-ON(R) directional switch 84 from the OFF (O) position to the ON(R) position could have been performed by a User prior to the separation of the detachable container 14 from handle 12.

A User then positions the Push-On/Push-Off switch 88 to the ON position completing the selected circuit thereby causing the electrical current to begin to flow from batteries 20 to and through the Push-On/Push-Off switch 88; and then to and through the ON(R) position circuitry of the ON(L)-OFF(O)-ON(R) directional switch 84 to the torque gear box motor 30 causing the motor shaft 32 to rotate in a clockwise direction. As the motor shaft 32 is rotating in a clockwise direction the mating male spline gear 34 carried on motor shaft 32 is also rotating in a clockwise direction and transmits that clockwise rotation by way of the series of narrow keys (external splines) 36 of the mating male spline gear 34 to the series of corresponding grooves (internal splines) 46 of the mating female slidable oblong multipurpose component 44 causing the mating female slidable oblong multipurpose component 44 to rotate in a clockwise direction. At the very moment when the mating female slidable oblong multipurpose component 44 begins to rotate in a clockwise direction, an interaction between the embedded a two-stroke looping cam groove track 50 profile on the elongated surface 48 of the mating female slidable oblong multipurpose component 44 and the stationary cam follower 66 of the drive mechanism 28 does occur. More particularly, the stationary cam follower 66 transmits the movement dictated by the embedded two-stroke looping cam groove track 50 profile on the elongated surface 48 of the mating female slidable oblong 40 multipurpose component 44 to the mating female slidable oblong multipurpose component 44 thereby causing the series of corresponding grooves (internal splines) 46 of the mating female slidable oblong multipurpose component 44 to begin to slide in a forward direction on the series of narrow keys (external splines) 36 of the mating male spline gear 34 marking the beginning of the reciprocation cycle of the two-stroke looping cam groove track 50 profile.

In addition, the rotatable shaft 56 whose first end 58, as shown in FIG. 12, is centrally affixed to closed end 60 of the mating female slidable oblong multipurpose component 44 and whose second end 62 is connectable directly to applicator head 78, as shown in FIG. 15, or in another embodiment whose second end 62 is connectable indirectly to applicator head 78 via the locking mechanism 98, as shown in FIG. 18, or yet in another embodiment whose second end 62 is connectable indirectly to applicator head 78 via the locking mechanism 98 and coupled stem 108, as shown in FIG. 20 are also being rotated in a clockwise direction and sliding in a forward direction towards the completion of the forward stroke of the reciprocation cycle of the two-stroke looping cam groove track 50 profile. The clockwise rotation and sliding in a forward direction of the rotatable shaft 56 is supported by bushing 64, shown in FIG. 1.

Figure 8:
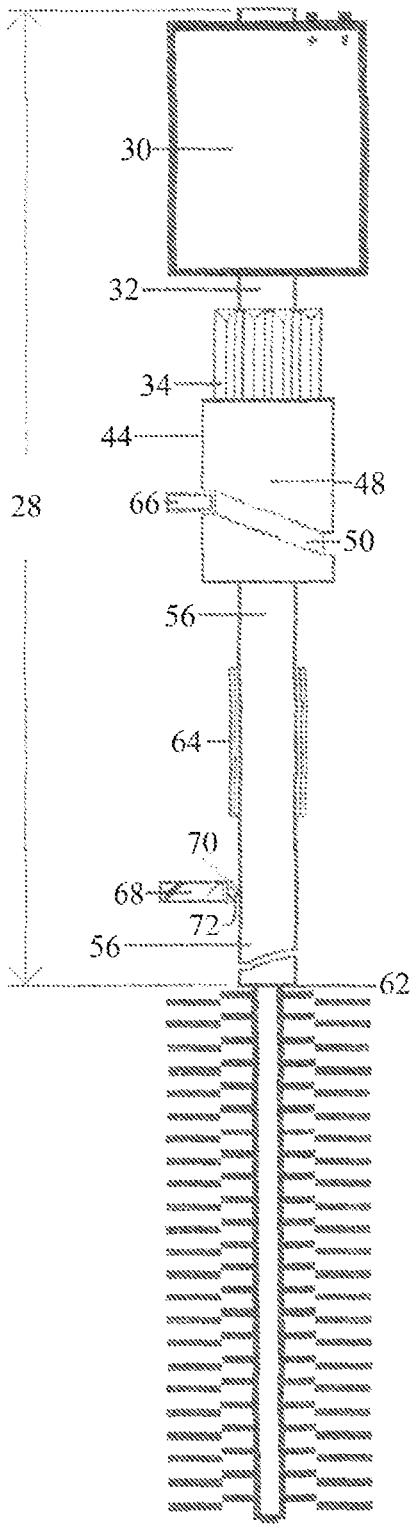
FIG. 8 is a side view illustrating the very end of the forward stroke of the reciprocating cycle of a two-stroke looping cam groove track profile of the reciprocating, rotating, vibrating, bidirectional electric cosmetic applicator shown in FIG. 1.

As the mating female slidable oblong multipurpose component 44 continues to be rotated clockwise by the transmitted clockwise rotation of the mating male spline gear 34, the embedded two-stroke looping cam groove track 50 on the elongated surface 48 of the mating female slidable oblong multipurpose component 44 that is continually engaged with the stationary cam follower 66 continues to progressively transmit the movement dictated by the two-stroke looping cam groove track 50 profile on the elongated surface 48 of the mating female slidable oblong multipurpose component 44 to the mating female slidable oblong multipurpose component 44 causing the series of corresponding grooves (internal splines) 46 of the mating female slidable oblong multipurpose component 44 to continue to slide in a forward direction on the series of narrow keys (external splines) 36 of the mating male spline gear 34, thereby continuing to drive the mating female slidable oblong multipurpose component 44, the attached rotatable shaft 56 and applicator head 78, as shown in FIG. 15, or in another embodiment the indirectly connected applicator head 78 via the directly connected locking mechanism 98, as shown in FIG. 18, or yet in another embodiment the indirectly connected applicator head 78 via the directly connected locking mechanism 98 and coupled stem 108, as shown in FIG. 20 in a forward direction until the furthest forward point of the reciprocating cycle of the two-stroke looping cam groove track 50 profile dictated by the two-stroke looping cam groove track 50 profile is reached marking the end of the forward stroke, as shown in FIG. 8.

Figure 11:
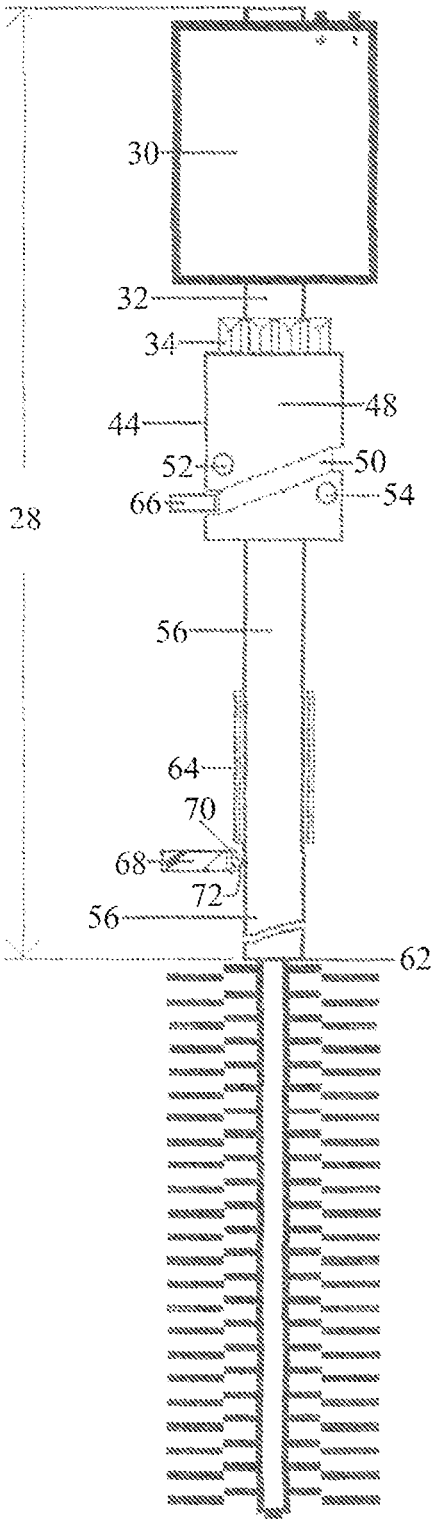
FIG. 11 is a side view illustrating the very end of the backward stroke of the reciprocating cycle of a two-stroke looping cam groove track profile of the reciprocating, rotating, vibrating, bidirectional electric cosmetic applicator shown in FIG. 1.
Figure 12:
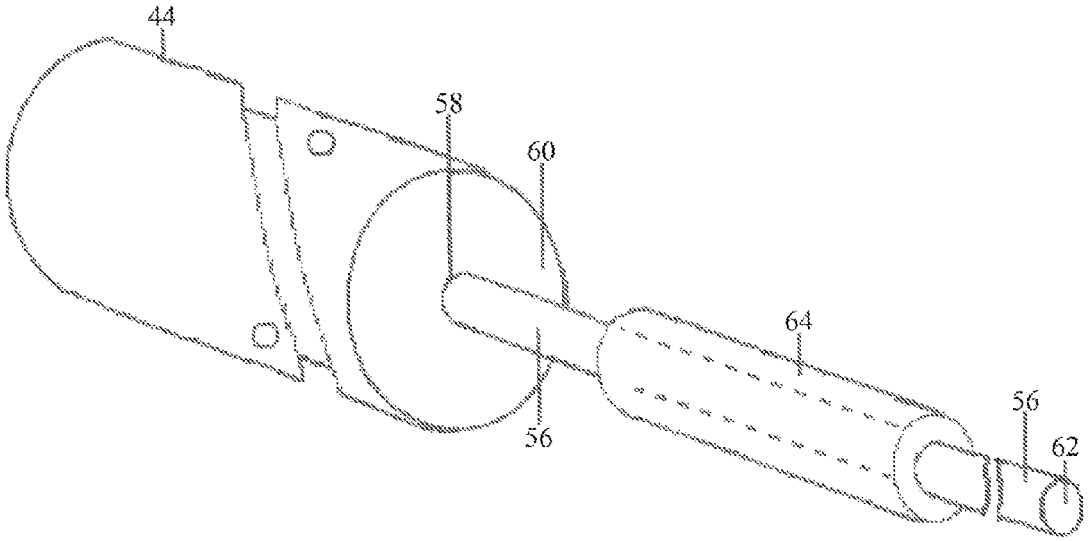
FIG. 12 is a top perspective schematic view illustrating the attachment of one end of the rotatable shaft to the closed-end of the mating female slidable oblong multipurpose component of the reciprocating, rotating, vibrating, bidirectional electric cosmetic applicator shown in FIG. 1.

As the mating female slidable oblong multipurpose component 44 continues to receive transmitted clockwise rotation and rotate clockwise, the embedded two-stroke looping cam groove track 50 on the elongated surface 48 of the mating female slidable oblong multipurpose component 44 that is continually engaged with the stationary cam follower 66 continues to transmit the movement dictated by the two-stroke looping cam groove track 50 profile on the elongated surface 48 of the mating female slidable oblong multipurpose component 44 to the mating female slidable oblong multipurpose component 44 resulting in the mating female slidable oblong multipurpose component 44, the attached rotatable shaft 56 and applicator head 78, as shown in FIG. 15, or in another embodiment the indirectly connected applicator head 78 via the directly connected locking mechanism 98, as shown in FIG. 18, or yet in another embodiment the indirectly connected applicator head 78 via the directly connected locking mechanism 98 and coupled stem 108, as shown in FIG. 20 to loop into the backward stroke of the reciprocation cycle of the two-stroke looping cam groove track 50 profile causing the series of corresponding grooves (internal splines) 46 of the mating female slidable oblong multipurpose component 44 to slide in a backward direction on the series of narrow keys (external splines) 36 of the mating male spline gear 34, and continues to do so, until the furthest backward peak of the reciprocating cycle of the two-stroke looping cam groove track 50 profile dictated by the two-stroke looping cam groove track 50 profile is reached marking the end of the backward stroke, as shown in FIG. 11.

Whereupon, the continuation of the mating female slidable oblong multipurpose component 44 receiving transmitted clockwise rotation and rotating clockwise results in the continuation of the embedded two-stroke looping cam groove track 50 on the elongated surface 48 of the mating female slidable oblong multipurpose component 44 that is continually engaged with the stationary cam follower 66 to progressively transmit the movement dictated by the two-stroke looping cam groove track 50 profile of the elongated surface 48 of the mating female slidable oblong multipurpose component 44 to the mating female slidable oblong multipurpose component 44 resulting in an immediate looping back to and entering into and completing the forward stroke of the reciprocation cycle; and then, the looping back to and entering into and completing the backward stroke of the reciprocation cycle and so forth and so on. The rotation and reciprocation cycle of the two-stroke looping cam groove track 50 profile is shown in FIGS. 6 thru 11.

In addition, at that same moment in time when a User positioned the Push-On/Push-Off switch 88 to the ON position, a vibration also commenced, continued and was transferred to the applicator head 78. More particularly, when the Push-On/Push-Off switch 88 was positioned to the ON position the electrical current also began to flow from batteries 20 to and through the Push-On/Push-Off switch 88 to the disk coin-type vibration motor 68 causing the disk coin-type vibration motor 68 to begin to vibrate sending continual vibration to and through the base 508 of transfer head 70; to and through the domed portion 72 of transfer head 70; to and through the rotating and reciprocating rotatable shaft 56; and to and through the directly connected applicator head 78, as shown in FIG. 15, or in another embodiment to and through the indirectly connected to applicator head 78 via the locking mechanism 98, as shown in FIG. 18, or yet in another embodiment to and through the indirectly connected to applicator head 78 via the locking mechanism 98 and coupled stem 108, as shown in FIG. 20.

The repeated reciprocation of the series of corresponding grooves (internal splines) 46 of the mating female slidable oblong multipurpose component 44 sliding forward and backward on the series of narrow keys (external splines) 36 of the mating male spline gear 34 creates air movement within the open drive mechanism compartment 24 that freely flows within to and fro through air flow shaft 40 and air flow shaft 42 of the mating male spline gear 34, as shown in FIG. 5, as well as, to and fro through air passageway 52 and air passageway 54 of the mating female slidable oblong multipurpose component 44, as shown in FIGS. 5 and 6; and to and fro through the air flow shaft 82, shown in FIG. 1 during the entire operation of the Reciprocating Rotating Vibrating Bidirectional Electric Cosmetic Applicator 10.

While applicator head 78 is simultaneously reciprocating, rotating clockwise and vibrating a User transfers the mascara from applicator head 78 to the Right Eye-Upper Group of eyelashes and/or the Left Eye-Lower Group of eyelashes thereby providing a User a new unmatched ultimate mascara application experience. The simultaneous reciprocation, clockwise rotation and vibration the applicator head 78 continues until a User positions the Push-On/Push-Off switch 88 to the OFF position.

Once a User completes the application of mascara to all of the desired eyelash groups, a User inserts the applicator head 78 through opening 118 of the detachable container 14; through opening 122 of the surface stripper 120 into the chamber 116 of the detachable container 14, and then, holds the detachable container 14 firmly while rotating the handle 12 to the right until the continued rotation of the matched outer helical ridge 114 of the detachable container 14 and the matched inner helical ridge 92 of handle 12 tightly seal handle 12 with the detachable container 14.

In the present embodiment and operation of the invention described above a two-stroke looping cam groove track 50 profile of the looping cam groove track 50 profile group 510, as shown in FIG. 22 was utilized. Therefore, for every clockwise revolution of motor shaft 32 by torque gear box motor 30 the applicator head 78 simultaneously revolved once in the same rotational direction of the motor shaft 32, vibrated continuously and traveled once forward and once backward equally in distance according to the reciprocating cycle shown in the 360° flat elongated surface of the mating female slidable oblong multipurpose component 44 diagram 140 shown in FIG. 22.

However, in some embodiments a four-stroke looping cam groove track profile of the looping cam groove track 50 profile group 510, as shown in FIG. 23 is utilized as looping cam groove track 50. Therefore, for every clockwise revolution of motor shaft 32, by torque gear box motor 30, the applicator head 78 simultaneously revolved once, in the same rotational direction of the motor shaft 32, vibrated continuously and traveled backward, forward, backward and forward equally in distance according to the reciprocating cycle shown in the 360° flat elongated surface of the mating female slidable oblong multipurpose component 44 diagram 174 of FIG. 23; and yet, in another embodiment a six-stroke looping cam groove track 50 profile of the looping cam groove track 50 profile group 510 is utilized as looping cam groove track 50. Therefore, for every clockwise revolution of motor shaft 32 by torque gear box motor 30, the applicator head 78 simultaneously revolves once, in the same rotational direction of the motor shaft 32, vibrated continuously and traveled backward, forward, backward, forward, backward and forward equally in distance according to the reciprocating cycle shown in the 360° flat elongated surface of the mating female slidable oblong multipurpose component 44 diagram 224 of FIG. 24; and yet, in other embodiments an eight-stroke looping cam groove track 50 profile of the looping cam groove track 50 profile group 510 is utilized as looping cam groove track 50. Therefore, for every clockwise revolution of motor shaft 32 by torque gear box motor 30, the applicator head 78 simultaneously revolves once, in the same rotational direction of the motor shaft 32, vibrated continuously and traveled backward, forward, backward, forward, backward, forward, backward and forward equally in distance according to the reciprocating cycle shown in the 360° flat elongated surface of the mating female slidable oblong multipurpose component 44 diagram 290 of FIG. 25; and yet, in yet other embodiments a four-stroke looping cam groove track 50 profile of the looping cam groove track 50 profile group 510 having length segment variations is utilized as looping cam groove track 50. Therefore, for every clockwise revolution of motor shaft 32 by torque gear box motor 30 the applicator head 78 simultaneously revolves once, in the same rotational direction of the motor shaft 32, vibrated continuously and traveled backward a greater distance, forward a lesser distance, backward a lesser distance and forward a greater distance according to the reciprocating cycle shown in the 360° flat elongated surface of the mating female slidable oblong multipurpose component 44 diagram 324 of FIG. 26; and yet, in another embodiments a six-stroke looping cam groove track 50 profile of the looping cam groove track 50 profile group 510 having length segment variations is utilized as looping cam groove track 50. Therefore, for every clockwise revolution of motor shaft 32 by torque gear box motor 30, the applicator head 78 simultaneously revolves once, in the same rotational direction of the motor shaft 32, vibrated continuously and traveled backward a great distance, forward a great distance, backward a less distance, forward a less distance, backward a great distance and forward a great distance according to the reciprocating cycle shown in the 360° flat elongated surface of the mating female slidable oblong multipurpose component 44 diagram 374 of FIG. 27; and yet, in yet another embodiments an eight-stroke looping cam groove track 50 profile of the looping cam groove track 50 profile group 510 having length segment variations is utilized as looping cam groove track 50. Therefore, for every clockwise revolution of motor shaft 32, by torque gear box motor 30, the applicator head 78 simultaneously revolves once, in the same rotational direction of the motor shaft 32, vibrated continuously and traveled backward a great distance, forward a great distance, backward a less distance, forward a less distance, backward a great distance, forward a great distance, backward a less distance and forward a less distance according to the reciprocating cycle shown in the 360° flat elongated surface of the mating female slidable oblong multipurpose component 44 diagram 440 of FIG. 28; and yet, in yet other embodiments an eight-stroke looping cam groove track profile having other length segment variations, as shown in FIG. 29 an eight-stroke looping cam groove track 50 profile of the looping cam groove track 50 profile group 510 having other length segment variations is utilized as looping cam groove track 50. Therefore, for every clockwise revolution of motor shaft 32 by torque gear box motor 30, the applicator head 78 simultaneously revolves once, in the same rotational direction of the motor shaft 32, vibrated continuously and traveled backward a great distance, forward a great distance, backward a less distance, forward a less distance, backward a less distance, forward a less distance, backward a great distance and forward a great distance according to the reciprocating cycle shown in the 360° flat elongated surface of the mating female slidable oblong multipurpose component 44 diagram 506 of FIG. 29.

The Present Invention in Operation

Figure 9:
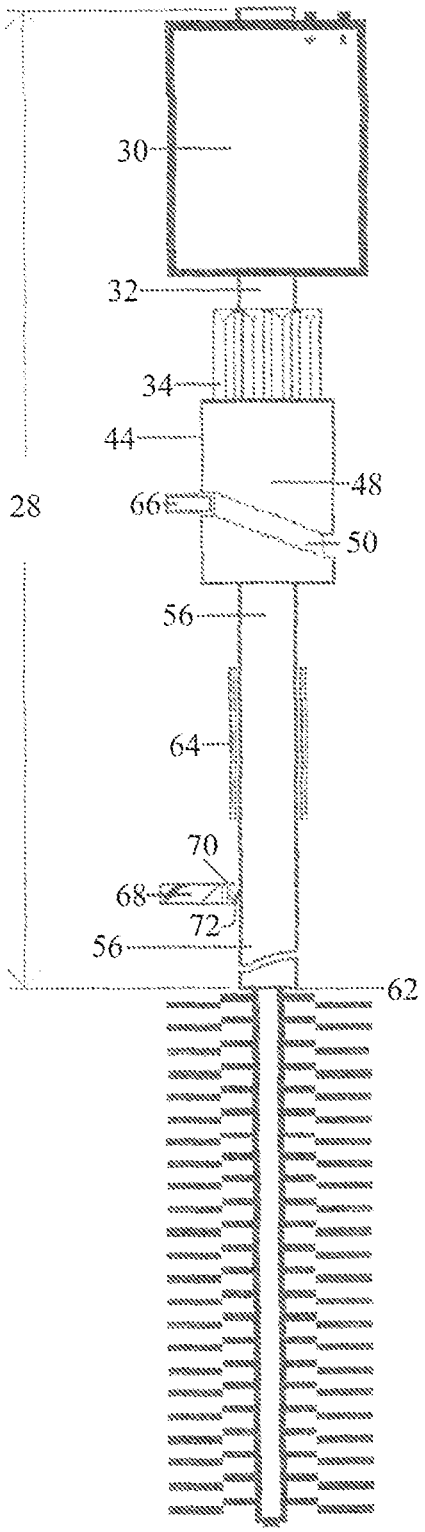
FIG. 9 is a side view illustrating the very beginning of the backward stroke of the reciprocating cycle of a two-stroke looping cam groove track profile of the reciprocating, rotating, vibrating, bidirectional electric cosmetic applicator shown in FIG. 1.
Figure 10:
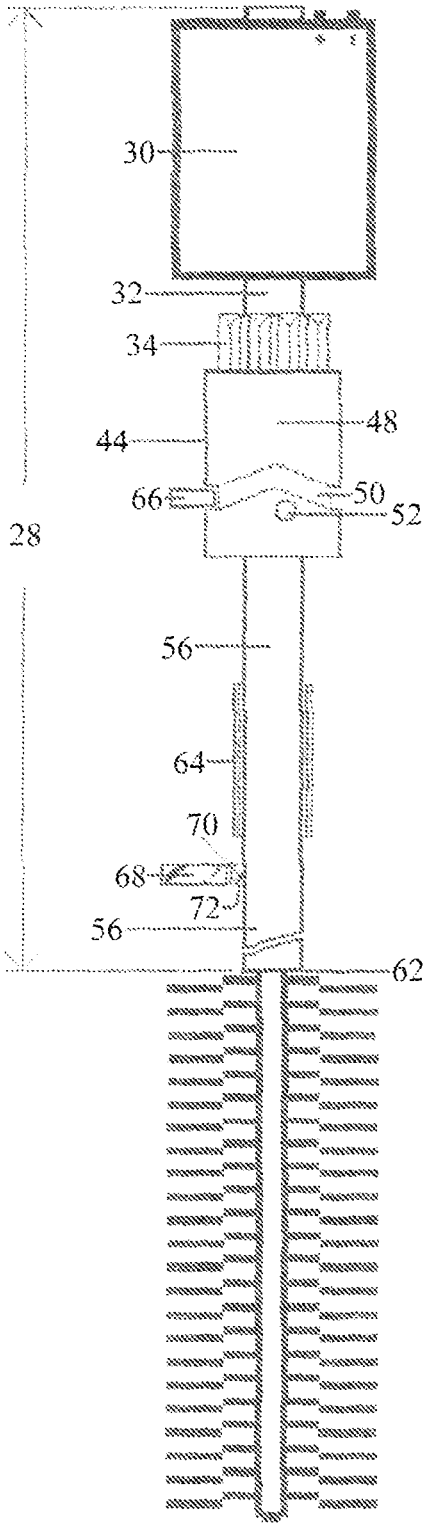
FIG. 10 is a side view illustrating the half-way backward stroke of the reciprocating cycle of a two-stroke looping cam groove track profile of the reciprocating, rotating, vibrating, bidirectional electric cosmetic applicator shown in FIG. 1.

When the ON(L)-OFF(O)-ON(R) Directional Switch 84 is in the L Position and the Push-On/Push-Off Switch 88 is in an ON Position In order to fully explain accurately the operation of the Reciprocating Rotating Vibrating Bidirectional Electric Cosmetic Applicator 10 it must first be made known that a two-stroke looping cam groove track 50 profile of the looping cam groove track 50 profile group 510, shown in FIG. 22, is being utilized as looping cam groove track 50 of a mating female slidable oblong multipurpose component 44, and secondly, that an established operational commencing point of the reciprocating cycle of the two-stroke looping cam groove track 50 profile must be assigned for purposes of explanation due to the reciprocating nature of the drive mechanism 28 as described above. Therefore, the very beginning of the backward stroke of the reciprocating cycle of the two-stroke looping cam groove track 50 profile shall be the established operational commencing point, as shown in FIG. 9. Hereafter, the operational commencing point will always be determined at that point within the reciprocating cycle when the most recent deactivation of the flow of electrical current from batteries 20 occurred by way of the Push-On/Push-Off switch 88 being positioned to the OFF position or by way of switching means 86 of the ON(L)-OFF(O)-ON(R) directional switch 84 being positioned to the OFF(O) position.

Before a User operates the present invention a User must be informed that the mascara carried on applicator head 78 may be applied to any group of eyelashes when the switching means 86 of the ON(L)-OFF(O)-ON(R) directional switch 84 is in the OFF(O) position, however, when the switching means 86 of the ON(L)-OFF(O)-ON(R) directional switch 84 is in the ON(R) position and the Push-On/Push-Off switch 88 is in the ON position the mascara carried on applicator head 78 must only be applied to the Right Eye-Upper Group of eyelashes and/or the Left Eye-Lower Group of eyelashes due to the clockwise rotation of applicator head 78; and when the switching means 86 of the ON(L)-OFF(O)-ON(R) directional switch 84 is in the ON(L) position and the Push-On/Push-Off switch 88 is in the ON position the mascara carried on applicator head 78 must only be applied to the Left Eye-Upper Group of eyelashes and/or the Right Eye-Lower Group of eyelashes due to the counterclockwise rotation of applicator head 78. In addition, a User is informed that it is recommended to have the Push-On/Push-Off switch 88 in the OFF position during the insertion of the applicator head 78 through opening 118 of the detachable container 14 and then through opening 122 of the surface stripper 120 into the chamber 116. Once the applicator head 78 is fully within the chamber 116 of the detachable container 14 the Push-On/Push-Off switch 88 may be positioned to the ON position momentarily thereby shearing the mascara within the chamber 116 thus lowering the viscosity of the mascara to be loaded onto applicator head 78 for the eventual depositing of the mascara to the eyelashes.

In operation of the Reciprocating Rotating Vibrating Bidirectional Electric Cosmetic Applicator 10, a User may first separate the detachable container 14 from the handle 12 by holding the detachable container 14 firmly while rotating the handle 12 to the left until the continued rotation of handle 12 causes the complete separation of the matched outer helical ridge 114 of the detachable container 14 from the matched inner helical ridge 92 of handle 12. A User then pulls the applicator head 78 of handle 12 through opening 122 of the surface stripper 120 of the detachable container 14 thus evenly compressing and distributing the mascara onto applicator head 78 for application purposes; and then guides the applicator head 78 through opening 118 of the detachable container 14. The compressed and evenly distributed mascara carried on applicator head 78 may be applied to any group of eyelashes when the switching means 86 of the ON(L)-OFF(O)-ON(R) directional switch 84 is in the OFF(O) position, however, when the switching means 86 of the ON(L)-OFF(O)-ON(R) directional switch 84 is in the ON(R) position and the Push-On/Push-Off switch 88 is in the ON position the mascara carried on applicator head 78 must only be applied to the Right Eye-Upper Group of eyelashes and/or the Left Eye-Lower Group of eyelashes due to the clockwise rotation of applicator head 78; and when the switching means 86 of the ON(L)-OFF(O)-ON(R) directional switch 84 is in the ON(L) position and the Push-On/Push-Off switch 88 is in the ON position the mascara carried on applicator head 78 must only be applied to the Left Eye-Upper Group of eyelashes and/or the Right Eye-Lower Group of eyelashes due to the counterclockwise rotation of applicator head 78.

A User then positions the switching means 86 of the ON(L)-OFF(O)-ON(R) directional switch 84 from the OFF (O) position to the ON(L) position, thereby establishing the desired electrical circuit for the electrical current to flow from batteries 20 to and through the Push-On/Push-Off switch 88 and to and through the ON(L)-OFF(O)-ON(R) directional switch 84 to the torque gear box motor 30. This operational step of positioning the switching means 86 of the ON(L)-OFF(O)-ON(R) directional switch 84 from the OFF (O) position to the ON(L) position could have been performed by a User prior to the separation of the detachable container 14 from handle 12.

A User then positions the Push-On/Push-Off switch 88 to the ON position completing the selected circuit thereby causing the electrical current to begin to flow from batteries 20 to and through the Push-On/Push-Off switch 88; and then to and through the ON(L) position circuitry of the ON(L)-OFF(O)-ON(R) directional switch 84 to the torque gear box motor 30 causing the motor shaft 32 to rotate in a counterclockwise direction. As the motor shaft 32 is rotating in a counterclockwise direction the mating male spline gear 34 carried on motor shaft 32 is also rotating in a counterclockwise direction and transmits that counterclockwise rotation by way of the series of narrow keys (external splines) 36 of the mating male spline gear 34 to the series of corresponding grooves (internal splines) 46 of the mating female slidable oblong multipurpose component 44 causing the mating female slidable oblong multipurpose component 44 to rotate in a counterclockwise direction. At the very moment when the mating female slidable oblong multipurpose component 44 begins to rotate in a counterclockwise direction, an interaction between the embedded a two-stroke looping cam groove track 50 profile on the elongated surface 48 of the mating female slidable oblong multipurpose component 44 and the stationary cam follower 66 of the drive mechanism 28 does occur. More particularly, the stationary cam follower 66 transmits the movement dictated by the embedded two-stroke looping cam groove track 50 profile on the elongated surface 48 of the mating female slidable oblong 40 multipurpose component 44 to the mating female slidable oblong multipurpose component 44 thereby causing the series of corresponding grooves (internal splines) 46 of the mating female slidable oblong multipurpose component 44 to begin to slide in a backward direction on the series of narrow keys (external splines) 36 of the mating male spline gear 34 marking the beginning of the reciprocation cycle of the two-stroke looping cam groove track 50 profile.

In addition, the rotatable shaft 56 whose first end 58, as shown in FIG. 12, is centrally affixed to closed end 60 of the mating female slidable oblong multipurpose component 44 and whose second end 62 is connectable directly to applicator head 78, as shown in FIG. 15, or in another embodiment whose second end 62 is connectable indirectly to applicator head 78 via the locking mechanism 98, as shown in FIG. 18, or yet in another embodiment whose second end 62 is connectable indirectly to applicator head 78 via the locking mechanism 98 and coupled stem 108, as shown in FIG. 20 are also being rotated in a counterclockwise direction and sliding in a backward direction towards the completion of the backward stroke of the reciprocation cycle of the two-stroke looping cam groove track 50 profile. The counterclockwise rotation and sliding in a backward direction of the rotatable shaft 56 is supported by bushing 64, shown in FIG. 1.

As the mating female slidable oblong multipurpose component 44 continues to be rotated counterclockwise by the transmitted counterclockwise rotation of the mating male spline gear 34, the embedded two-stroke looping cam groove track 50 on the elongated surface 48 of the mating female slidable oblong multipurpose component 44 that is continually engaged with the stationary cam follower 66 continues to progressively transmit the movement dictated by the two-stroke looping cam groove track 50 profile on the elongated surface 48 of the mating female slidable oblong multipurpose component 44 to the mating female slidable oblong multipurpose component 44 causing the series of corresponding grooves (internal splines) 46 of the mating female slidable oblong multipurpose component 44 to continue to slide in a backward direction on the series of narrow keys (external splines) 36 of the mating male spline gear 34, thereby continuing to drive the mating female slidable oblong multipurpose component 44, the attached rotatable shaft 56 and applicator head 78, as shown in FIG. 15, or in another embodiment the indirectly connected applicator head 78 via the directly connected locking mechanism 98, as shown in FIG. 18, or yet in another embodiment the indirectly connected applicator head 78 via the directly connected locking mechanism 98 and coupled stem 108, as shown in FIG. 20 in a backward direction until the furthest backward point of the reciprocating cycle of the two-stroke looping cam groove track 50 profile dictated by the two-stroke looping cam groove track 50 profile is reached marking the end of the backward stroke, as shown in FIG. 11.

As the mating female slidable oblong multipurpose component 44 continues to receive transmitted counterclockwise rotation and rotate counterclockwise, the embedded two-stroke looping cam groove track 50 on the elongated surface 48 of the mating female slidable oblong multipurpose component 44 that is continually engaged with the stationary cam follower 66 continues to transmit the movement dictated by the two-stroke looping cam groove track 50 profile on the elongated surface 48 of the mating female slidable oblong multipurpose component 44 to the mating female slidable oblong multipurpose component 44 resulting in the mating female slidable oblong multipurpose component 44, the attached rotatable shaft 56 and applicator head 78, as shown in FIG. 15, or in another embodiment the indirectly connected applicator head 78 via the directly connected locking mechanism 98, as shown in FIG. 18, or yet in another embodiment the indirectly connected applicator head 78 via the directly connected locking mechanism 98 and coupled stem 108, as shown in FIG. 20 to loop into the forward stroke of the reciprocation cycle of the two-stroke looping cam groove track 50 profile causing the series of corresponding grooves (internal splines) 46 of the mating female slidable oblong multipurpose component 44 to slide in a forward direction on the series of narrow keys (external splines) 36 of the mating male spline gear 34, and continues to do so, until the furthest forward peak of the reciprocating cycle of the two-stroke looping cam groove track 50 profile dictated by the two-stroke looping cam groove track 50 profile is reached marking the end of the forward stroke, as shown in FIG. 8.

Whereupon, the continuation of the mating female slidable oblong multipurpose component 44 receiving transmitted counterclockwise rotation and rotating counterclockwise results in the continuation of the embedded two-stroke looping cam groove track 50 on the elongated surface 48 of the mating female slidable oblong multipurpose component 44 that is continually engaged with the stationary cam follower 66 to progressively transmit the movement dictated by the two-stroke looping cam groove track 50 profile of the elongated surface 48 of the mating female slidable oblong multipurpose component 44 to the mating female slidable oblong multipurpose component 44 resulting in an immediate looping back to and entering into and completing the backward stroke of the reciprocation cycle; and then, the looping back to and entering into and completing the forward stroke of the reciprocation cycle and so forth and so on. The rotation and reciprocation cycle of the two-stroke looping cam groove track 50 profile is shown in FIGS. 6 thru 11.

In addition, at that same moment in time when a User positioned the Push-On/Push-Off switch 88 to the ON position, a vibration also commenced, continued and was transferred to the applicator head 78. More particularly, when the Push-On/Push-Off switch 88 was positioned to the ON position the electrical current also began to flow from batteries 20 to and through the Push-On/Push-Off switch 88 to the disk coin-type vibration motor 68 causing the disk coin-type vibration motor 68 to begin to vibrate sending continual vibration to and through the base 508 of transfer head 70; to and through the domed portion 72 of transfer head 70; to and through the rotating and reciprocating rotatable shaft 56; and to and through the directly connected applicator head 78, as shown in FIG. 15, or in another embodiment to and through the indirectly connected to applicator head 78 via the locking mechanism 98, as shown in FIG. 18, or yet in another embodiment to and through the indirectly connected to applicator head 78 via the locking mechanism 98 and coupled stem 108, as shown in FIG. 20.

The repeated reciprocation of the series of corresponding grooves (internal splines) 46 of the mating female slidable oblong multipurpose component 44 sliding backward and forward on the series of narrow keys (external splines) 36 of the mating male spline gear 34 creates air movement within the open drive mechanism compartment 24 that freely flows within to and fro through air flow shaft 40 and air flow shaft 42 of the mating male spline gear 34, as shown in FIG. 5, as well as, to and fro through air passageway 52 and air passageway 54 of the mating female slidable oblong multipurpose component 44, as shown in FIGS. 5 and 6; and to and fro through the air flow shaft 82, shown in FIG. 1 during the entire operation of the Reciprocating Rotating Vibrating Bidirectional Electric Cosmetic Applicator 10.

While applicator head 78 is simultaneously reciprocating, rotating counterclockwise and vibrating a User transfers the mascara from applicator head 78 to the Left Eye-Upper Group of eyelashes and/or the Right Eye-Lower Group of eyelashes thereby providing a User a new unmatched ultimate mascara application experience. The simultaneous reciprocation, counterclockwise rotation and vibration the applicator head 78 continues until a User positions the Push-On/Push-Off switch 88 to the OFF position.

Once a User completes the application of mascara to all of the desired eyelash groups, a User inserts the applicator head 78 through opening 118 of the detachable container 14; through opening 122 of the surface stripper 120 into the chamber 116 of the detachable container 14, and then, holds the detachable container 14 firmly while rotating the handle 12 to the right until the continued rotation of the matched outer helical ridge 114 of the detachable container 14 and the matched inner helical ridge 92 of handle 12 tightly seal handle 12 with the detachable container 14.

In the present embodiment and operation of the invention described above a two-stroke looping cam groove track 50 profile of the looping cam groove track 50 profile group 510, as shown in FIG. 22 was utilized. Therefore, for every counterclockwise revolution of motor shaft 32 by torque gear box motor 30 the applicator head 78 simultaneously revolved once in the same rotational direction of the motor shaft 32, vibrated continuously and traveled once backward and once forward equally in distance according to the reciprocating cycle shown in the 360° flat elongated surface of the mating female slidable oblong multipurpose component 44 diagram 140 shown in FIG. 22.

However, in some embodiments a four-stroke looping cam groove track profile of the looping cam groove track 50 profile group 510, as shown in FIG. 23 is utilized as looping cam groove track 50. Therefore, for every counterclockwise revolution of motor shaft 32, by torque gear box motor 30, the applicator head 78 simultaneously revolved once, in the same rotational direction of the motor shaft 32, vibrated continuously and traveled forward, backward, forward and backward equally in distance according to the reciprocating cycle shown in the 360° flat elongated surface of the mating female slidable oblong multipurpose component 44 diagram 174 of FIG. 23; and yet, in another embodiment an six-stroke looping cam groove track 50 profile of the looping cam groove track 50 profile group 510 is utilized as looping cam groove track 50. Therefore, for every counterclockwise revolution of motor shaft 32 by torque gear box motor 30, the applicator head 78 simultaneously revolves once, in the same rotational direction of the motor shaft 32, vibrated continuously and traveled forward, backward, forward, backward, forward and backward equally in distance according to the reciprocating cycle shown in the 360° flat elongated surface of the mating female slidable oblong multipurpose component 44 diagram 224 of FIG. 24; and yet, in other embodiments an eight-stroke looping cam groove track 50 profile of the looping cam groove track 50 profile group 510 is utilized as looping cam groove track 50. Therefore, for every counterclockwise revolution of motor shaft 32 by torque gear box motor 30, the applicator head 78 simultaneously revolves once, in the same rotational direction of the motor shaft 32, vibrated continuously and traveled forward, backward, forward, backward, forward, backward, forward and backward equally in distance according to the reciprocating cycle shown in the 360° flat elongated surface of the mating female slidable oblong multipurpose component 44 diagram 290 of FIG. 25; and yet, in yet other embodiments a four-stroke looping cam groove track 50 profile of the looping cam groove track 50 profile group 510 having length segment variations is utilized as looping cam groove track 50. Therefore, for every counterclockwise revolution of motor shaft 32 by torque gear box motor 30 the applicator head 78 simultaneously revolves once, in the same rotational direction of the motor shaft 32, vibrated continuously and traveled forward a greater distance, backward a lesser distance, forward a lesser distance and backward a greater distance according to the reciprocating cycle shown in the 360° flat elongated surface of the mating female slidable oblong multipurpose component 44 diagram 324 of FIG. 26; and yet, in another embodiments a six-stroke looping cam groove track 50 profile of the looping cam groove track 50 profile group 510 having length segment variations is utilized as looping cam groove track 50. Therefore, for every counterclockwise revolution of motor shaft 32 by torque gear box motor 30, the applicator head 78 simultaneously revolves once, in the same rotational direction of the motor shaft 32, vibrated continuously and traveled forward a great distance, backward a great distance, forward a less distance, backward a less distance, forward a great distance and backward a great distance according to the reciprocating cycle shown in the 360° flat elongated surface of the mating female slidable oblong multipurpose component 44 diagram 374 of FIG. 27; and yet, in yet another embodiments an eight-stroke looping cam groove track 50 profile of the looping cam groove track 50 profile group 510 having length segment variations is utilized as looping cam groove track 50. Therefore, for every counterclockwise revolution of motor shaft 32, by torque gear box motor 30, the applicator head 78 simultaneously revolves once, in the same rotational direction of the motor shaft 32, vibrated continuously and traveled forward a great distance, backward a great distance, forward a less distance, backward a less distance, forward a great distance, backward a great distance, forward a less distance and backward a less distance according to the reciprocating cycle shown in the 360° flat elongated surface of the mating female slidable oblong multipurpose component 44 diagram 440 of FIG. 28; and yet, in yet other embodiments an eight-stroke looping cam groove track profile having other length segment variations, as shown in FIG. 29 an eight-stroke looping cam groove track 50 profile of the looping cam groove track 50 profile group 510 having other length segment variations is utilized as looping cam groove track 50. Therefore, for every counterclockwise revolution of motor shaft 32 by torque gear box motor 30, the applicator head 78 simultaneously revolves once, in the same rotational direction of the motor shaft 32, vibrated continuously and traveled forward a great distance, backward a great distance, forward a less distance, backward a less distance, forward a less distance, backward a less distance, forward a great distance and backward a great distance according to the reciprocating cycle shown in the 360° flat elongated surface of the mating female slidable oblong multipurpose component 44 diagram 506 of FIG. 29.

The Present Invention in Operation

When the ON(L)-OFF(O)-ON(R) Directional Switch 84 is in the OFF(O) Position and the Push-On/Push-Off Switch 88 is in an ON Position Before a User operates the present invention, a User must be informed that mascara carried on applicator head 78 may be applied to any group of eyelashes when the switching means 86 of the ON(L)-OFF(O)-ON(R) directional switch 84 is in the OFF(O) position, however, when the switching means 86 of the ON(L)-OFF(O)-ON(R) directional switch 84 is in the ON(R) position and the Push-On/Push-Off switch 88 is in the ON position the mascara carried on applicator head 78 must only be applied to the Right Eye-Upper Group of eyelashes and/or the Left Eye-Lower Group of eyelashes due to the clockwise rotation of applicator head 78; and when the switching means 86 of the ON(L)-OFF(O)-ON(R) directional switch 84 is in the ON(L) position and the Push-On/Push-Off switch 88 is in the ON position the mascara carried on applicator head 78 must only be applied to the Left Eye-Upper Group of eyelashes and/or the Right Eye-Lower Group of eyelashes due to the counterclockwise rotation of applicator head 78. In addition, a User is informed that it is recommended to have the Push-On/Push-Off switch 88 in the OFF position during the insertion of the applicator head 78 through opening 118 of the detachable container 14 and then through opening 122 of the surface stripper 120 into the chamber 116. Once the applicator head 78 is fully within the chamber 116 of the detachable container 14 the Push-On/Push-Off switch 88 may be positioned to the ON position momentarily thereby shearing the mascara within the chamber 116 thus lowering the viscosity of the mascara to be loaded onto applicator head 78 for the eventual depositing of the mascara to the eyelashes.

In operation of the Reciprocating Rotating Vibrating Bidirectional Electric Cosmetic Applicator 10, a User may first separate the detachable container 14 from the handle 12 by holding the detachable container 14 firmly while rotating the handle 12 to the left until the continued rotation of handle 12 causes the complete separation of the matched outer helical ridge 114 of the detachable container 14 from the matched inner helical ridge 92 of handle 12. A User then pulls the applicator head 78 of handle 12 through opening 122 of the surface stripper 120 of the detachable container 14 thus evenly compressing and distributing the mascara onto applicator head 78 for application purposes; and then guides the applicator head 78 through opening 118 of the detachable container 14.

A User then positions the switching means 86 of the ON(L)-OFF(O)-ON(R) directional switch 84 to the OFF(O) position thereby, establishing the desired electrical circuit for the electrical current to flow from batteries 20 to and through the Push-On/Push-Off switch 88 to the disk coin-type vibration motor 68 thereby, assuring that the applicator head 78 will not simultaneously rotate and reciprocate when the Push-On/Push-Off switch 88 is positioned to the ON position but will only vibrate. This operational step of positioning the switching means 86 of the ON(L)-OFF(O)-ON(R) directional switch 84 to the OFF(O) position could have been performed by a User prior to the separation of the detachable container 14 from handle 12.

A User then positions the Push-On/Push-Off switch 88 to the ON position completing the selected circuit thereby causing the electrical current to begin to flow from batteries 20 to and through the Push-On/Push-Off switch 88 to the disk coin-type vibration motor 68 causing the disk coin-type vibration motor 68 to begin to vibrate. The vibration produced by the disk coin-type vibration motor 68 continually flows to and through the base 508 of transfer head 70; to and through the domed portion 72 of transfer head 70; to and through the rotating and reciprocating rotatable shaft 56; and to and through the directly connected applicator head 78, as shown in FIG. 15, or in another embodiment to and through the indirectly connected to applicator head 78 via the locking mechanism 98, as shown in FIG. 18, or yet in another embodiment to and through the indirectly connected to applicator head 78 via the locking mechanism 98 and coupled stem 108, as shown in FIG. 20.

While applicator head 78 is receiving transfer vibrations and vibrating a User transfers the mascara from applicator head 78 to the desired eyelash group by touching the applicator head 78 to the desired eyelash group thereby enabling a deposit of the mascara carried by the applicator head 78 to the desired eyelash group. The transfer vibration to the applicator head 78 continues until a User positions the Push-On/Push-Off switch 88 to the OFF position.

A User while the Push-On/Push-Off switch 88 is in the OFF position inserts of the applicator head 78 through opening 118 of the detachable container 14 and then through opening 122 of the surface stripper 120 into the chamber 116 of the detachable container 14. Once the applicator head 78 is fully within the chamber 116 the Push-On/Push-Off switch 88 may be positioned to the ON position momentarily thereby shearing the mascara by way of vibration within the chamber 116 thus lowering the viscosity of the mascara to be loaded onto applicator head 78 for the eventual depositing of the mascara to the eyelashes.

Once a User completes the application of mascara to all of the desired eyelash groups, a User inserts the applicator head 78 through opening 118 of the detachable container 14; through opening 122 of the surface stripper 120 into the chamber 116 of the detachable container 14, and then, holds the detachable container 14 firmly while rotating the handle 12 to the right until the continued rotation of the matched outer helical ridge 114 of the detachable container 14 and the matched inner helical ridge 92 of handle 12 tightly seal handle 12 with the detachable container 14.

The Present Invention in Operation

Figure 30:
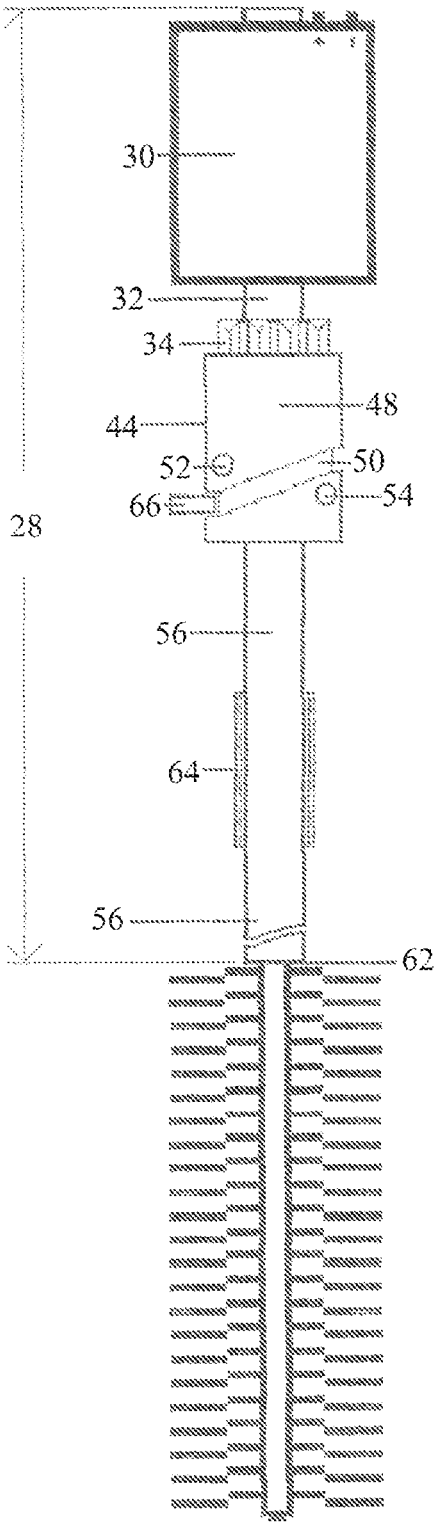
FIG. 30 is a side view illustrating the very beginning of the forward stroke of the reciprocating cycle of a two-stroke looping cam groove track profile of the reciprocating, rotating, bidirectional electric cosmetic applicator shown in FIG. 15.
Figure 31:
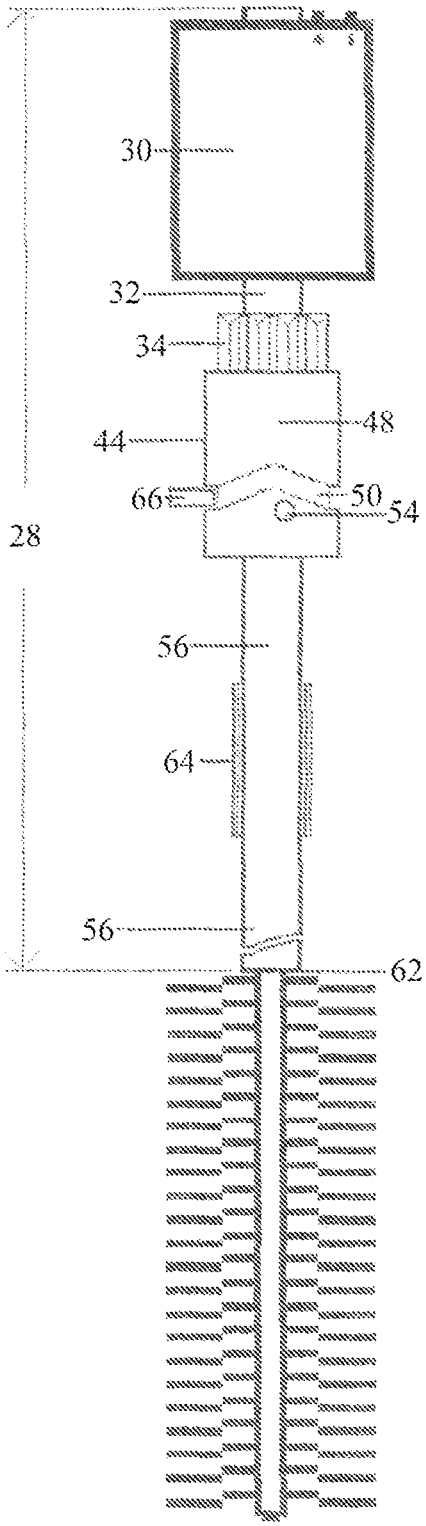
FIG. 31 is a side view illustrating the half-way position of the forward stroke of the reciprocating cycle of a two-stroke looping cam groove track profile of the reciprocating, rotating, bidirectional electric cosmetic applicator shown in FIG. 15.

When the Vibration Components are not Included in the Device and when the ON(L)-OFF(O)-ON(R) Directional Switch 84 is in the R Position A User in an alternative embodiment of the Reciprocating Rotating Vibrating Bidirectional Electric Cosmetic Applicator 10 in which the Push-On/Push-Off switch, the disk coin-type vibration motor and the transfer head are taken out, as shown in FIG. 15 must first be made known that a two-stroke looping cam groove track 50 profile of the looping cam groove track 50 profile group 510, shown in FIG. 22, is being utilized as looping cam groove track 50 of a mating female slidable oblong multipurpose component 44, and secondly, that an established operational commencing point of the reciprocating cycle of the two-stroke looping cam groove track 50 profile must be assigned for purposes of explanation due to the reciprocating nature of the drive mechanism 28 as described above. Therefore, the very beginning of the forward stroke of the reciprocating cycle of the two-stroke looping cam groove track 50 profile shall be the established operational commencing point, as shown in FIG. 30. Hereafter, the operational commencing point will always be determined at that point within the reciprocating cycle when the most recent deactivation of the flow of electrical current from batteries 20 occurred by way of the Push-On/Push-Off switch 88 being positioned to the OFF position or by way of switching means 86 of the ON(L)-OFF(O)-ON(R) directional switch 84 being positioned to the OFF(O) position.

Before a User operates the present invention a User must be informed that mascara carried on applicator head 78 may be applied to any group of eyelashes when the switching means 86 of the ON(L)-OFF(O)-ON(R) directional switch 84 is in the OFF(O) position, however, when the switching means 86 of the ON(L)-OFF(O)-ON(R) directional switch 84 is in the ON(R) position and the Push-On/Push-Off switch 88 is in the ON position the mascara carried on applicator head 78 must only be applied to the Right Eye-Upper Group of eyelashes and/or the Left Eye-Lower Group of eyelashes due to the clockwise rotation of applicator head 78; and when the switching means 86 of the ON(L)-OFF(O)-ON(R) directional switch 84 is in the ON(L) position and the Push-On/Push-Off switch 88 is in the ON position the mascara carried on applicator head 78 must only be applied to the Left Eye-Upper Group of eyelashes and/or the Right Eye-Lower Group of eyelashes due to the counterclockwise rotation of applicator head 78. In addition, a User is informed that it is recommended to have the Push-On/Push-Off switch 88 in the OFF position during the insertion of the applicator head 78 through opening 118 of the detachable container 14 and then through opening 122 of the surface stripper 120 into the chamber 116. Once the applicator head 78 is fully within the chamber 116 of the detachable container 14 the Push-On/Push-Off switch 88 may be positioned to the ON position momentarily thereby shearing the mascara within the chamber 116 thus lowering the viscosity of the mascara to be loaded onto applicator head 78 for the eventual depositing of the mascara to the eyelashes.

In operation of the Reciprocating Rotating Vibrating Bidirectional Electric Cosmetic Applicator 10 in which the Push-On/Push-Off switch, the disk coin-type vibration motor and the transfer head are taken out, as shown in FIG. 15, a User may first separate the detachable container 14 from the handle 12 by holding the detachable container 14 firmly while rotating the handle 12 to the left until the continued rotation of handle 12 causes the complete separation of the matched outer helical ridge 114 of the detachable container 14 from the matched inner helical ridge 92 of handle 12. A User then pulls the applicator head 78 of handle 12 through opening 122 of the surface stripper 120 of the detachable container 14 thus evenly compressing and distributing the mascara onto applicator head 78 for application purposes; and then guides the applicator head 78 through opening 118 of the detachable container 14. The compressed and evenly distributed mascara carried on applicator head 78 may be applied to any group of eyelashes when the switching means 86 of the ON(L)-OFF(O)-ON(R) directional switch 84 is in the OFF(O) position, however, when the switching means 86 of the ON(L)-OFF(O)-ON(R) directional switch 84 is in the ON(R) position and the Push-On/Push-Off switch 88 is in the ON position the mascara carried on applicator head 78 must only be applied to the Right Eye-Upper Group of eyelashes and/or the Left Eye-Lower Group of eyelashes due to the clockwise rotation of applicator head 78; and when the switching means 86 of the ON(L)-OFF(O)-ON(R) directional switch 84 is in the ON(L) position and the Push-On/Push-Off switch 88 is in the ON position the mascara carried on applicator head 78 must only be applied to the Left Eye-Upper Group of eyelashes and/or the Right Eye-Lower Group of eyelashes due to the counterclockwise rotation of applicator head 78.

A User then positions the switching means 86 of the ON(L)-OFF(O)-ON(R) directional switch 84 from the OFF (O) position to the ON(R) position, thereby establishing the desired electrical circuit for the electrical current to flow from batteries 20 to and through the Push-On/Push-Off switch 88 and to and through the ON(L)-OFF(O)-ON(R) directional switch 84 to the torque gear box motor 30. This operational step of positioning the switching means 86 of the ON(L)-OFF(O)-ON(R) directional switch 84 from the OFF (O) position to the ON(R) position could have been performed by a User prior to the separation of the detachable container 14 from handle 12.

A User then positions the Push-On/Push-Off switch 88 to the ON position completing the selected circuit thereby causing the electrical current to begin to flow from batteries 20 to and through the Push-On/Push-Off switch 88; and then to and through the ON(R) position circuitry of the ON(L)-OFF(O)-ON(R) directional switch 84 to the torque gear box motor 30 causing the motor shaft 32 to rotate in a clockwise direction. As the motor shaft 32 is rotating in a clockwise direction the mating male spline gear 34 carried on motor shaft 32 is also rotating in a clockwise direction and transmits that clockwise rotation by way of the series of narrow keys (external splines) 36 of the mating male spline gear 34 to the series of corresponding grooves (internal splines) 46 of the mating female slidable oblong multipurpose component 44 causing the mating female slidable oblong multipurpose component 44 to rotate in a clockwise direction. At the very moment when the mating female slidable oblong multipurpose component 44 begins to rotate in a clockwise direction, an interaction between the embedded a two-stroke looping cam groove track 50 profile on the elongated surface 48 of the mating female slidable oblong multipurpose component 44 and the stationary cam follower 66 of the drive mechanism 28 does occur. More particularly, the stationary cam follower 66 transmits the movement dictated by the embedded two-stroke looping cam groove track 50 profile on the elongated surface 48 of the mating female slidable oblong 40 multipurpose component 44 to the mating female slidable oblong multipurpose component 44 thereby causing the series of corresponding grooves (internal splines) 46 of the mating female slidable oblong multipurpose component 44 to begin to slide in a forward direction on the series of narrow keys (external splines) 36 of the mating male spline gear 34 marking the beginning of the reciprocation cycle of the two-stroke looping cam groove track 50 profile.

In addition, the rotatable shaft 56 whose first end 58, as shown in FIG. 12, is centrally affixed to closed end 60 of the mating female slidable oblong multipurpose component 44 and whose second end 62 is connectable directly to applicator head 78, as shown in FIG. 15, or in another embodiment whose second end 62 is connectable indirectly to applicator head 78 via the locking mechanism 98, as shown in FIG. 18, or yet in another embodiment whose second end 62 is connectable indirectly to applicator head 78 via the locking mechanism 98 and coupled stem 108, as shown in FIG. 20 are also being rotated in a clockwise direction and sliding in a forward direction towards the completion of the forward stroke of the reciprocation cycle of the two-stroke looping cam groove track 50 profile. The clockwise rotation and sliding in a forward direction of the rotatable shaft 56 is supported by bushing 64, shown in FIG. 1.

Figure 32:
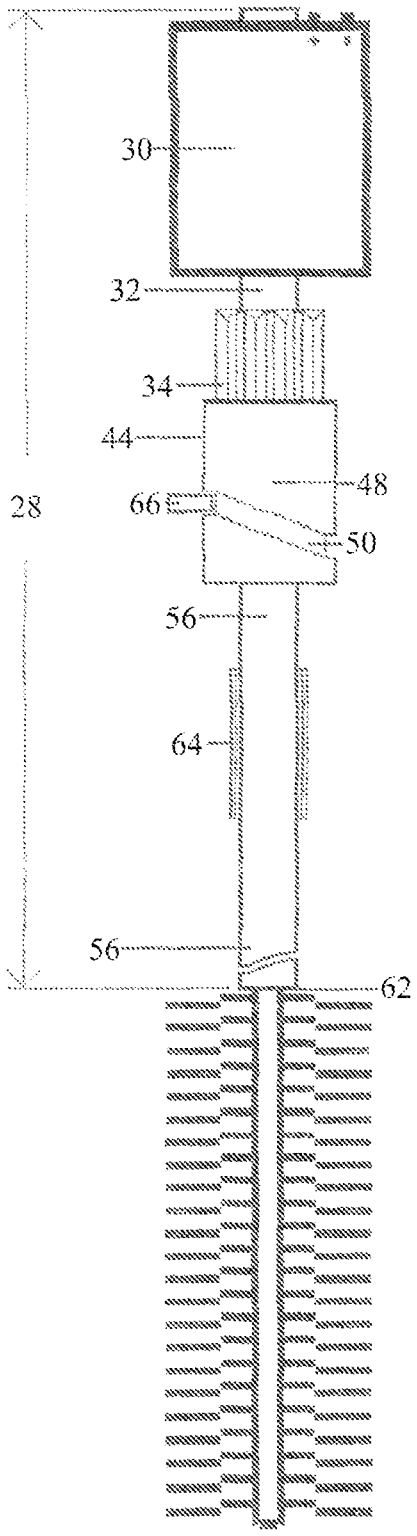
FIG. 32 is a side view illustrating the very end of the forward stroke of the reciprocating cycle of a two-stroke looping cam groove track profile of the reciprocating, rotating, bidirectional electric cosmetic applicator shown in FIG. 15.
Figure 33:
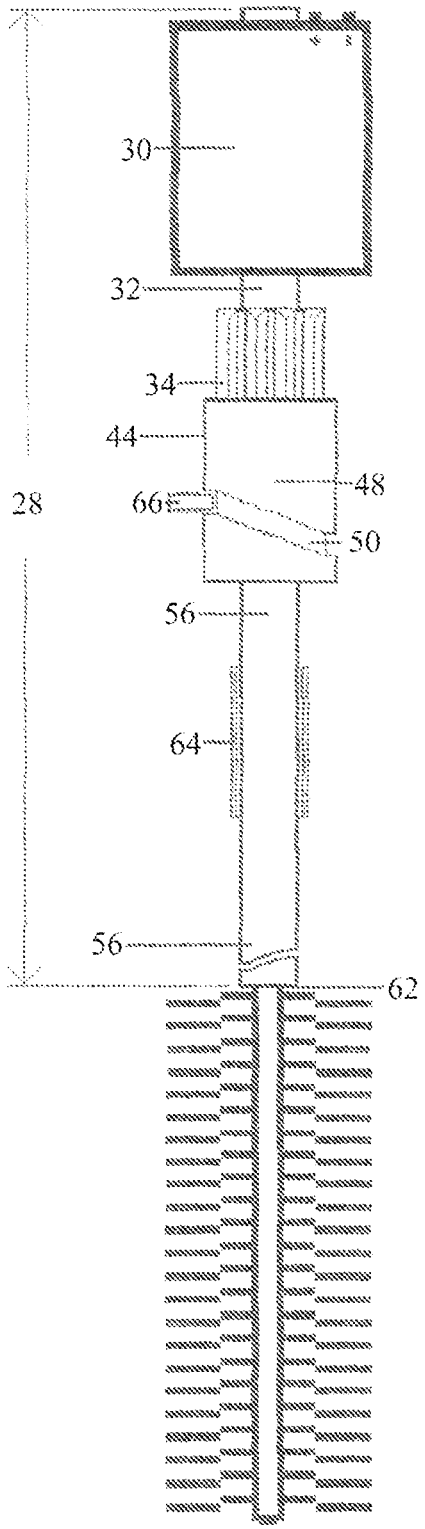
FIG. 33 is a side view illustrating the very beginning of the backward stroke of the reciprocating cycle of a two-stroke looping cam groove track profile of the reciprocating, rotating, bidirectional electric cosmetic applicator shown in FIG. 15.
Figure 34:
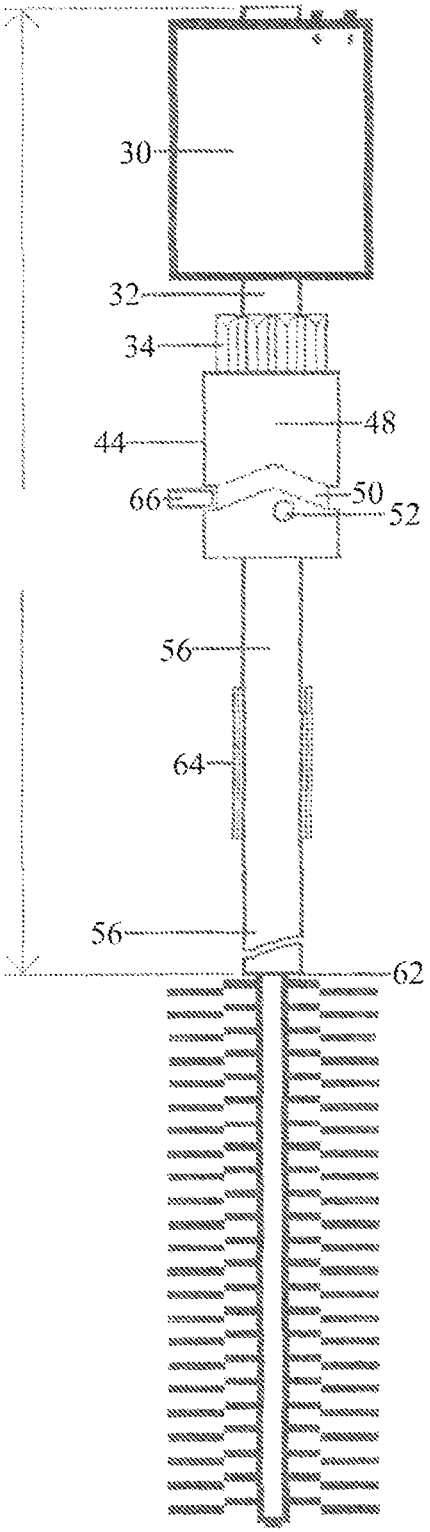
FIG. 34 is a side view illustrating the half-way backward stroke of the reciprocating cycle of a two-stroke looping cam groove track profile of the reciprocating, rotating, bidirectional electric cosmetic applicator shown in FIG. 15.

As the mating female slidable oblong multipurpose component 44 continues to be rotated clockwise by the transmitted clockwise rotation of the mating male spline gear 34, the embedded two-stroke looping cam groove track 50 on the elongated surface 48 of the mating female slidable oblong multipurpose component 44 that is continually engaged with the stationary cam follower 66 continues to progressively transmit the movement dictated by the two-stroke looping cam groove track 50 profile on the elongated surface 48 of the mating female slidable oblong multipurpose component 44 to the mating female slidable oblong multipurpose component 44 causing the series of corresponding grooves (internal splines) 46 of the mating female slidable oblong multipurpose component 44 to continue to slide in a forward direction on the series of narrow keys (external splines) 36 of the mating male spline gear 34, thereby continuing to drive the mating female slidable oblong multipurpose component 44, the attached rotatable shaft 56 and applicator head 78, as shown in FIG. 15, or in another embodiment the indirectly connected applicator head 78 via the directly connected locking mechanism 98, as shown in FIG. 18, or yet in another embodiment the indirectly connected applicator head 78 via the directly connected locking mechanism 98 and coupled stem 108, as shown in FIG. 20 in a forward direction until the furthest forward point of the reciprocating cycle of the two-stroke looping cam groove track 50 profile dictated by the two-stroke looping cam groove track 50 profile is reached marking the end of the forward stroke, as shown in FIG. 32.

As the mating female slidable oblong multipurpose component 44 continues to receive transmitted clockwise rotation and rotate clockwise, the embedded two-stroke looping cam groove track 50 on the elongated surface 48 of the mating female slidable oblong multipurpose component 44 that is continually engaged with the stationary cam follower 66 continues to transmit the movement dictated by the two-stroke looping cam groove track 50 profile on the elongated surface 48 of the mating female slidable oblong multipurpose component 44 to the mating female slidable oblong multipurpose component 44 resulting in the mating female slidable oblong multipurpose component 44, the attached rotatable shaft 56 and applicator head 78, as shown in FIG. 15, or in another embodiment the indirectly connected applicator head 78 via the directly connected locking mechanism 98, as shown in FIG. 18, or yet in another embodiment the indirectly connected applicator head 78 via the directly connected locking mechanism 98 and coupled stem 108, as shown in FIG. 20 to loop into the backward stroke of the reciprocation cycle of the two-stroke looping cam groove track 50 profile causing the series of corresponding grooves (internal splines) 46 of the mating female slidable oblong multipurpose component 44 to slide in a backward direction on the series of narrow keys (external splines) 36 of the mating male spline gear 34, and continues to do so, until the furthest backward peak of the reciprocating cycle of the two-stroke looping cam groove track 50 profile dictated by the two-stroke looping cam groove track 50 profile is reached marking the end of the backward stroke, as shown in FIG. 11.

Whereupon, the continuation of the mating female slidable oblong multipurpose component 44 receiving transmitted clockwise rotation and rotating clockwise results in the continuation of the embedded two-stroke looping cam groove track 50 on the elongated surface 48 of the mating female slidable oblong multipurpose component 44 that is continually engaged with the stationary cam follower 66 to progressively transmit the movement dictated by the two-stroke looping cam groove track 50 profile of the elongated surface 48 of the mating female slidable oblong multipurpose component 44 to the mating female slidable oblong multipurpose component 44 resulting in an immediate looping back to and entering into and completing the forward stroke of the reciprocation cycle; and then, the looping back to and entering into and completing the backward stroke of the reciprocation cycle and so forth and so on. The rotation and reciprocation cycle of the two-stroke looping cam groove track 50 profile is shown in FIGS. 30 thru 35.

The repeated reciprocation of the series of corresponding grooves (internal splines) 46 of the mating female slidable oblong multipurpose component 44 sliding forward and backward on the series of narrow keys (external splines) 36 of the mating male spline gear 34 creates air movement within the open drive mechanism compartment 24 that freely flows within to and fro through air flow shaft 40 and air flow shaft 42 of the mating male spline gear 34, as shown in FIG. 5, as well as, to and fro through air passageway 52 and air passageway 54 of the mating female slidable oblong multipurpose component 44, as shown in FIGS. 5 and 6; and to and fro through the air flow shaft 82, shown in FIG. 1 during the entire operation of the Reciprocating Rotating Vibrating Bidirectional Electric Cosmetic Applicator 10.

Once a User completes the application of mascara to all of the desired eyelash groups, a User inserts the applicator head 78 through opening 118 of the detachable container 14; through opening 122 of the surface stripper 120 into the chamber 116 of the detachable container 14, and then, holds the detachable container 14 firmly while rotating the handle 12 to the right until the continued rotation of the matched outer helical ridge 114 of the detachable container 14 and the matched inner helical ridge 92 of handle 12 tightly seal handle 12 with the detachable container 14.

In the present embodiment and operation of the invention described above a two-stroke looping cam groove track 50 profile of the looping cam groove track 50 profile group 510, as shown in FIG. 22 was utilized. Therefore, for every clockwise revolution of motor shaft 32 by torque gear box motor 30 the applicator head 78 simultaneously revolved once in the same rotational direction of the motor shaft 32 and traveled once forward and once backward equally in distance according to the reciprocating cycle shown in the 360° flat elongated surface of the mating female slidable oblong multipurpose component 44 diagram 140 shown in FIG. 22.

However, in some embodiments a four-stroke looping cam groove track profile of the looping cam groove track 50 profile group 510, as shown in FIG. 23 is utilized as looping cam groove track 50. Therefore, for every clockwise revolution of motor shaft 32, by torque gear box motor 30, the applicator head 78 simultaneously revolved once, in the same rotational direction of the motor shaft 32 and traveled backward, forward, backward and forward equally in distance according to the reciprocating cycle shown in the 360° flat elongated surface of the mating female slidable oblong multipurpose component 44 diagram 174 of FIG. 23; and yet, in another embodiment a six-stroke looping cam groove track 50 profile of the looping cam groove track 50 profile group 510 is utilized as looping cam groove track 50. Therefore, for every clockwise revolution of motor shaft 32 by torque gear box motor 30, the applicator head 78 simultaneously revolves once, in the same rotational direction of the motor shaft 32 and traveled backward, forward, backward, forward, backward and forward equally in distance according to the reciprocating cycle shown in the 360° flat elongated surface of the mating female slidable oblong multipurpose component 44 diagram 224 of FIG. 24; and yet, in other embodiments an eight-stroke looping cam groove track 50 profile of the looping cam groove track 50 profile group 510 is utilized as looping cam groove track 50. Therefore, for every clockwise revolution of motor shaft 32 by torque gear box motor 30, the applicator head 78 simultaneously revolves once, in the same rotational direction of the motor shaft 32 and traveled backward, forward, backward, forward, backward, forward, backward and forward equally in distance according to the reciprocating cycle shown in the 360° flat elongated surface of the mating female slidable oblong multipurpose component 44 diagram 290 of FIG. 25; and yet, in yet other embodiments a four-stroke looping cam groove track 50 profile of the looping cam groove track 50 profile group 510 having length segment variations is utilized as looping cam groove track 50. Therefore, for every clockwise revolution of motor shaft 32 by torque gear box motor 30 the applicator head 78 simultaneously revolves once, in the same rotational direction of the motor shaft 32 and traveled backward a greater distance, forward a lesser distance, backward a lesser distance and forward a greater distance according to the reciprocating cycle shown in the 360° flat elongated surface of the mating female slidable oblong multipurpose component 44 diagram 324 of FIG. 26; and yet, in another embodiments a six-stroke looping cam groove track 50 profile of the looping cam groove track 50 profile group 510 having length segment variations is utilized as looping cam groove track 50. Therefore, for every clockwise revolution of motor shaft 32 by torque gear box motor 30, the applicator head 78 simultaneously revolves once, in the same rotational direction of the motor shaft 32 and traveled backward a great distance, forward a great distance, backward a less distance, forward a less distance, backward a great distance and forward a great distance according to the reciprocating cycle shown in the 360° flat elongated surface of the mating female slidable oblong multipurpose component 44 diagram 374 of FIG. 27; and yet, in yet another embodiments an eight-stroke looping cam groove track 50 profile of the looping cam groove track 50 profile group 510 having length segment variations is utilized as looping cam groove track 50. Therefore, for every clockwise revolution of motor shaft 32, by torque gear box motor 30, the applicator head 78 simultaneously revolves once, in the same rotational direction of the motor shaft 32 and traveled backward a great distance, forward a great distance, backward a less distance, forward a less distance, backward a great distance, forward a great distance, backward a less distance and forward a less distance according to the reciprocating cycle shown in the 360° flat elongated surface of the mating female slidable oblong multipurpose component 44 diagram 440 of FIG. 28; and yet, in yet other embodiments an eight-stroke looping cam groove track profile having other length segment variations, as shown in FIG. 29 an eight-stroke looping cam groove track 50 profile of the looping cam groove track 50 profile group 510 having other length segment variations is utilized as looping cam groove track 50. Therefore, for every clockwise revolution of motor shaft 32 by torque gear box motor 30, the applicator head 78 simultaneously revolves once, in the same rotational direction of the motor shaft 32 and traveled backward a great distance, forward a great distance, backward a less distance, forward a less distance, backward a less distance, forward a less distance, backward a great distance and forward a great distance according to the reciprocating cycle shown in the 360° flat elongated surface of the mating female slidable oblong multipurpose component 44 diagram 506 of FIG. 29.

The Present Invention in Operation

When the Vibration Components are not Included in the Device and when the ON(L)-OFF(O)-ON(R) Directional Switch 84 is in the L Position A User in an alternative embodiment of the Reciprocating Rotating Vibrating Bidirectional Electric Cosmetic Applicator 10 in which the Push-On/Push-Off switch, the disk coin-type vibration motor and the transfer head are taken out, as shown in FIG. 15 must first be made known that a two-stroke looping cam groove track 50 profile of the looping cam groove track 50 profile group 510, shown in FIG. 22, is being utilized as looping cam groove track 50 of a mating female slidable oblong multipurpose component 44, and secondly, that an established operational commencing point of the reciprocating cycle of the two-stroke looping cam groove track 50 profile must be assigned for purposes of explanation due to the reciprocating nature of the drive mechanism 28 as described above. Therefore, the very beginning of the backward stroke of the reciprocating cycle of the two-stroke looping cam groove track 50 profile shall be the established operational commencing point, as shown in FIG. 9. Hereafter, the operational commencing point will always be determined at that point within the reciprocating cycle when the most recent deactivation of the flow of electrical current from batteries 20 occurred by way of the Push-On/Push-Off switch 88 being positioned to the OFF position or by way of switching means 86 of the ON(L)-OFF(O)-ON(R) directional switch 84 being positioned to the OFF(O) position.

Before a User operates the present invention a User must be informed that the mascara carried on applicator head 78 may be applied to any group of eyelashes when the switching means 86 of the ON(L)-OFF(O)-ON(R) directional switch 84 is in the OFF(O) position, however, when the switching means 86 of the ON(L)-OFF(O)-ON(R) directional switch 84 is in the ON(R) position and the Push-On/Push-Off switch 88 is in the ON position the mascara carried on applicator head 78 must only be applied to the Right Eye-Upper Group of eyelashes and/or the Left Eye-Lower Group of eyelashes due to the clockwise rotation of applicator head 78; and when the switching means 86 of the ON(L)-OFF(O)-ON(R) directional switch 84 is in the ON(L) position and the Push-On/Push-Off switch 88 is in the ON position the mascara carried on applicator head 78 must only be applied to the Left Eye-Upper Group of eyelashes and/or the Right Eye-Lower Group of eyelashes due to the counterclockwise rotation of applicator head 78. In addition, a User is informed that it is recommended to have the Push-On/Push-Off switch 88 in the OFF position during the insertion of the applicator head 78 through opening 118 of the detachable container 14 and then through opening 122 of the surface stripper 120 into the chamber 116. Once the applicator head 78 is fully within the chamber 116 of the detachable container 14 the Push-On/Push-Off switch 88 may be positioned to the ON position momentarily thereby shearing the mascara within the chamber 116 thus lowering the viscosity of the mascara to be loaded onto applicator head 78 for the eventual depositing of the mascara to the eyelashes.

In operation of the Reciprocating Rotating Vibrating Bidirectional Electric Cosmetic Applicator 10 in which the Push-On/Push-Off switch, the disk coin-type vibration motor and the transfer head are taken out, as shown in FIG. 15, a User may first separate the detachable container 14 from the handle 12 by holding the detachable container 14 firmly while rotating the handle 12 to the left until the continued rotation of handle 12 causes the complete separation of the matched outer helical ridge 114 of the detachable container 14 from the matched inner helical ridge 92 of handle 12. A User then pulls the applicator head 78 of handle 12 through opening 122 of the surface stripper 120 of the detachable container 14 thus evenly compressing and distributing the mascara onto applicator head 78 for application purposes; and then guides the applicator head 78 through opening 118 of the detachable container 14. The compressed and evenly distributed mascara carried on applicator head 78 may be applied to any group of eyelashes when the switching means 86 of the ON(L)-OFF(O)-ON(R) directional switch 84 is in the OFF(O) position, however, when the switching means 86 of the ON(L)-OFF(O)-ON(R) directional switch 84 is in the ON(R) position and the Push-On/Push-Off switch 88 is in the ON position the mascara carried on applicator head 78 must only be applied to the Right Eye-Upper Group of eyelashes and/or the Left Eye-Lower Group of eyelashes due to the clockwise rotation of applicator head 78; and when the switching means 86 of the ON(L)-OFF(O)-ON(R) directional switch 84 is in the ON(L) position and the Push-On/Push-Off switch 88 is in the ON position the mascara carried on applicator head 78 must only be applied to the Left Eye-Upper Group of eyelashes and/or the Right Eye-Lower Group of eyelashes due to the counterclockwise rotation of applicator head 78.

A User then positions the switching means 86 of the ON(L)-OFF(O)-ON(R) directional switch 84 from the OFF (O) position to the ON(L) position, thereby establishing the desired electrical circuit for the electrical current to flow from batteries 20 to and through the Push-On/Push-Off-switch 88 and to and through the ON(L)-OFF(O)-ON(R) directional switch 84 to the torque gear box motor 30. This operational step of positioning the switching means 86 of the ON(L)-OFF(O)-ON(R) directional switch 84 from the OFF (O) position to the ON(L) position could have been performed by a User prior to the separation of the detachable container 14 from handle 12.

A User then positions the Push-On/Push-Off switch 88 to the ON position completing the selected circuit thereby causing the electrical current to begin to flow from batteries 20 to and through the Push-On/Push-Off switch 88; and then to and through the ON(L) position circuitry of the ON(L)-OFF(O)-ON(R) directional switch 84 to the torque gear box motor 30 causing the motor shaft 32 to rotate in a counterclockwise direction. As the motor shaft 32 is rotating in a counterclockwise direction the mating male spline gear 34 carried on motor shaft 32 is also rotating in a counterclockwise direction and transmits that counterclockwise rotation by way of the series of narrow keys (external splines) 36 of the mating male spline gear 34 to the series of corresponding grooves (internal splines) 46 of the mating female slidable oblong multipurpose component 44 causing the mating female slidable oblong multipurpose component 44 to rotate in a counterclockwise direction. At the very moment when the mating female slidable oblong multipurpose component 44 begins to rotate in a counterclockwise direction, an interaction between the embedded a two-stroke looping cam groove track 50 profile on the elongated surface 48 of the mating female slidable oblong multipurpose component 44 and the stationary cam follower 66 of the drive mechanism 28 does occur. More particularly, the stationary cam follower 66 transmits the movement dictated by the embedded two-stroke looping cam groove track 50 profile on the elongated surface 48 of the mating female slidable oblong 40 multipurpose component 44 to the mating female slidable oblong multipurpose component 44 thereby causing the series of corresponding grooves (internal splines) 46 of the mating female slidable oblong multipurpose component 44 to begin to slide in a backward direction on the series of narrow keys (external splines) 36 of the mating male spline gear 34 marking the beginning of the reciprocation cycle of the two-stroke looping cam groove track 50 profile.

In addition, the rotatable shaft 56 whose first end 58, as shown in FIG. 12, is centrally affixed to closed end 60 of the mating female slidable oblong multipurpose component 44 and whose second end 62 is connectable directly to applicator head 78, as shown in FIG. 15, or in another embodiment whose second end 62 is connectable indirectly to applicator head 78 via the locking mechanism 98, as shown in FIG. 18, or yet in another embodiment whose second end 62 is connectable indirectly to applicator head 78 via the locking mechanism 98 and coupled stem 108, as shown in FIG. 20 are also being rotated in a counterclockwise direction and sliding in a backward direction towards the completion of the backward stroke of the reciprocation cycle of the two-stroke looping cam groove track 50 profile. The counterclockwise rotation and sliding in a backward direction of the rotatable shaft 56 is supported by bushing 64, shown in FIG. 1.

Figure 35:
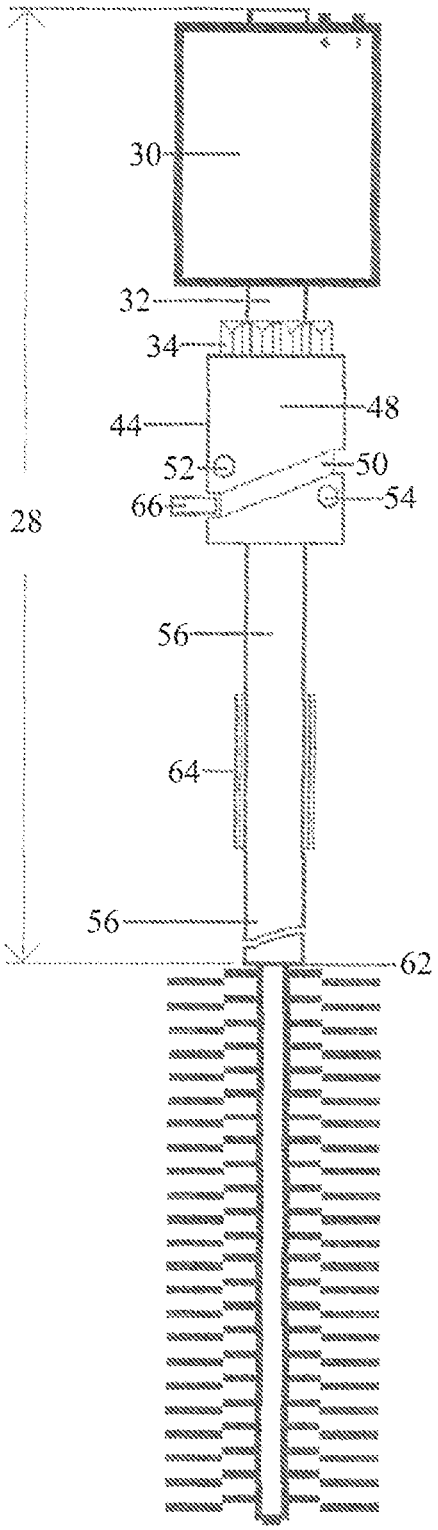
FIG. 35 is a side view illustrating the very end of the backward stroke of the reciprocating cycle of a two-stroke looping cam groove track profile of the reciprocating, rotating, bidirectional electric cosmetic applicator shown in FIG. 15.

As the mating female slidable oblong multipurpose component 44 continues to be rotated counterclockwise by the transmitted counterclockwise rotation of the mating male spline gear 34, the embedded two-stroke looping cam groove track 50 on the elongated surface 48 of the mating female slidable oblong multipurpose component 44 that is continually engaged with the stationary cam follower 66 continues to progressively transmit the movement dictated by the two-stroke looping cam groove track 50 profile on the elongated surface 48 of the mating female slidable oblong multipurpose component 44 to the mating female slidable oblong multipurpose component 44 causing the series of corresponding grooves (internal splines) 46 of the mating female slidable oblong multipurpose component 44 to continue to slide in a backward direction on the series of narrow keys (external splines) 36 of the mating male spline gear 34, thereby continuing to drive the mating female slidable oblong multipurpose component 44, the attached rotatable shaft 56 and applicator head 78, as shown in FIG. 15, or in another embodiment the indirectly connected applicator head 78 via the directly connected locking mechanism 98, as shown in FIG. 18, or yet in another embodiment the indirectly connected applicator head 78 via the directly connected locking mechanism 98 and coupled stem 108, as shown in FIG. 20 in a backward direction until the furthest backward point of the reciprocating cycle of the two-stroke looping cam groove track 50 profile dictated by the two-stroke looping cam groove track 50 profile is reached marking the end of the backward stroke, as shown in FIG. 35.

As the mating female slidable oblong multipurpose component 44 continues to receive transmitted counterclockwise rotation and rotate counterclockwise, the embedded two-stroke looping cam groove track 50 on the elongated surface 48 of the mating female slidable oblong multipurpose component 44 that is continually engaged with the stationary cam follower 66 continues to transmit the movement dictated by the two-stroke looping cam groove track 50 profile on the elongated surface 48 of the mating female slidable oblong multipurpose component 44 to the mating female slidable oblong multipurpose component 44 resulting in the mating female slidable oblong multipurpose component 44, the attached rotatable shaft 56 and applicator head 78, as shown in FIG. 15, or in another embodiment the indirectly connected applicator head 78 via the directly connected locking mechanism 98, as shown in FIG. 18, or yet in another embodiment the indirectly connected applicator head 78 via the directly connected locking mechanism 98 and coupled stem 108, as shown in FIG. 20 to loop into the forward stroke of the reciprocation cycle of the two-stroke looping cam groove track 50 profile causing the series of corresponding grooves (internal splines) 46 of the mating female slidable oblong multipurpose component 44 to slide in a forward direction on the series of narrow keys (external splines) 36 of the mating male spline gear 34, and continues to do so, until the furthest forward peak of the reciprocating cycle of the two-stroke looping cam groove track 50 profile dictated by the two-stroke looping cam groove track 50 profile is reached marking the end of the forward stroke, as shown in FIG. 32.

Whereupon, the continuation of the mating female slidable oblong multipurpose component 44 receiving transmitted counterclockwise rotation and rotating counterclockwise results in the continuation of the embedded two-stroke looping cam groove track 50 on the elongated surface 48 of the mating female slidable oblong multipurpose component 44 that is continually engaged with the stationary cam follower 66 to progressively transmit the movement dictated by the two-stroke looping cam groove track 50 profile of the elongated surface 48 of the mating female slidable oblong multipurpose component 44 to the mating female slidable oblong multipurpose component 44 resulting in an immediate looping back to and entering into and completing the backward stroke of the reciprocation cycle; and then, the looping back to and entering into and completing the forward stroke of the reciprocation cycle and so forth and so on. The rotation and reciprocation cycle of the two-stroke looping cam groove track 50 profile is shown in FIGS. 30 thru 35.

The repeated reciprocation of the series of corresponding grooves (internal splines) 46 of the mating female slidable oblong multipurpose component 44 sliding backward and forward on the series of narrow keys (external splines) 36 of the mating male spline gear 34 creates air movement within the open drive mechanism compartment 24 that freely flows within to and fro through air flow shaft 40 and air flow shaft 42 of the mating male spline gear 34, as shown in FIG. 5, as well as, to and fro through air passageway 52 and air passageway 54 of the mating female slidable oblong multipurpose component 44, as shown in FIGS. 5 and 6; and to and fro through the air flow shaft 82, shown in FIG. 1 during the entire operation of the Reciprocating Rotating Vibrating Bidirectional Electric Cosmetic Applicator 10.

While applicator head 78 is simultaneously reciprocating, rotating counterclockwise and vibrating a User transfers the mascara from applicator head 78 to the Left Eye-Upper Group of eyelashes and/or the Right Eye-Lower Group of eyelashes thereby providing a User a new unmatched ultimate mascara application experience. The simultaneous reciprocation, counterclockwise rotation and vibration the applicator head 78 continues until a User positions the Push-On/Push-Off switch 88 to the OFF position.

Once a User completes the application of mascara to all of the desired eyelash groups, a User inserts the applicator head 78 through opening 118 of the detachable container 14; through opening 122 of the surface stripper 120 into the chamber 116 of the detachable container 14, and then, holds the detachable container 14 firmly while rotating the handle 12 to the right until the continued rotation of the matched outer helical ridge 114 of the detachable container 14 and the matched inner helical ridge 92 of handle 12 tightly seal handle 12 with the detachable container 14.

In the present embodiment and operation of the invention described above a two-stroke looping cam groove track 50 profile of the looping cam groove track 50 profile group 510, as shown in FIG. 22 was utilized. Therefore, for every counterclockwise revolution of motor shaft 32 by torque gear box motor 30 the applicator head 78 simultaneously revolved once in the same rotational direction of the motor shaft 32 and traveled once backward and once forward equally in distance according to the reciprocating cycle shown in the 360° flat elongated surface of the mating female slidable oblong multipurpose component 44 diagram 140 shown in FIG. 22.

However, in some embodiments a four-stroke looping cam groove track profile of the looping cam groove track 50 profile group 510, as shown in FIG. 23 is utilized as looping cam groove track 50. Therefore, for every counterclockwise revolution of motor shaft 32, by torque gear box motor 30, the applicator head 78 simultaneously revolved once, in the same rotational direction of the motor shaft 32 and traveled forward, backward, forward and backward equally in distance according to the reciprocating cycle shown in the 360° flat elongated surface of the mating female slidable oblong multipurpose component 44 diagram 174 of FIG. 23; and yet, in another embodiment a six-stroke looping cam groove track 50 profile of the looping cam groove track 50 profile group 510 is utilized as looping cam groove track 50. Therefore, for every counterclockwise revolution of motor shaft 32 by torque gear box motor 30, the applicator head 78 simultaneously revolves once, in the same rotational direction of the motor shaft 32 and traveled forward, backward, forward, backward, forward and backward equally in distance according to the reciprocating cycle shown in the 360° flat elongated surface of the mating female slidable oblong multipurpose component 44 diagram 224 of FIG. 24; and yet, in other embodiments an eight-stroke looping cam groove track 50 profile of the looping cam groove track 50 profile group 510 is utilized as looping cam groove track 50. Therefore, for every counterclockwise revolution of motor shaft 32 by torque gear box motor 30, the applicator head 78 simultaneously revolves once, in the same rotational direction of the motor shaft 32 and traveled forward, backward, forward, backward, forward, backward, forward and backward equally in distance according to the reciprocating cycle shown in the 360° flat elongated surface of the mating female slidable oblong multipurpose component 44 diagram 290 of FIG. 25; and yet, in yet other embodiments a four-stroke looping cam groove track 50 profile of the looping cam groove track 50 profile group 510 having length segment variations is utilized as looping cam groove track 50. Therefore, for every counterclockwise revolution of motor shaft 32 by torque gear box motor 30 the applicator head 78 simultaneously revolves once, in the same rotational direction of the motor shaft 32 and traveled forward a greater distance, backward a lesser distance, forward a lesser distance and backward a greater distance according to the reciprocating cycle shown in the 360° flat elongated surface of the mating female slidable oblong multipurpose component 44 diagram 324 of FIG. 26; and yet, in another embodiments a six-stroke looping cam groove track 50 profile of the looping cam groove track 50 profile group 510 having length segment variations is utilized as looping cam groove track 50. Therefore, for every counterclockwise revolution of motor shaft 32 by torque gear box motor 30, the applicator head 78 simultaneously revolves once, in the same rotational direction of the motor shaft 32 and traveled forward a great distance, backward a great distance, forward a less distance, backward a less distance, forward a great distance and backward a great distance according to the reciprocating cycle shown in the 306° flat elongated surface of the mating female slidable oblong multipurpose component 44 diagram 374 of FIG. 27; and yet, in yet another embodiments an eight-stroke looping cam groove track 50 profile of the looping cam groove track 50 profile group 510 having length segment variations is utilized as looping cam groove track 50. Therefore, for every counterclockwise revolution of motor shaft 32, by torque gear box motor 30, the applicator head 78 simultaneously revolves once, in the same rotational direction of the motor shaft 32 and traveled forward a great distance, backward a great distance, forward a less distance, backward a less distance, forward a great distance, backward a great distance, forward a less distance and backward a less distance according to the reciprocating cycle shown in the 360° flat elongated surface of the mating female slidable oblong multipurpose component 44 diagram 440 of FIG. 28; and yet, in yet other embodiments an eight-stroke looping cam groove track profile having other length segment variations, as shown in FIG. 29 an eight-stroke looping cam groove track 50 profile of the looping cam groove track 50 profile group 510 having other length segment variations is utilized as looping cam groove track 50. Therefore, for every counterclockwise revolution of motor shaft 32 by torque gear box motor 30, the applicator head 78 simultaneously revolves once, in the same rotational direction of the motor shaft 32 and traveled forward a great distance, backward a great distance, forward a less distance, backward a less distance, forward a less distance, backward a less distance, forward a great distance and backward a great distance according to the reciprocating cycle shown in the 360° flat elongated surface of the mating female slidable oblong multipurpose component 44 diagram 506 of FIG. 29.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An applicator for applying cosmetic product, the applicator comprising:

a handle;

a battery compartment in said handle wherein a battery power source having at least one battery is confined;

a first switching means disposed in said handle between said battery power source and a DC motor whereby said first switching means selectively electrically controls the direction of current flow, so that said DC motor selectively turns normally, reversely or not at all;

said DC motor having a rotatable motor shaft;

said battery power source powers the rotation of said rotatable motor shaft on which is carried a mating male spline gear;

a mating female slidable oblong multipurpose component having therein a closed end, an embedded looping cam groove track and a series of narrow keys having a series of corresponding grooves slidably connected to said mating male spline gear;

a rotatable shaft having a first end and a second end, wherein said first end is centrally affixed to said closed end of said mating female slidable oblong multipurpose component;

an applicator head connectable to said second end of said rotatable shaft;

at least one bushing freely supporting said rotatable shaft;

a profile formed by the shape of said embedded looping cam groove track;

a stationary cam follower having a first end engaged with said embedded looping cam groove track of said mating female slidable oblong multipurpose component;

a drive mechanism wherein said DC motor rotates said rotatable motor shaft and said mating male spline gear that is carried on said rotatable motor shaft in the same direction thereby transmitting said rotation to said mating female slidable oblong multipurpose component by way of the slidably connected said series of narrow keys of said mating male spline gear with said series of corresponding grooves of said mating female slidable oblong multipurpose component thereby enabling said stationary cam follower that is engaged with said embedded looping cam groove track of said mating female slidable oblong multipurpose component to begin to continuously dictate said embedded looping cam groove track profile to said mating female slidable oblong multipurpose component thereby causing said female slidable oblong multipurpose component and the centrally affixed said rotatable shaft which is freely supported by said bushing to reciprocate while being rotated;

an open drive mechanism compartment in said handle housing several components of said drive mechanism;

a reciprocating cycle wherein for every revolution of said rotatable motor shaft by said DC motor said applicator head simultaneously revolved once in the same rotational direction of said rotatable motor shaft and traveled at least once backward and at least once forward; and a detachable container comprising a matched outer helical ridge; a chamber having an opening and a surface stripper having an opening wherein said first opening is disposed on one end of said detachable container, said first opening communicating with said second opening within said first opening of said chamber wherein as said applicator head is removed from said detachable container said applicator head first passes through said opening of said surface stripper where said applicator head brushes or rubs against the wall of said opening thereby removing and distributing a cosmetic product evenly upon said applicator head and then passes through said opening of said chamber.

2. The applicator according to claim 1, wherein said drive mechanism further comprises a disk coin-type vibration motor that is electrically and operatively connected to said first switching means; and a transfer head having a base that is affixed to said disk coin-type vibration motor and a domed portion that rest snugly against said rotatable shaft, whereby upon activation of said first switching means and regardless of the direction of current flow said disk coin-type vibration motor commences vibration and vibrates said base of said transfer head, said domed portion of said transfer head, said rotatable shaft and said applicator head.

3. The applicator according to claim 2, wherein a second switching means disposed in said handle between said battery power source and said first switching means and between said battery power source and said disk coin-type vibration motor whereby said second switching means selectively electrically connects or disconnects said battery power source with said first switching means and connects or disconnects said battery power source with said disk coin-type vibration motor so that upon activation said disk coin-type vibration motor commences vibration and vibrates said base of said transfer head, said domed portion of said transfer head, said rotatable shaft and said applicator head.

4. The applicator according to claim 2, wherein said applicator head simultaneously reciprocate, rotates and vibrates.

5. The applicator according to claim 2, wherein said applicator head vibrates.

6. The applicator according to claim 1, wherein for each revolution of said rotatable motor shaft by said DC motor said applicator head simultaneously revolves once in the same rotational direction of said rotatable motor shaft and reciprocated according to length, frequency and sequence variation dictated by said embedded looping cam groove track profile.

7. The applicator according to claim 1, wherein said applicator head simultaneously reciprocates and rotates.

8. The applicator according to claim 1, wherein said handle further comprises a locking mechanism comprising a male connectable section having an end affixed to said applicator head and a female connectable section having an end affixed to said second end of said rotatable shaft of said drive mechanism wherein said male connectable section is connectable to said female connectable section.

9. The applicator according to claim 1, wherein said handle further comprises a stem extending a distance between said applicator head and said locking mechanism having an end of said stem affixed to said applicator head and having an end of said stem affixed to said end of said male connectable section of said locking mechanism wherein said male connectable section and said female connectable section are connectable.

10. The applicator according to claim 1, wherein said handle further comprises at least one air flow shaft to direct the airflow to and from the said open drive mechanism compartment during operation.

11. The applicator according to claim 1, wherein at least one air flow shaft of said slidable oblong cylindrical mated female component and at least one air flow shaft of said mated male spline component provide passage for air movement that is created by the reciprocation of said slidable oblong cylindrical mated female component upon said mated male spline component.

12. The applicator according to claim 1, wherein said handle and said detachable container rotatably fasten and unfasten.

13. The applicator according to claim 1, wherein said series of narrow keys are etched onto the very end of said rotatable motor shaft in lieu of carrying said mating male spline gear having said series of narrow keys on said rotatable motor shaft.

14. The applicator according to claim 1, wherein said DC motor is a torque gear box motor.

15. The applicator according to claim 1, wherein said embedded looping cam groove track has a defined shape to receive said stationary cam follower.

16. The applicator according to claim 1, wherein a gasket to prevent leakage is placed between said handle and said detachable container.

17. The applicator according to claim 1, wherein said applicator head has a plurality of protrusions spaced to define gaps during rotation, thereby aiding in applying said cosmetic product.

18. The applicator according to claim 1, wherein said applicator head and said stem, said applicator head and said male connectable section of said locking mechanism and said detachable container carrying said cosmetic product are replaceable.

19. The applicator according to claim 1, wherein a shield connected to said handle at one end extents to cover a portion of said rotatable shaft having a seal at the other end of said shield which seals the space between said rotatable shaft and said shield from said cosmetic product.

* * * * *